US006823789B2

(12) United States Patent
Hara et al.

(10) Patent No.: US 6,823,789 B2
(45) Date of Patent: Nov. 30, 2004

(54) CYLINDER CLEANING DEVICE AND CYLINDER CLEANING FABRIC USED THEREFOR

(75) Inventors: Akira Hara, Tokyo (JP); Hideo Oyaizu, Tokyo (JP); Shigeo Isobe, Iwatuki (JP); Takayuki Gotoh, Yamakawa-machi (JP)

(73) Assignee: Baldwin-Japan Ltd., Tokyo (JP)

( * ) Notice: Subject to any disclaimer, the term of this patent is extended or adjusted under 35 U.S.C. 154(b) by 246 days.

(21) Appl. No.: 09/836,786

(22) Filed: Apr. 17, 2001

(65) Prior Publication Data

US 2001/0047561 A1 Dec. 6, 2001

Related U.S. Application Data

(63) Continuation-in-part of application No. 08/813,535, filed on Mar. 7, 1997, now abandoned.

(51) Int. Cl.[7] ..... B41F 35/00
(52) U.S. Cl. ..... 101/425; 15/256.51; 242/364
(58) Field of Search ..... 101/425, 423, 101/479; 242/364, 364.9, 571.2, 365.1, 366, 538.1; 15/256.57; 400/613

(56) References Cited

U.S. PATENT DOCUMENTS

| | | | | |
|---|---|---|---|---|
| 1,392,321 A | | 10/1921 | Gammeter | |
| 1,592,359 A | | 7/1926 | Hawk | |
| 1,746,976 A | | 2/1930 | Wendt | |
| 1,763,794 A | | 6/1930 | Lenston | |
| 2,574,413 A | | 11/1951 | Pugh | |
| 3,391,878 A | | 7/1968 | Naccara | |
| 3,834,641 A | | 9/1974 | Level | |
| 3,863,857 A | | 2/1975 | Smith | |
| 4,575,890 A | * | 3/1986 | Hidle | |
| 5,150,650 A | | 9/1992 | Murakami | |
| 5,337,524 A | * | 8/1994 | Norville | 15/104.002 |
| 5,379,964 A | * | 1/1995 | Pretto et al. | 242/571.2 |
| 5,404,819 A | * | 4/1995 | Hishinuma et al. | 101/425 |
| 5,425,309 A | * | 6/1995 | Saito et al. | 101/425 |
| 5,947,618 A | * | 9/1999 | Keller et al. | 400/613 |
| 6,332,238 B1 | * | 12/2001 | Hara et al. | 15/256.51 |

FOREIGN PATENT DOCUMENTS

| | | |
|---|---|---|
| DE | 2 157 776 A | 4/1973 |
| EP | 0 611 651 A1 | 1/1994 |

OTHER PUBLICATIONS

European Search Report: EP 97 10 4146.

* cited by examiner

*Primary Examiner*—Eugene H. Eickholt

(57) ABSTRACT

Divided shaft members constitute a cleaning fabric take-up shaft, and are secured at both ends by shaft member fixing means that is attached to a side plate. Shaft member fixing portions include a shaft end supporter, for supporting the end of the shaft member, and a plug that is fitted to a shaft receiving section. A wedge portion is provided, which runs across the center of the shaft end supporter and is projected linearly. When this wedge portion is inserted between the shaft members, the diameter of the shaft is increased. At this time, the winding of the cleansing fabric is performed. To dispose of the wound cleaning fabric, the shaft members are detached from the shaft member fixing portions and the wedge is extracted from the shaft members, so that the diameter is reduced, and the cleaning fabric is disengaged from the shaft members. As a result, the cleaning fabric take-up shaft can be removed from the cleaning fabric roll.

21 Claims, 54 Drawing Sheets

Fig. 72
Fig. 72A
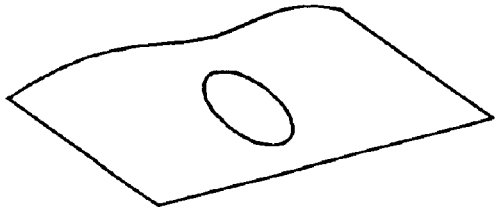
Fig. 72B
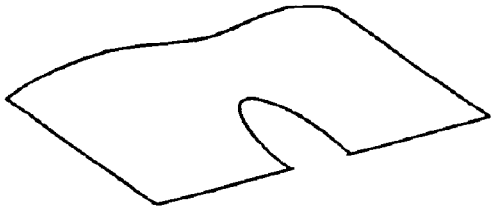
Fig. 72C
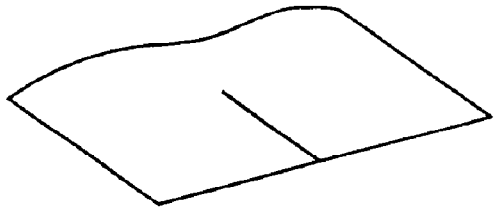
Fig. 72D
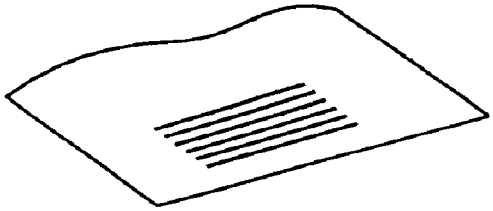

CYLINDER CLEANING DEVICE AND CYLINDER CLEANING FABRIC USED THEREFOR

This application is a continuation-in-part of U.S. Ser. No. 08/813,535, filed Mar. 7, 1997 and now abandoned.

BACKGROUND OF THE INVENTION

1. Field of the Invention

The present invention relates to a cylinder cleaning device for cleaning the surfaces of various cylinders and rolls in an offset printer, and in particular, to a cylinder cleaning device, wherein the structures of cleaning fabric and of a take-up shaft assembly, for winding a waste cleaning fabric, are corruptible in consonance with changes in a diameter of the shaft, configuration and a circumference of the shaft, that can facilitate performance of a disposal process for used cleaning fabric that is wound around a shaft.

2. Related Arts

Generally, in a conventional cylinder cleaning device that uses a cleaning fabric to clean the surface of a blanket cylinder, etc., of an offset printer, the cleaning fabric is fed from a cleaning fabric supplying element that is formed into a roll, or that is reversibly folded, and is pressed against the outer circumference of the cylinder to clean it. After that, the used cleaning fabric is wound around a take-up shaft as the surface of the cylinder is cleaned. As is shown in FIG. 95, belt shaped cleaning fabric 3 that is wound around a core, or that is fan-folded, is used. To form a cleaning fabric roll, the cleaning fabric 3 is wound around a take-up shaft 6 that has on its surface multiple tiny pointed protrusions 6*a*. The take-up shaft assembly is proposed in, for example, Japanese Utility Model Laid-Open No. Hei 5-60843. A plurality of rows of raised and recessed portions are alternately formed around this type of take-up shaft.

When cleaning fabric, from a cleaning fabric supplying element that is attached to a cylinder cleaning device is to be wound around a take-up shaft in order to prepare for cleaning, this must be performed with a cylinder cleaning device that is installed near the cylinder of a printer. Especially because a current printer is compactly made, there is only a narrow space available in which to perform the above process. In addition, without shifting the cleaning fabric on the take-up shaft while it is being wound, it is difficult to wind a wide cleaning fabric (e.g., about 170 cm for newspapers) that passes through a small gap (about 3 cm) between a cylinder surface and a cylinder cleaning device so that no loose portion appears around the take-up shaft, and so that the widthwise side edge of the cleaning fabric is aligned. That is, it is not easy to wind the cleaning fabric around the take-up shaft while keeping the side edge of the cleaning fabric perpendicular to the shaft (to maintain a right angle); how well this procedure is performed depends on the skill of an operator.

When the take-up shaft around which a used cleaning fabric is wound is removed from the cylinder cleaning device, in order to dispose of the fabric roll, the cleaning fabric must be unrolled manually. Since the used cleaning fabric holds ink, a worker tends to become dirty while unrolling it, and as the unrolled used cleaning fabric is easily contaminated and bulky, it is difficult to handle.

SUMMARY OF THE INVENTION

It is therefore one object of the present invention to provide a cylinder cleaning device that has a cleaning fabric take-up shaft assembly that permits a take-up shaft to be easily removed from a cleaning fabric roll.

It is another object of the present invention to provide cleaning fabric that can be accurately and easily attached to a cleaning fabric take-up shaft assembly.

It is an additional object of the present invention to provide a waste cleaning fabric processing method whereby waste cleaning fabric can be removed from a take-up shaft and can be disposed of as a roll of the waste cleaning fabric.

According to the present invention, a cylinder cleaning device for cleaning a circumferential surface of a cylinder by pressing a cleaning fabric passed between cleaning fabric supplying element for the cleaning fabric and cleaning fabric take-up shaft assembly for taking up the cleaning fabric against the circumferential surface of the cylinder, comprises:

a frame; and the cleaning fabric take-up shaft assembly, supported by the frame, that includes a mechanism for mechanically changing a condition where the cleaning fabric, which has been taken up around the cleaning fabric take-up shaft assembly, is in contact with the cleaning fabric take-up shaft assembly.

Preferably, the assembly has a mechanical structure for changing a diameter of the cleaning fabric take-up shaft assembly, a mechanical structure for changing a configuration of the cleaning fabric take-up shaft assembly, or a mechanical structure for changing a circumference of the cleaning fabric take-up shaft assembly.

Since provided for the take-up shaft assembly is an assembly for mechanically changing a condition at an area where the cleaning fabric take-up shaft assembly contacts the cleaning fabric that is, wound around it, its diameter can be reduced after the cleaning fabric has been wound. As a result, the winding force with which the cleaning fabric is applied to the take-up shaft is extremely reduced. Therefore, the take-up shaft can be easily removed from the cleaning fabric roll.

Since the used cleaning fabric is disposed of as a roll, operating efficiency is improved, compared with a conventional case where the used fabric must be unrolled to be disposed of and contamination of the periphery and of workers is reduced. In other words, the maintenance is improved.

When the cleaning fabric take-up shaft is constituted by a plurality of divided shaft members, the structure for changing the diameter is simplified and manufacturing costs are reduced.

For the structure where a wedge shaped member is inserted in and extracted from between the components of the take-up shaft, the diameter can be easily increased or reduced, and the increased diameter can be stably maintained.

When engagement means is provided for the cleaning fabric take-up shaft, the winding of the fabric around the take-up shaft is easy, and the winding process can be stably performed at a right angle.

For the structure for engaging cleaning fabric employing a bar member, a groove and a shaft member, a condition where a cleaning fabric roll contacts the outer periphery of the shaft member is changed by removing the bar member from the shaft member, so that the shaft member is easily removed from the cleaning fabric roll. Especially for a structure where bar members are extracted from a plurality of grooves, the condition where the fabric roll contacts the shaft member can be changed more drastically than can that where a bar member is removed from a single groove, and the removal of the shaft member becomes even easier. For a structure where a plurality of bar members are provided at predetermined intervals for a single groove, the bar members engaged at one side end are released from the shaft member, and are brought near each other by the winding force exerted by the cleaning fabric roll. As a result, the circumference of the shaft is reduced and the contact condition between the shaft member and the fabric roll is changed, so that the removal of the shaft member is easy.

When an oblong bar member is employed, after the bar member is released from the shaft member, it is rotated to reduce the circumference of the shaft, so that the shaft member can be easily removed. In addition, when a gap is defined around the bar member, the bar member is shifted to the gap when it is removed from the shaft end to reduce the circumference of the shaft, and thereafter the shaft member is easily removed.

When a long shaft is used, accordingly, the length of a bar member is increased and its removal from a cleaning fabric roll becomes more difficult. It is preferable that such a long shaft have a structure such that an engagement member is provided at the middle portion of a groove to engage the ends of the bar members on one side, or a structure such that bar members are coupled together in the groove. With such an arrangement and such an engagement member, a short bar member can be employed. As a result, the removal of the bar member is facilitated and the operation can be easily implemented from either side of the shaft.

Furthermore, according to the present invention, a cylinder cleaning device, for cleaning a circumferential surface of a cylinder by pressing a cleaning fabric passed between cleaning fabric supplying element for the cleaning fabric and cleaning fabric take-up shaft assembly for taking up the cleaning fabric against the circumferential surface of the cylinder, comprises:

a frame; and engagement means for engaging means of the cleaning fabric to be engaged at an outer periphery or at a shaft end of the take-up shaft supported by the frame.

With the thus described arrangement, an assembly that easily engages the take-up shaft, and which has a certain strength relative to the rotational direction of the take-up shaft, is provided at a predetermined end portion, or at a location at which the cleaning fabric can be engaged, so that engaging the cleaning fabric with the take-up shaft is easily accomplished, the positioning is accurate, the attachment of the fabric around the take-up shaft can be precisely performed.

When an engagement release mechanism is provided, a phenomenon such that used cleaning fabric sticks to the take-up shaft can be prevented, and the used cleaning fabric roll can be easily removed from the take-up shaft. Especially since the engagement/disengagement function can be implemented by only one mechanism, the device can be simplified.

Reinforcement, or coating or impregnation with low friction material, or with a curing agent, is performed for the portion where the means of the cleaning fabric to be engaged is provided to prevent deformation of that portion, and engagement/disengagement can be stably performed.

The portion that contacts the outer periphery of the take-up shaft on the cleaning fabric side and/or the outer periphery of the take-up shaft are smoothed, and the used cleaning fabric can be removed from the take-up shaft and can be disposed of as a roll. Thus, the handling of the used cleaning fabric is improved.

In the structure where the engagement means is provided for the member of the cleaning fabric to be engaged, which is at the outer periphery of the take-up shaft, the member to be engaged with which the used cleaning fabric is wound is removed from the take-up shaft, and from the outside is pushed toward the center to reduce the diameter of the take-up shaft, and make it possible to remove the member to be engaged.

Further, according to the present invention, cylinder cleaning fabric is wound into a roll or is fan-folded, and has means to be engaged, which engages engagement means on a take-up shaft that is installed in a cylinder cleaning device.

Preferably, a cleaning fabric, or a connection member contiguous with the cleaning fabric, has a smooth portion that contacts an outer surface of a take-up shaft, and a hole, a slit, a cut, or a cut-out strip is formed at or near the end of the fabric.

As another method, a cleaning fabric mounting element is provided on the cleaning fabric side. The cleaning fabric mounting element is constituted by one or more bar members, or string members attached to a cleaning fabric, or to a member that is added to the cleaning fabric. Further, a cleaning fabric mounting element obtained by processing a cleaning element, or a member added to the cleaning fabric, is provided.

A cleaning fabric is easily wound around a take-up shaft by engaging the means to be engaged of the cleaning fabric with the above described engagement means, and a right angle can be stably maintained.

BRIEF DESCRIPTION OF THE DRAWINGS

FIGS. 72A through 72D are diagrams for explaining other examples of the cylinder cleaning fabric;

DETAILED DESCRIPTION OF THE PREFERRED EMBODIMENTS

Figure 96:
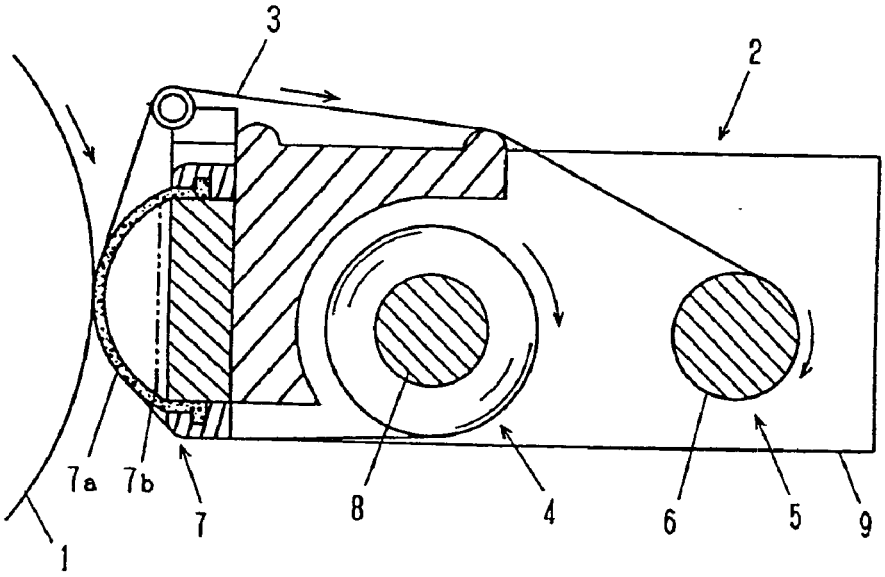
FIG. 96 is a cross-sectional view of the schematic arrangement of a cylinder cleaning device.

The preferred embodiments of the present invention will now be described while referring to the accompanying drawings. FIG. 96 is a cross-sectional view of the basic structure of a cylinder cleaning device according to the present invention. The cylinder cleaning device serves as a cleaning unit 2 that is installed facing a cylinder 1 of a printer. The cleaning unit 2 comprises a cleaning fabric supplying element 4, for feeding cleaning fabric 3; a cleaning fabric take-up shaft section 5, for winding the cleaning fabric 3 from the cleaning fabric supplying element 4; and a cylinder pressing part, for pressing, against the surface of the cylinder 1, the cleaning fabric 3 that is held taut between the cleaning fabric supplying element 4 and the cleaning fabric take-up shaft section 5. These components are supported by side plates 9 that are parts of a frame constituting the cleaning unit 2.

As is shown in FIG. 96, the cylinder pressing part supplies compressed air to an inflation member 7*a* that, when inflated, presses the cleaning fabric against the surface of the cylinder 1. Further, the cylinder pressing part releases air from the inflation member 7*a* to deflate it, as is indicated by a broken line 7*b*, and thus separate the cleaning fabric 3 from the surface of the cylinder 1.

The cleaning fabric supplying element 4 is used for a roll of the cleaning fabric 3, or for fan-folded cleaning fabric 3. Especially, a cleaning fabric roll having a tube core or a bar core, or one that has no core, can be used. The cleaning fabric 3 consists of woven or non-woven cloth, paper or film, or one of them for which some processing has been performed, or another similar material. The processed cleaning fabric can be material impregnated with a liquid, or material impregnated with a liquid and then packaged in a vacuum. The cleaning fabric 3 also includes material coated with a cleaning jelly or a cleaning paste.

The cleaning fabric take-up shaft section 5 is constituted by a cleaning fabric take-up shaft 6, and a constant distance winding mechanism (not shown) that applies, to the take-up shaft 6, the rotational force required to wind the cleaning fabric 3 a constant distance around the take-up shaft 6. A cleaning fabric feeding shaft 8 for supplying the cleaning fabric supplying element 4, the cleaning fabric take-up shaft 6 and the constant distance winding mechanism are assembled inside the side plates 9.

A cleaning fabric take-up shaft assembly according to the present invention comprises a plurality of mechanical components to provide an assembly for mechanically changing the condition at the location where the take-up shaft and the cleaning fabric contact each other. In the following explanation, the cleaning fabric take-up shaft assembly is referred to as a "cleaning fabric take-up shaft."

An explanation will be given for a structure for changing the diameter of the cleaning fabric take-up shaft, which serves as the assembly for mechanically changing the condition at the location where the take-up shaft contacts the cleaning fabric that is wound around it.

Figure 1:
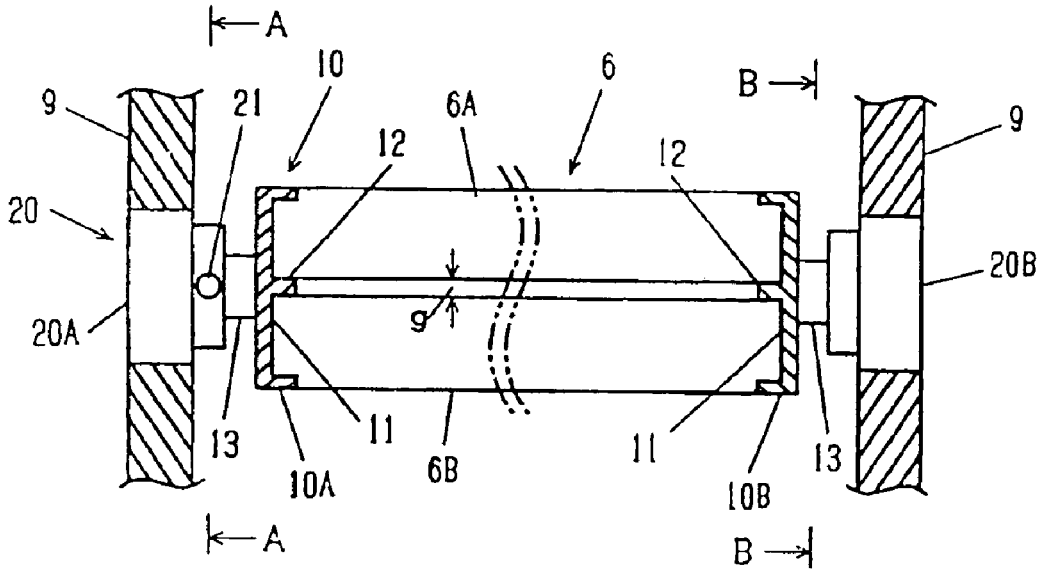
FIG. 1 is front view of a cleaning fabric take-up shaft according to one embodiment of the present invention.

FIG. 1 is a front view of a cleaning fabric take-up shaft according to one embodiment of the present invention. FIG. 2A is an exploded front view of a shaft member, and FIG. 2B is an exploded side view of the shaft member. In this embodiment, a plurality of divided shaft members, such as two or three shaft members, are fixed at either end to provide a cleaning fabric take-up shaft. In this embodiment, two divided shaft members are employed to explain the structure used to change the diameter of the cleaning fabric take-up shaft, but three divided shaft members can also be employed.

Figure 2:
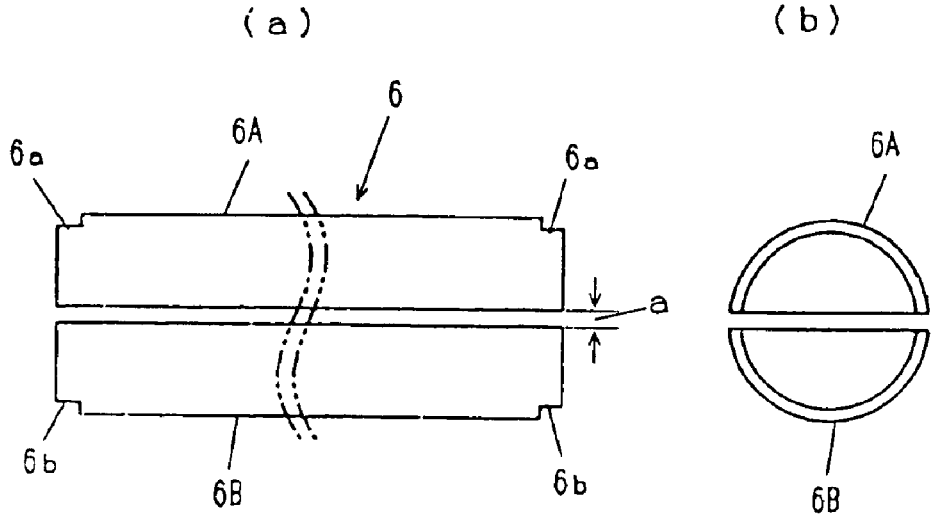
FIG. 2A is an exploded front view of a shaft member.
FIG. 2B is an exploded side view of the shaft member.
Figure 3:
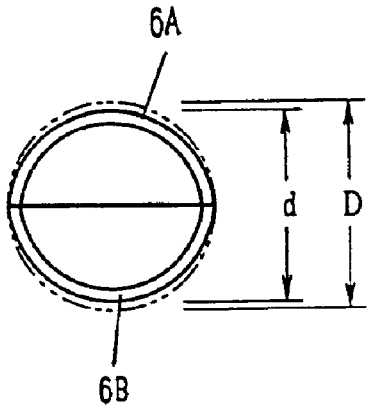
FIG. 3 is diagram for explaining a diameter attained by the shaft member.

The cleaning fabric take-up shaft 6 has two separate half cylindrical shaft members 6A and 6B. Both ends of the shaft members 6A and 6B are secured by shaft member fixing means that is attached to the side plate 9. As is shown in FIG. 2, the shaft members 6A and 6B have substantially semicircular cross sections obtained by cutting through a cylinder and removing a portion having a predetermined width, a. When the cut faces of the shaft members are abut against each other, a diameter, d of the cylinder is smaller than a diameter, D, as is shown in FIG. 3. Cut-down portions 6*a* and 6*b* are formed at either end of each of shaft members 6A and 6B.

Figure 4:
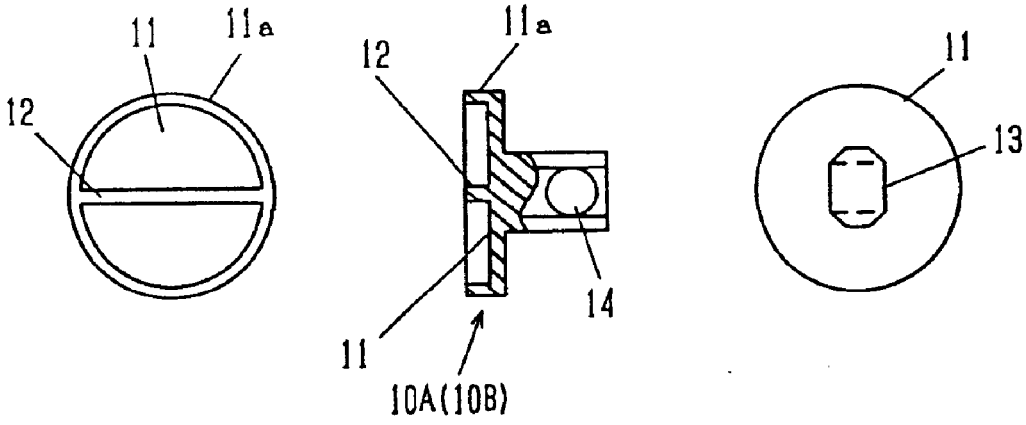
FIG. 4 is a diagram for explaining a shaft member fixing portion.
Figure 5:
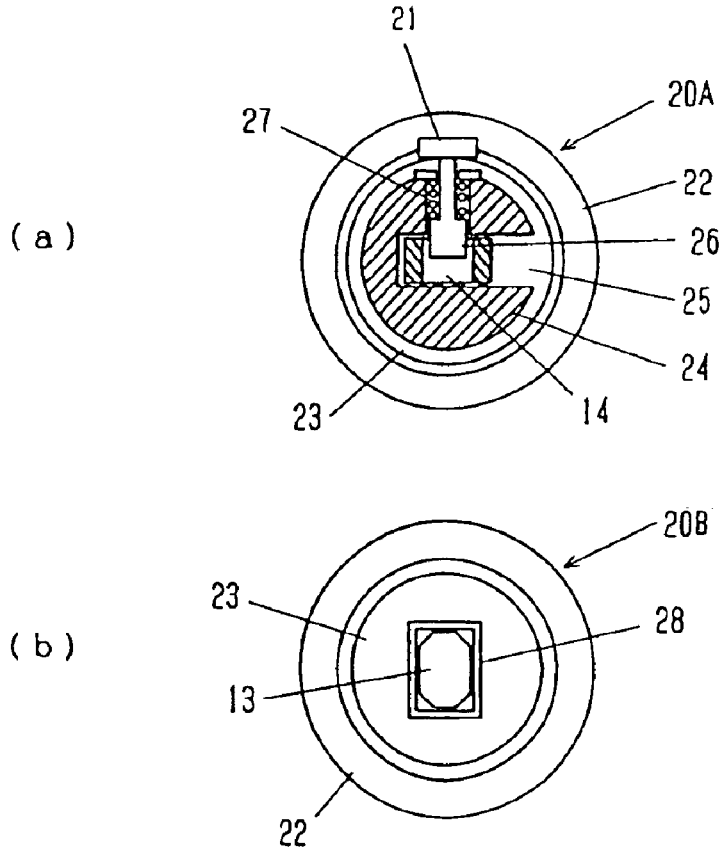
FIG. 5A is a cross-sectional view taken along line A—A in FIG. 1.
FIG. 5B is a cross-sectional view taken along line B—B in FIG. 1.

The shaft member fixing section 10 comprises a first shaft member fixing portion 10A, for securing one end of each shaft member, and a second shaft member fixing portion 10B, for securing the other end of each shaft member. The structure used in common for the first and the second shaft member fixing portions 10A and 10B will now be described while referring to FIG. 4. Each of the shaft member fixing portions 10A and 10B includes a shaft end supporting section 11, for supporting the ends of the shaft member 6, and a plug 13 that is to be loaded into a bearing member 20. In the shaft end supporting section 11 are provided a ring convex portion 11*a* into which the cut-down portions 6*a* and 6*b* of the shaft members 6A and 6*b* are inserted, and a linear wedge convex portion 12 having a predetermined width that extends across the center of the circle formed by the ring convex portion 11*a*. The polygonal plug 13 is provided on the rear face of the shaft end supporting section 11 for insertion into the shaft receiving section 20. A pin hole 14 is formed in the plug 13. An operating knob 21 for a connecting pin 26, which is inserted into the pin hole 14 in the plug 13, is provided for a left shaft receiving section 20A in FIG. 1. In this case, as is shown in FIG. 5B, a polygonal plug receiving hole 28, into which the plug 13 is inserted, is formed for a right shaft receiving section 20B. A spring 27 is used to drive the connection pin 26 into a groove 25.

FIGS. 5A and 5B are examples of the shaft receiving section. The shaft receiving sections 20A and 20B are constituted by a shaft supporter 22 fixed to the side plate 9, and a rotary shaft 23 rotatably attached to the shaft supporter 22. The rotary shaft 23 has a shaft coupling 24 to which is coupled the cleaning fabric take-up shaft 6. To feed the cleaning fabric 3 a constant distance, the rotary shaft 23 of the shaft receiving section 20B is coupled via an arm with a rotation mechanism (not shown), i.e., a piston for an air cylinder, for the cleaning fabric take-up shaft 6. The horizontal open groove 25 is formed in a shaft coupling 24 for the left shaft receiving section 20A. The connection pin 26 is formed so that it can be retracted into a groove perpendicular to the groove 25. The operating knob 21 is attached to the end of the connection pin 26.

The assembling and the removal of the cleaning fabric take-up shaft 6 will now be described. First, for assembling the take-up shaft 6, both ends of the shaft members 6A and 6B are inserted into the ring convex portion 11*a* of the shaft member fixing portions 10A and 10B. At this time, as is shown in FIG. 1, the wedge portion 12 is inserted between the shaft members 6A and 6B to define a gap, g having a predetermined width, and to provide a larger diameter. In this condition, the plug 13 of the right shaft member fixing portion 10B is fitted into the shaft receiving section 20B. Then, the position of the plug 13 of the shaft member fixing portion is moved closer to the shaft receiving section 20B, and is inserted into the groove 25 from the side. Following this, the connection pin 26 is inserted into the hole 14 of the plug 13 to couple together the plug 13 of the shaft member fixing portion 10A and the shaft receiving section 20B.

Figure 6:
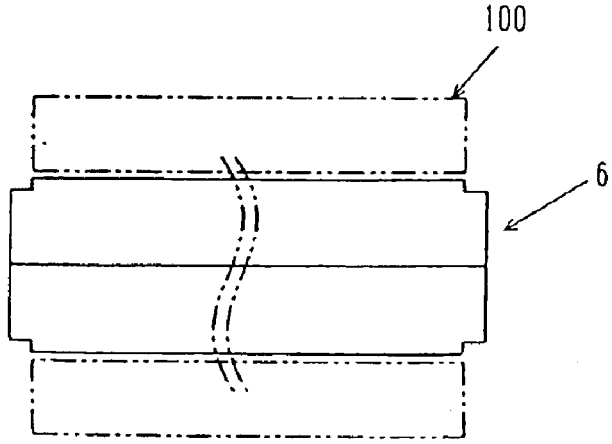
FIG. 6 is a diagram for explaining when a cleaning fabric take-up shaft is removed from a cleaning fabric roll.
Figure 7:
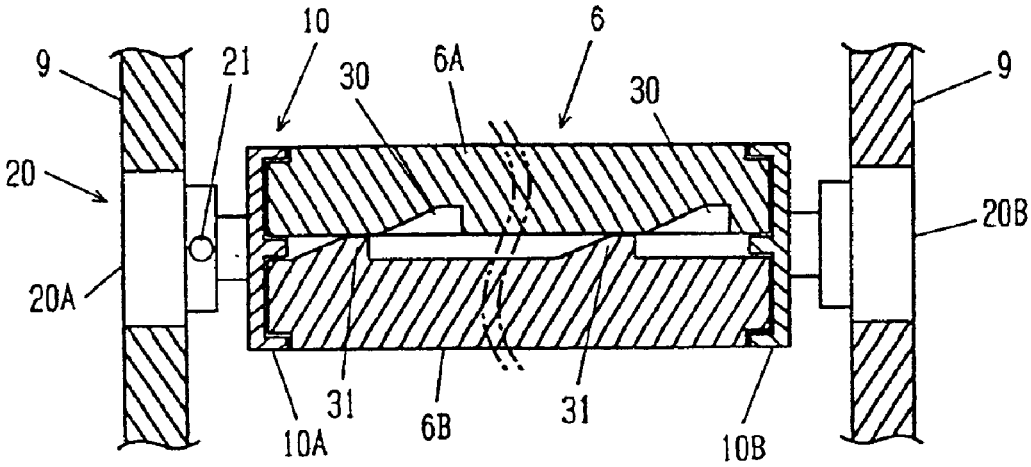
FIG. 7 is a front view of a cleaning fabric take-up shaft according to another embodiment of the present invention.
Figure 8:
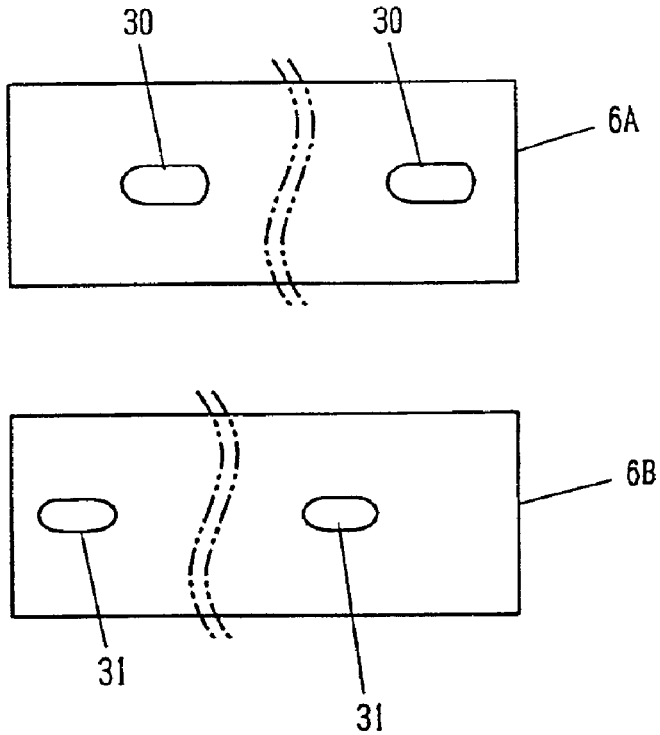
FIG. 8 is a plan view of a shaft member.
Figure 9:
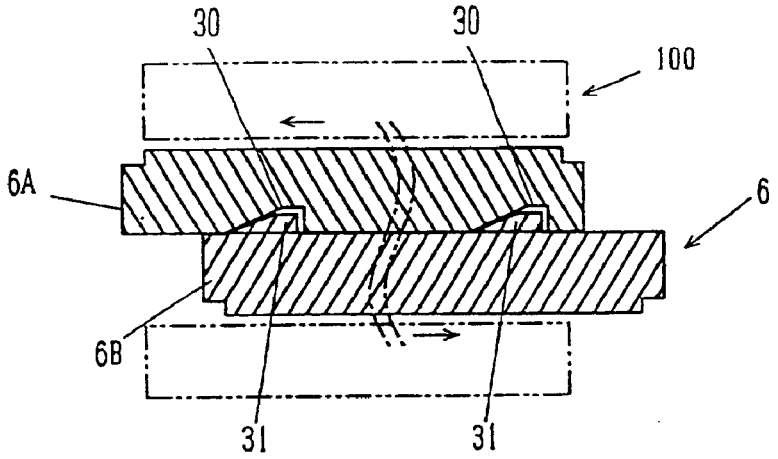
FIG. 9 is a diagram for explaining how a cleaning fabric take-up shaft is removed from a cleaning fabric roll.

The used cleaning fabric 3 that is wound around the cleaning fabric take-up shaft 6 is disposed of by removing the shaft member fixing portion 10 from the shaft receiving section 20. More specifically, the connection pin 26 is extracted by operating the knob 21, and the plug 13 is removed from the shaft receiving section 20. Then, the plug 13 of the shaft member fixing portion 10 on the other end is removed from the shaft receiving section 20. Thereafter, the shaft member fixing portion 10 is removed, and the wedge 12 is extracted from between the shaft members 6A and 6B. As a result, the shaft members 6A and 6B approach each other, i.e., they move until they are positioned as is shown in FIG. 6, and the diameter of the take-up shaft 6 is reduced. Following this, when the end of the shaft assembly is hit, the cleaning fabric take-up shaft 6 pops out of cleaning fabric roll 100, and can then be pulled out by grasping it at its end. In this manner, the cleaning fabric take-up shaft 6 can be removed from the cleaning fabric roll 100, which thereafter is easily disposed of In FIG. 7 is shown another embodiment for the structure for changing the diameter of the cleaning fabric take-up shaft 6. FIG. 8 is a plan view of shaft members. In this embodiment, means for changing the diameter is provided on the faces of the divided shaft members that are positioned opposite each other. The means for changing the diameter includes one or more recessed portions 30, which are formed on a shaft member 6A, and protrusions 31, which are formed on another shaft member 6B. The protrusions 31 are appropriately shaped and sized so that they can fit into the recessed portions 30. As is shown in FIG. 7, the positions of the recessed portions 30 and the protrusions 31 are shifted when the ends of the shaft 6 are secured by the shaft member fixing portion 10. And since when the protrusions 31 are shifted they contact areas outside the recessed portions 30 of the facing shaft member 6A, a gap is formed between the shaft members 6A and 6B that is equivalent to the height of the protrusions 31, and the diameter of the take-up shaft 6 is increased. Basically, the assembling and removal of the cleaning fabric take-up shaft 6 are performed in the sue manner as in the first embodiment. The only difference is that the shaft members 6A and 6B are moved in the axial direction to reduce the diameter. When the cleaning fabric take-up shaft 6 is to be removed from the cleaning fabric roll 100, as is shown in FIG. 9, the shaft member fixing portion is removed. Then one, or both, of the shaft members 6A and 6B is moved in a direction indicated by an arrow, and the protrusions 31 are inserted into the recessed portions 30 and reduce the diameter. Thereafter, the end of the shaft that projects from the cleaning fabric roll 100 is grasped and the take-up shaft 6 is pulled out of the roll 100.

Figure 10:
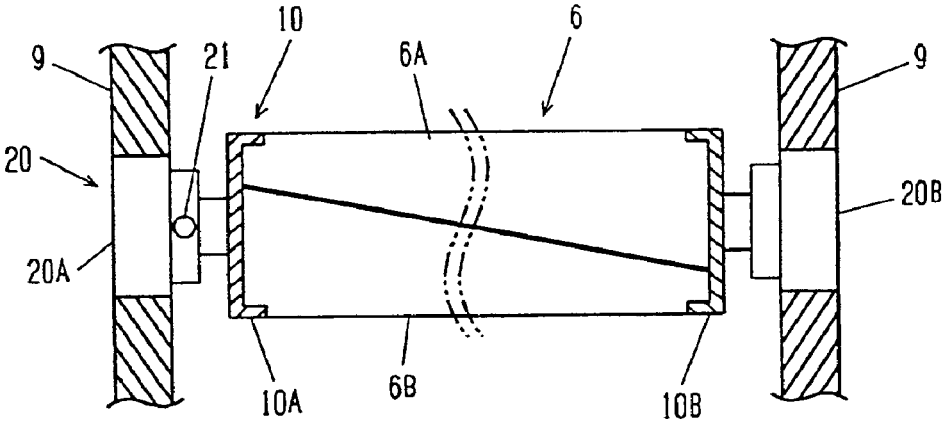
FIG. 10 is a front view of a modification of the take-up shaft for changing the diameter of a cleaning fabric take-up shaft.

In FIG. 10 is shown a modification of the structure for changing the diameter that involves the moving of one, or both, of the shaft members in the axial direction. This modification provides means for changing the diameter by using shaft members having inclined faces that are positioned opposite each other. The means for changing the diameter is acquired by longitudinally cutting a solid-core cylinder, at a predetermined angle relative to the center line, to form wedge-shaped shaft members having semicircular cross sections.

Figure 11:
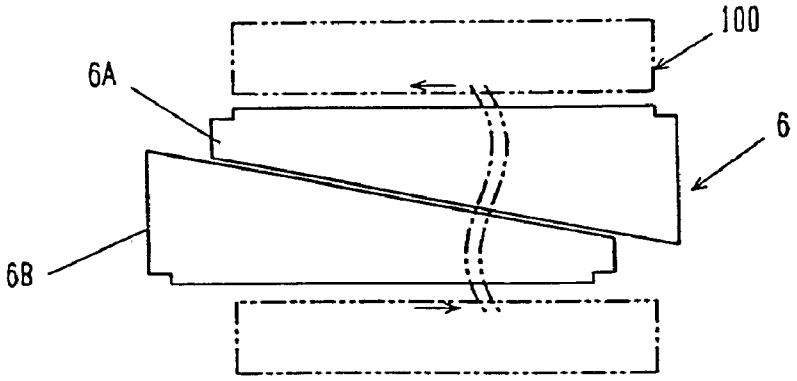
FIG. 11 is a diagram for explaining a condition where a cleaning fabric take-up shaft is removed from a cleaning fabric roll.

In order to remove the cleaning fabric take-up shaft 6 from the cleaning fabric roll 100, as is shown in FIG. 11, the shaft member fixing portion 10 is removed, and one, or both, of the shaft members 6A and 6B is moved in a direction indicated by an arrow. Since the relative position of the shaft members 6A and 6B is altered because of the movement along the inclined faces, the diameter is reduced. Then, the end of the shaft that projects from the cleaning fabric roll 100 is grasped and pulled out.

Although in this example the protrusions 31 are integrally formed on the shaft member 6B, the protrusions 31 may be formed separately and then secured to the shaft member by small screws.

Figure 12:
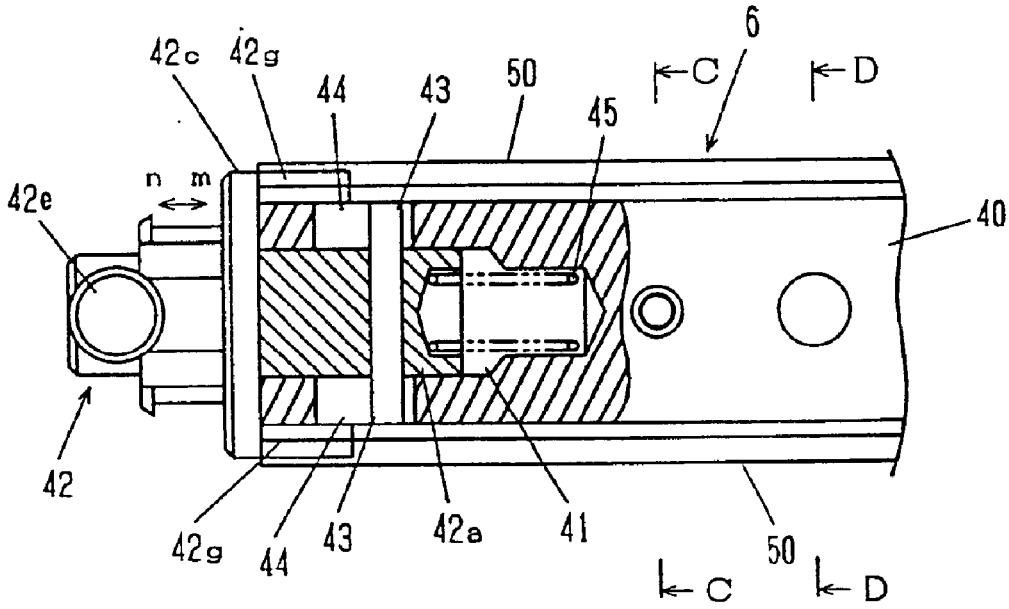
FIG. 12 is a side front view of a cleaning fabric take-up shaft according to an additional embodiment of the present invention.
Figure 13:
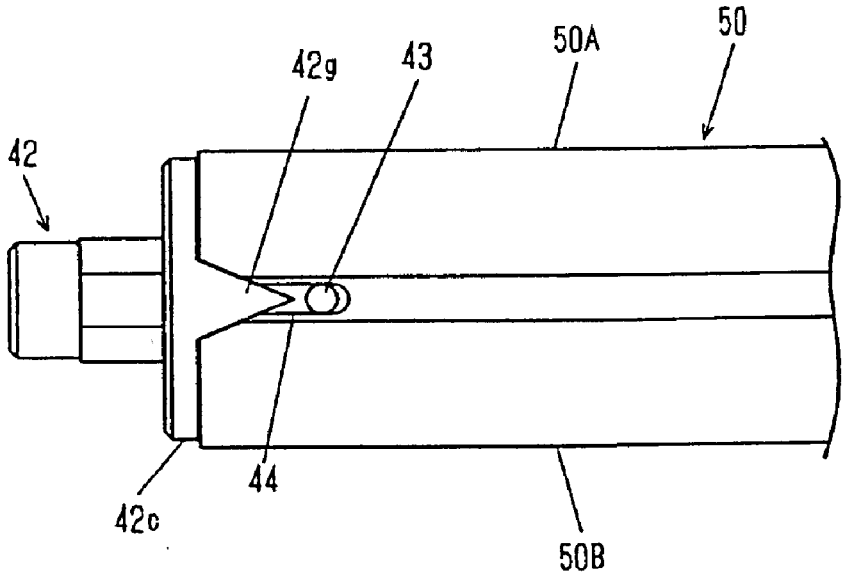
FIG. 13 is a front plan view of the take-up shaft in FIG. 12.

FIG. 12 is a front view of a cleaning fabric take-up shaft according to an additional embodiment of the present invention. FIG. 13 is a left side view of the take-up shaft in FIG. 12. A cleaning fabric take-up shaft 6 has an elongated solid axle portion 40, which corresponds to the length of a cylinder to be cleaned, and a semicircular shell member 50, which covers almost all the outer periphery of the axle portion 40. The shell member 50 is rotatably provided relative to the axle portion 40. Plug insertion holes 41 are formed at either end in the center of the axle portion 40. Plugs 42 are inserted into the plug insertion holes 41 and can be moved in the axial direction.

Figure 14:
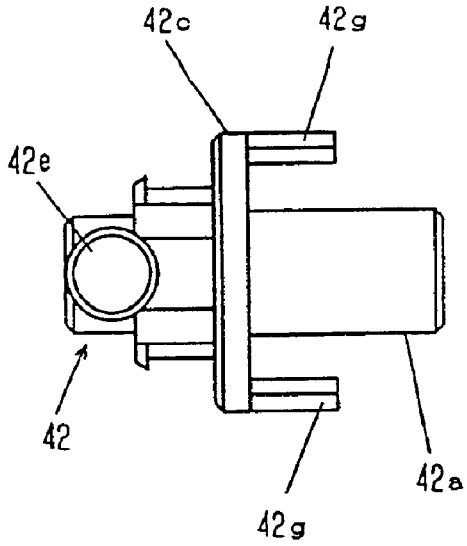
FIG. 14 is a front view of a plug.
Figure 15:
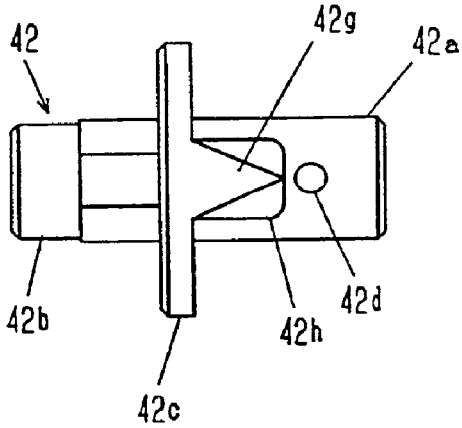
FIG. 15 is a plan view of the plug.

As is shown in FIG. 14, the plugs 42 each have a core insertion portion 42*a*, which is fitted into the axle portion 40; a coupling portion 42*b*, for a shaft receiving section that is near a side plate; and a jaw portion 42*c*, which is located between the core insertion portion 42*a* and the coupling portion 42*b*. The jaw portion 42*c* abuts upon the end face of the axle portion 40. As is shown in FIG. 15, a pin hole 42*d* is formed in and passes through the core insertion portion 42*a* in a direction perpendicular to the direction in which the plug 42 is moved. A plug: connection pin 43 (see FIG. 12) is inserted into the pin hole 42*d* and so secured therein that both ends project outward beyond the outer periphery of the core insertion portion 42*a* of the plug 42.

As is shown in FIG. 12, an elongated through hole 44 that is formed in the axle portion 40 is extended in its longitudinal direction, and the ends of the plug connection pin 43 project outward into the groove hole 44. Constrained by the elongated through hole 44 and the connection pin 43, the plug 42 can be moved only along the center line of the axle portion 40, and there is no play at the coupling of the plug 42 and the axle portion 40. A spring 45 is located between the core insertion portion 42*a* and the axle portion 40, and constantly urges the plug 42 in the direction in which it projects from the axle portion 40. In FIG. 12 the plug 42 is shown pressed fully inward to the axle portion 40, i.e., the spring 45 is compressed.

Figure 16:
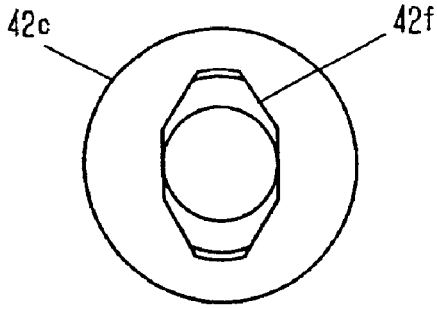
FIG. 16 is a left side view of the plug.

In the coupling portions 42*b* of the plugs 42 are coupling holes 42*e* into which are inserted connection pins that are formed on shaft couplings 24. The coupling portions 42*b* are detachably secured to the shaft couplings 24 of the shaft receiving sections, which are provided for the side plate 9. For the attachment of the plugs 42 to the shaft couplings 24, one or both of the plugs 42 are forced inward the axle portion 40 against the pressure exerted by the springs 45. Then, one of the shaft couplings 24 and one of the coupling portions 42*b* of the plugs 42 are aligned, and the plug 42 is fitted into the shaft coupling 24 by the pressure exerted by the springs 45. Then the other plug 42 is inserted into the groove 25 of the other shaft coupling 24 from the side. Following this, the connection pins 26 (see FIG. 5) formed in the shaft couplings 24 are inserted into the plug coupling holes 42*c*, and secured. A plug coupling portion 42*b* has a polygon shape 42*f*, for which the outer faces are cut as shown in FIG. 16, and correspond to the shape of a shaft coupling 24 so that the rotational force of winding can be precisely transmitted to the plug 42, i.e., so that no rotational movement occurs between the plug coupling portion 42*b* and the shaft coupling 24.

A pair of wedges 42*g* are formed opposite each other on the jaw portion 42*c* and extend in the axial direction of the axle portion 40. As is shown in FIGS. 14 and 15, the wedge members 42*g* are tapered, and on the side of the core insertion portion 42*a*, guide portions 42*h* are formed contiguous with the wedge portions 42*g* to control the movement of the shell member 50.

Figure 18:
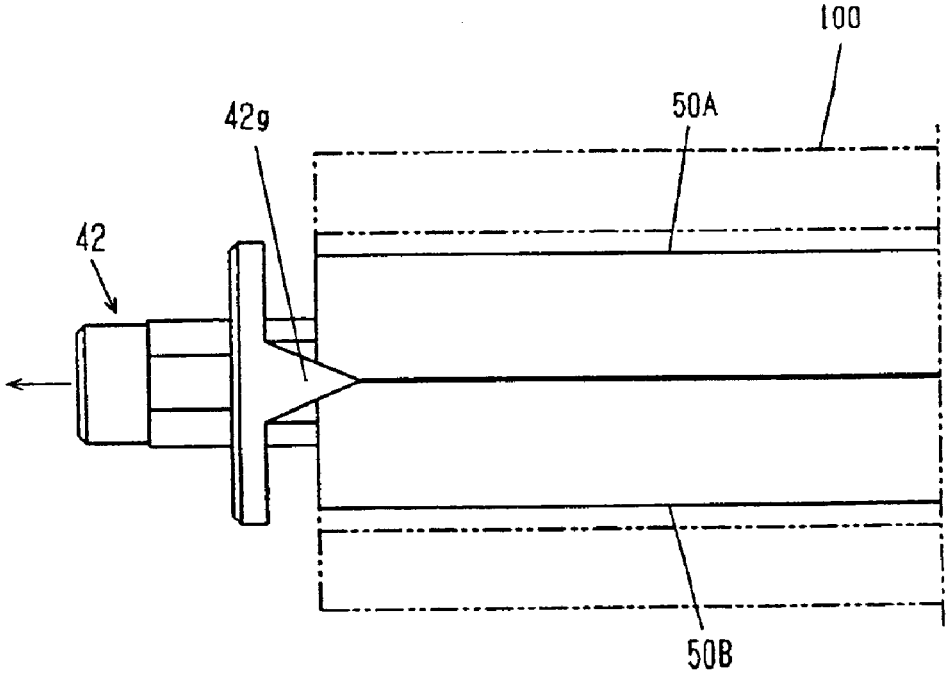
FIG. 18 is a diagram for explaining how a cleaning fabric take-up shaft is removed from a cleaning fabric roll.

The structure of the shell member 50 will be explained in detail while referring to FIGS. 13 and 18. The shell member 50 is constituted by two half-cylinder portions, a shell member 50A and a shell member 50B. Attached to the outer peripheries of the shell members 50A and 50B is perorated metal, the surface of which is so designed that fabric winding is ensured, i.e., multiple perforations are formed thereon that can easily catch the cleaning fabric. The shell members 50A and 50B are coupled with respective slide pins 51, which are formed at several locations in the longitudinal direction of the axle portion 40, and are movable.

Figure 17A:
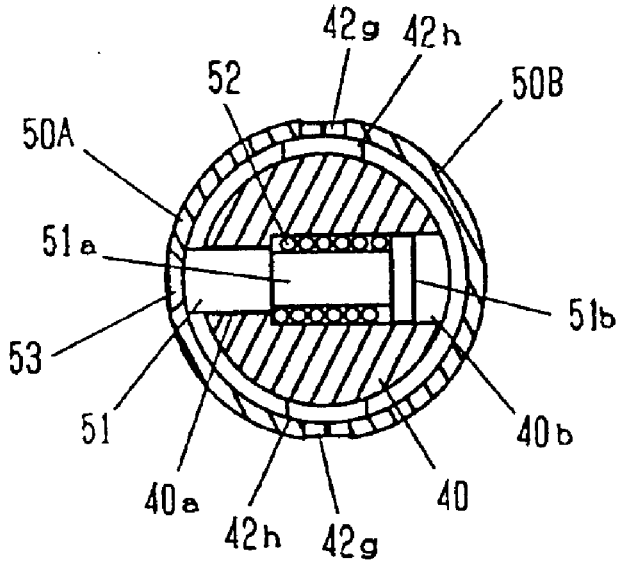
FIG. 17A is a cross-sectional view taken along line C—C in FIG. 12.
Figure 17B:
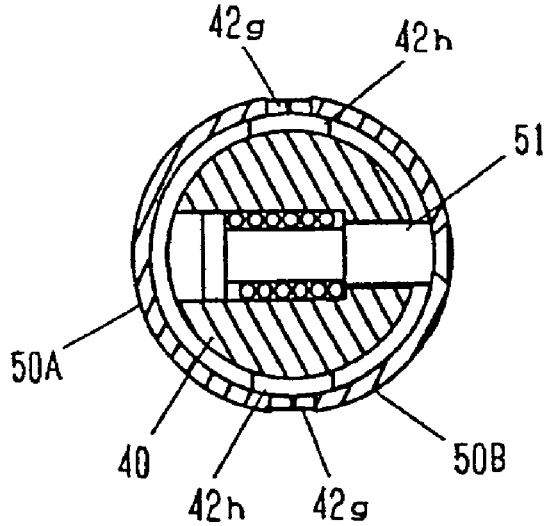
FIG. 17B is a cross-sectional view taken along line D—D in FIG. 12.

As is shown in FIGS. 17A and 17*b*, the slide pins 51 each have an extension portion 51*a* on one end. A head 51*b* having a larger diameter than that of the extension portion 51*a* is provided at the end of the slide pin 51. A slide pin hole 40*a* in the axle portion 40 is formed perpendicular to its axis. On the opposite side of the slide pin hole 40*a*, a hole 40*b* having a larger diameter is concentrically formed with the slide pin hole 40*a*. A spring 52 is positioned between the head 51*b* and the core 40 by inserting the slide pin 51 into the slide pin hole 40*a* from the hole 40*b*. The spring 52 is compressed so that the slide pin 51 is projected outward from the axle portion 40. In this condition, the shell member 50 is secured by a screw 53 so that it is integrally joined with the slide pin 51. The shell members 50A and 50B are urged toward the outer periphery of the axle portion 40 by the spring 52.

The assembling and the removal of the cleaning fabric take-up shaft 6 will now be described while referring to FIGS. 12 and 13. When the plug 42 is projected outward from the axle portion 40 in direction, n and has reached the limit of its movement, the wedge members 42*g* are detached from the shell member 50 and the shell member 50 is moved closer to the axle portion 40 by springs 52 (see FIGS. 17A and 17B). At this time, the edges of the shell members 50A and 50B in the longitudinal direction are brought near, i.e., the diameter is reduced. When the plug 42 is moved in the direction m, i.e., when the plug 42 is fitted into the shaft receiving section 20, as is shown in FIG. 12, the wedge members 42*g* enter between the shell members 50A and 50B. As a result, as the inclined faces of the wedge members slide along the shell members 50A and 50B, the shell members 50A and 50B are moved outward against the urging force of the springs 52. And since at this time the corners at the ends of the shell members 50A and 50B move along the guide portions 42*h*, the diameter can be smoothly changed.

In order to extract the cleaning fabric take-up shaft 6 from the cleaning fabric roll 100, the plugs 42 are removed from the shaft receiving section 20, and are then projected outward from the axle portion 40 by the force exerted by the springs 45 shown in FIG. 12. As the plugs 42 are moved in the direction in which the wedge members 42*g* are extracted from between the shell member 50, as is shown in FIG. 18, the shell members 50A and SOB, which were forcibly separated, are moved toward the axle portion 40, and the diameter is thus reduced. Then, the plug 42 is pulled in the direction indicated by an arrow in FIG. 18, so that the cleaning fabric take-up shaft 6 is removed from the cleaning fabric roll 100.

Figure 19:
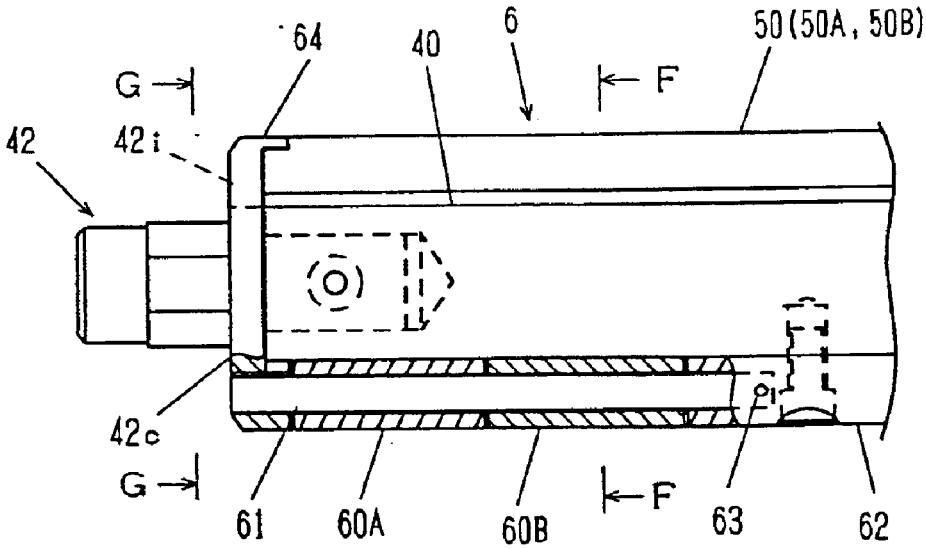
FIG. 19 is a diagram showing a modification of a cleaning fabric take-up shaft having a shell member.

FIG. 19 is a diagram showing a modification of the cleaning fabric take-up shaft 6 that has a shell member. In this modification, the edges on one side of two separate shell members are coupled together by a hinge, and the other ends are used to press against the fabric. At both ends of a shell member 50, a tubular portion 60A is formed on an edge of a shell member 50A and a tubular portion 60B is formed on an edge of a shell member 50B. A straight pin 61 is then inserted through these tubular portions 60A and 60B so that the shell member 50 can be rotated.

Figure 20:
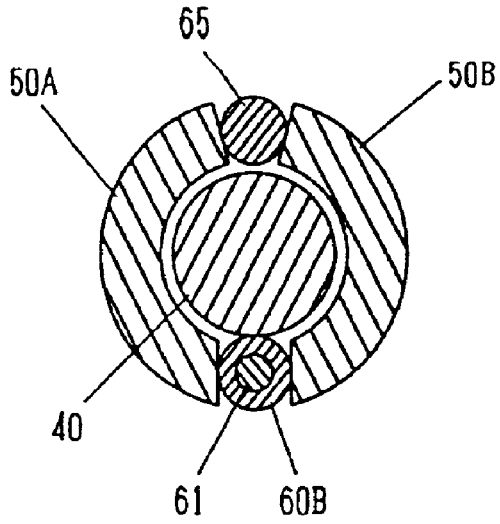
FIG. 20 is a cross-sectional view taken along line F—F in FIG. 19.
Figure 21:
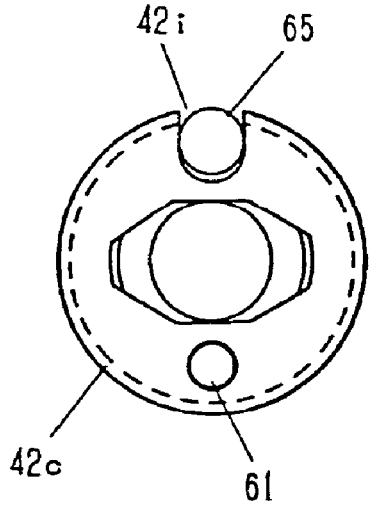
FIG. 21 is a cross-sectional view taken along line G—G in FIG. 19.

One end of the straight pin 61 is fitted in a pin receiving portion 62 and is secured by a small screw 63. As is shown in FIG. 20, a bar shaped fabric holder 65, which is longer than the axle portion 40, is sandwiched between the other edges of the shell members 50A and 50B. Although the gap between the shell members 50A and 50B is expanded a little by the bar-shaped fabric holder 65, this expansion is restricted by a ring convex portion 64 at the plug 42, while the cleaning fabric is securely held between the shell member 50 and the of fabric holder 65. Notched portions 42*i* are formed in jaw portions 42*c* of the plugs 42, as is shown in FIG. 21. The ends of the fabric holder 65 are fitted into the notched portions 42*i* for positioning. In this modification, the fabric holder 65 serves as a wedge for increasing the diameter. Also, the fabric holder 65 serves as means for generating a gap between the outer periphery of the axle, portion 40 and the inner periphery of the shell member 50, and for maintaining a larger diameter.

Figure 22A:
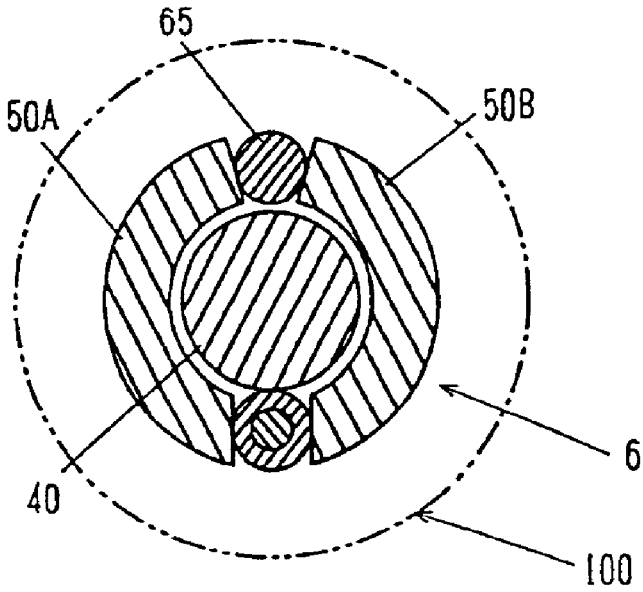
FIGS. 22A and 22B are diagrams for explaining how a cleaning fabric take-up shaft is removed from a cleaning fabric roll.
Figure 22B:
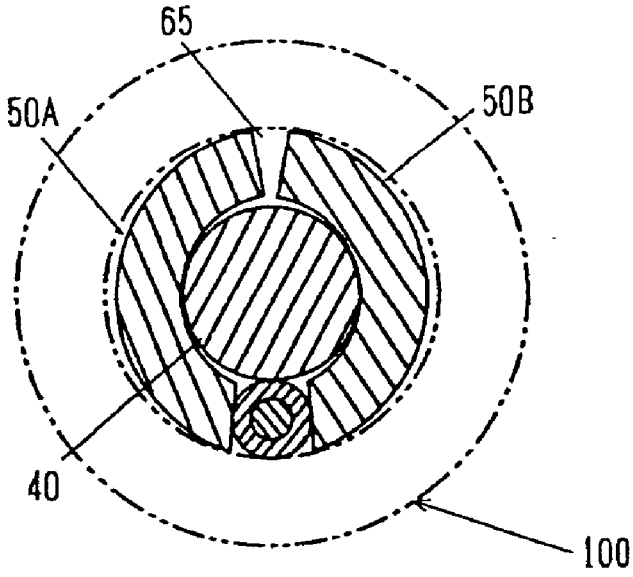

When the cleaning fabric take-up shaft 6 is to be removed from the cleaning fabric roll 100 shown in FIG. 22A, the end of the fabric holder 65, which is exposed in the notched portion 42*i* of the plug 42 at one end, is struck to project the fabric holder 65 outward from the notched portion 421 of the plug 42 at the other end. Then, the projected end is pulled to remove the fabric holder 65. And, as is shown in FIG. 22B, the shell members 50A and 50B rotate inward the axle portion 40, and a gap is formed between the shell member 50 and the cleaning fabric roll 110. Thus, the shell member 50 is released from the cleaning fabric roll 100 so that the cleaning fabric take-up shaft 6 can be removed from the cleaning fabric roll 100.

Figure 23:
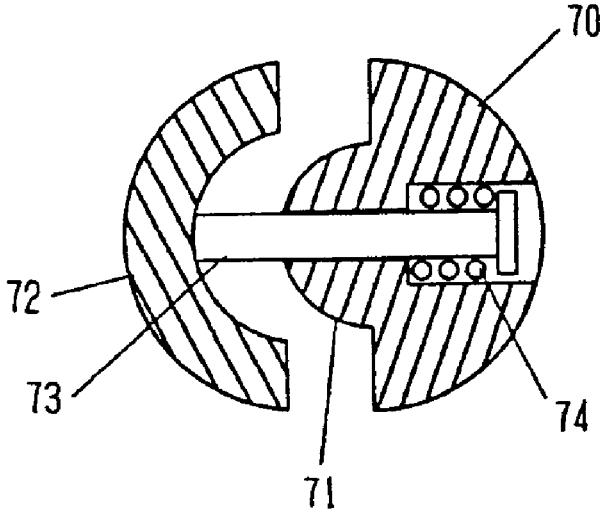
FIG. 23 is a diagram showing another modification of the cleaning fabric take-up shaft having a shell member.

The arrangement of a cleaning fabric take-up shaft 6 constituted by shaft members and shell members will now be explained. FIG. 23 is across-sectional view of a portion of a cleaning fabric take-up shaft 6 that corresponds to that in FIG. 17. The cleaning fabric take-up shaft 6 is an assembly composed of a shaft member having a half cylinder shape shown in FIG. 1 and a shell member shown in FIG. 12. Since the basic structure is the same as the third embodiment, only the characteristic portion will be described.

A shaft member 70, which is a solid-core structure having a half cylinder shape, has a projecting semicircular axle portion 71 at its center, and has the same plug as in the previous embodiment attached to both ends of the axle portion 71. A shell member 72 is provided opposite the shaft member 70 so that it covers the axle portion 71. The shell member 72 is supported by slide pins 73, which are provided at a plurality of locations in the longitudinal direction of the shaft member 70 and which so run across the axle portion 71 that they are retractable. The shell member 72 is movable relative to the shaft member 70. Springs 74 are provided on the ends of the slide pins 73 on the shaft member 70 side. The springs 74 constantly act to pull the slide pins 73 into the shaft member 70.

Figure 24:
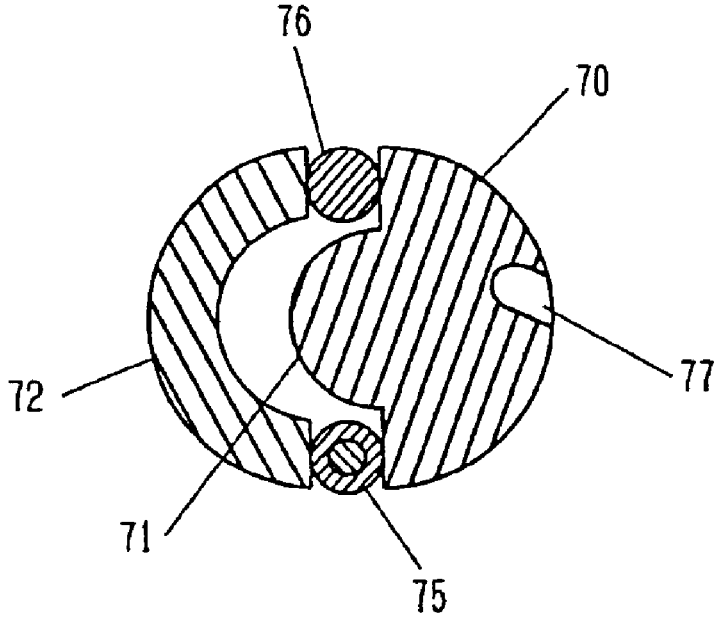
FIG. 24 is a diagram showing an additional modification of the cleaning fabric take-up shaft having a shell member.

A wedge shaped member is inserted between the shaft member 70 and the shell member 72, and to increase the diameter, the shell member 72 is moved outward against the urging force exerted by the springs 74. In this condition, the winding of the cleaning fabric is performed. To remove the cleaning fabric take-up shaft from the cleaning fabric roll, the wedge member is extracted, and the springs 74 pull the shell member 72 toward the shaft member 70, so that the diameter is reduced, and the cleaning fabric take-up shaft can be removed from the cleaning fabric roll. In FIG. 24 is shown a cleaning fabric take-up shaft wherein one end of a shell member is coupled with a shaft member by a hinge. The basic structure is the same as that of the modification shown in FIG. 19. A shaft member 70, which is a solid-core structure having a half cylindrical shape; has a semicircular axle portion 71 projected at its center. Plugs are attached to both ends of the axle portion 71. A shell member 72 is positioned opposite the shaft member 70 that it covers the axle portion 71. One edge of the shell member 72 is rotatably attached to the shaft member 70 by a hinge 75. A wedge member 76 having a bar shape is located between the other edges of the shell member 72 and the shaft member 70, and the diameter is thereby increased. To secure cleaning fabric to the shaft, either the cleaning fabric is held between the wedge member 76 and the shaft member 70 or the shell member 72, or means to be engaged, which is provided for the cleaning fabric, that will be described later is caught in a groove 77 that is formed in the longitudinal direction of the outer periphery of the shaft member 70.

An explanation will be given for a structure for changing the shape of a cleaning fabric take-up shaft, which serves as a mechanism for mechanically changing the condition where the cleaning fabric take-up shaft is in contact with cleaning fabric that is wound around it.

Figure 25:
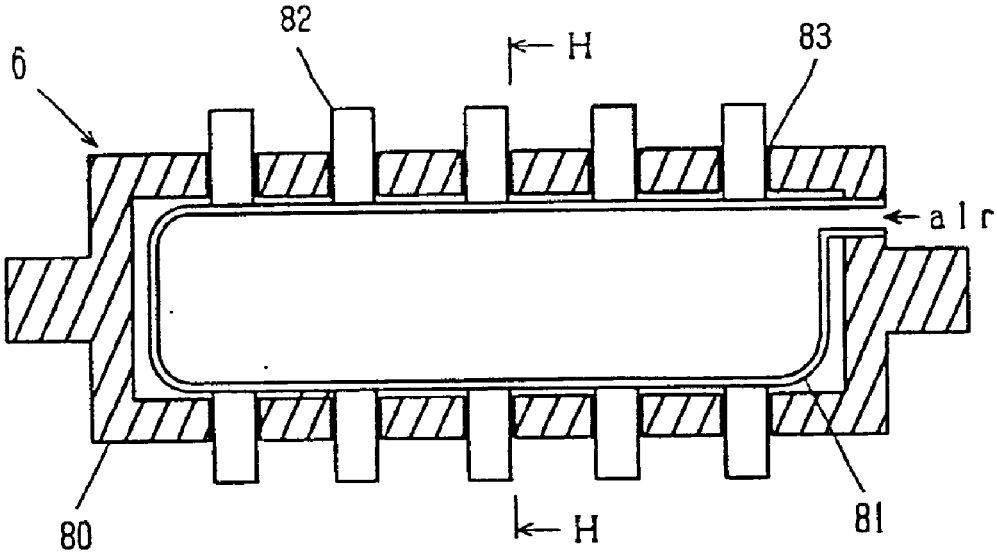
FIG. 25 is a cross-sectional view of a cleaning fabric take-up shaft according to a further embodiment of the present invention.

A cleaning fabric take-up shaft with the above structure is shown in FIG. 25. A cleaning fabric take-up shaft 6 comprises a hollow cylindrical shaft member 80, an inflation member 81 provided inside the cylinder 80, and projection engagement members 82 retractably provided relative to the surface of the outer periphery of the cylinder 80. A plurality of through holes 83 are formed in the outer periphery of the cylinder 80. The projection engagement members 82 are projected outward through the through holes 83.

Figure 26:
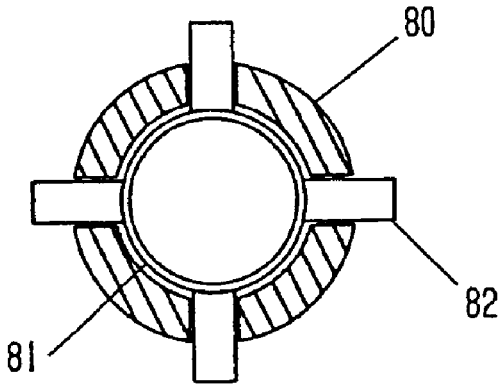
FIG. 26 is a cross-sectional view taken along line H—H in FIG. 25.
Figure 27:
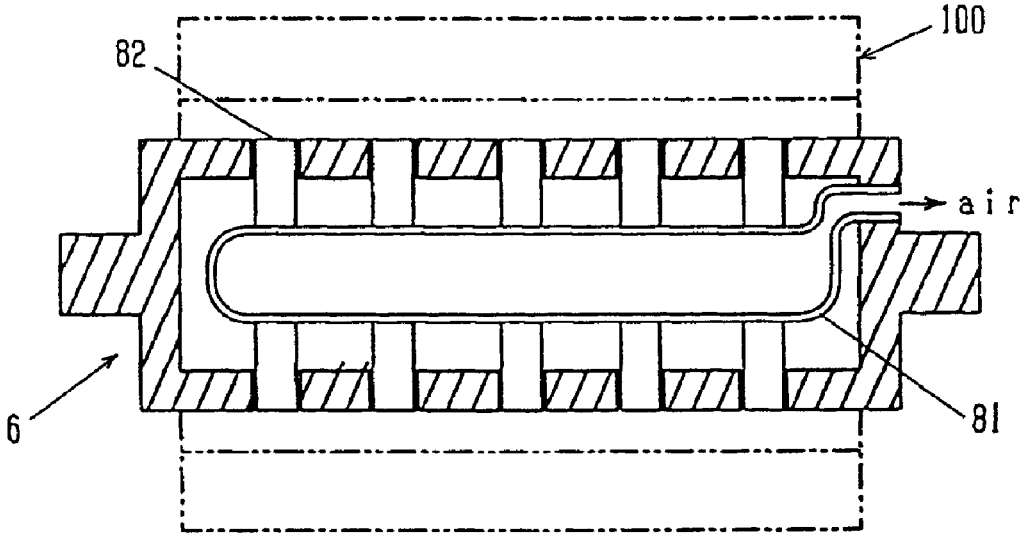
FIG. 27 is a cross-sectional view for explaining how a cleaning fabric take-up shaft is removed from a cleaning fabric roll.

The inflation member 81 is expanded/shrunk by supplying/discharging air at one end of the shaft member 80. When the inflation member 81 is expanded, the engagement members 82 are projected as is shown in FIG. 26. When the inflation member 81 is shrunk, the engagement members 82 are retracted inside the shaft member 80, as is shown in FIG. 27.

When the projection engagement members 82 are projected outward from the shaft member 80 by the expansion of the inflation member 81, the cleaning fabric is wound. When the cleaning fabric take-up shaft 6 is to be removed from a cleaning fabric roll 100, the inflation member 81 is shrunk by discharging air from it, and the cleaning fabric is released from the projection engagement members 82. Thus, as is shown in FIG. 27, a gap is formed between the shaft member 80 and the cleaning fabric roll 100, so that the cleaning fabric take-up shaft 6 can be easily removed.

Figure 28:
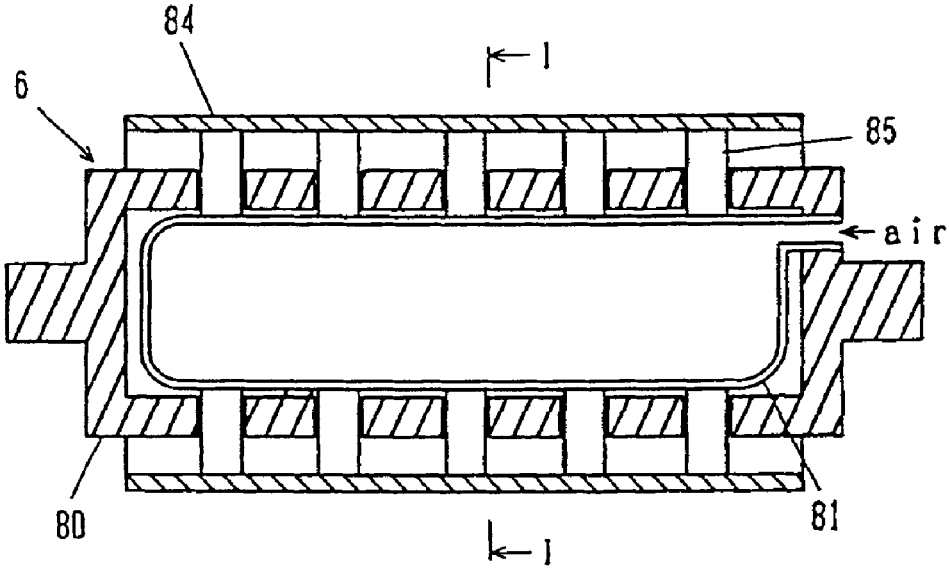
FIG. 28 is a cross-sectional view of a modification of the embodiment shown in FIG. 25.
Figure 29:
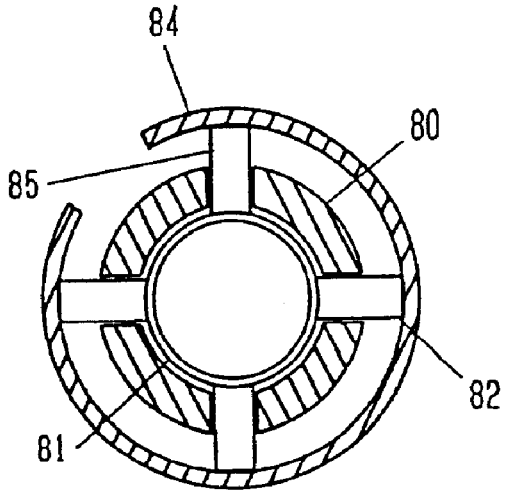
FIG. 29 is a cross-sectional view taken along line I—I in FIG. 28.

A modification is shown in FIG. 28. In this modification, an expandable/shrinkable cylindrical engagement member 84 is located on the outer periphery of a shaft member 80. The engagement member 84 is coupled with a moving members 85, which are moved by the expansion/shrinkage of the inflation member 81, which is internally provided in the shaft member 80. The engagement member 84 is formed of elastic material. As is shown in FIG. 29, the engagement member 84, one part of which is cut off, is deformed by extending or retracting the moving member 85, and the diameter is increased or reduced. The surface of the outer periphery of the engagement member 84 is smoothed to ensure that it engages the cleaning fabric.

Figure 30:
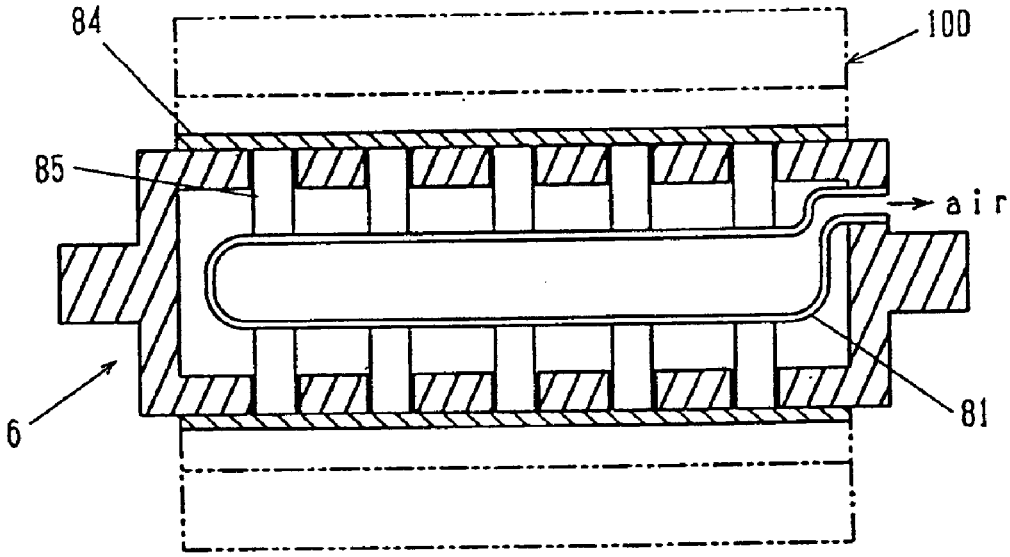
FIG. 30 is a cross-sectional view for explaining how a cleaning fabric take-up shaft is removed from a cleaning fabric roll.

To remove the cleaning fabric take-up shaft 6 from a cleaning fabric roll 100, the inflation member 81 is shrunk by discharging air therefrom, and the cleaning fabric is disengaged from the engagement member 84. When a gap is formed between the shaft member 80 and the cleaning fabric roll 100, as is shown in FIG. 30, the cleaning fabric take-up shaft 6 can be easily removed.

Figure 31:
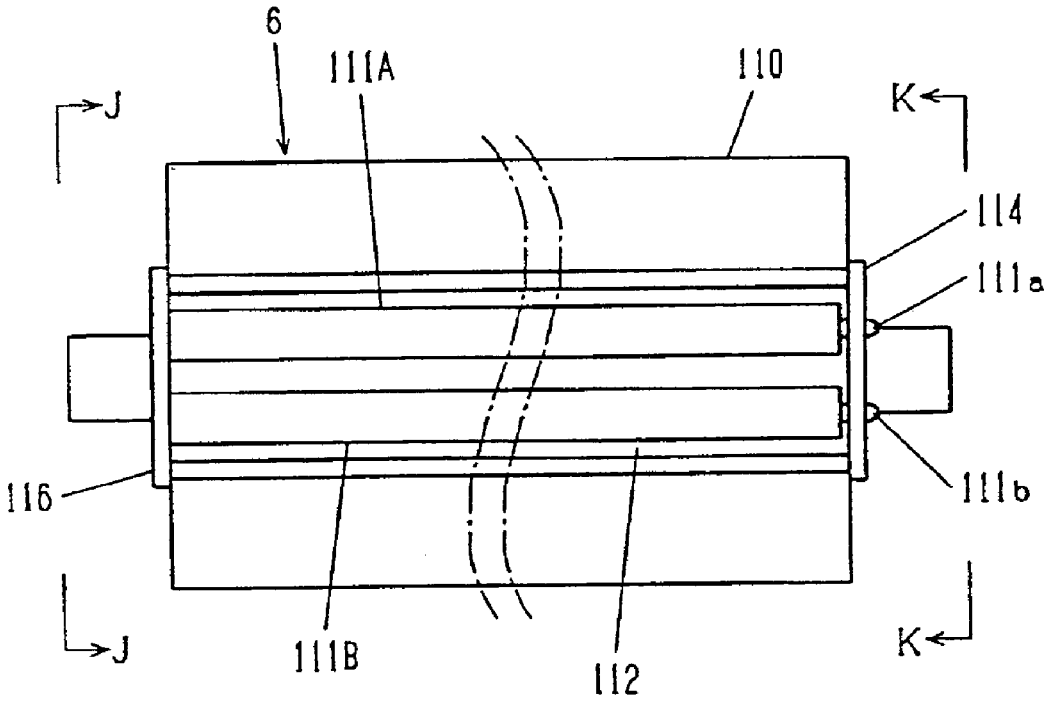
FIG. 31 is a plan view of a cleaning fabric take-up shaft according to still another embodiment of the present invention.
Figure 32:
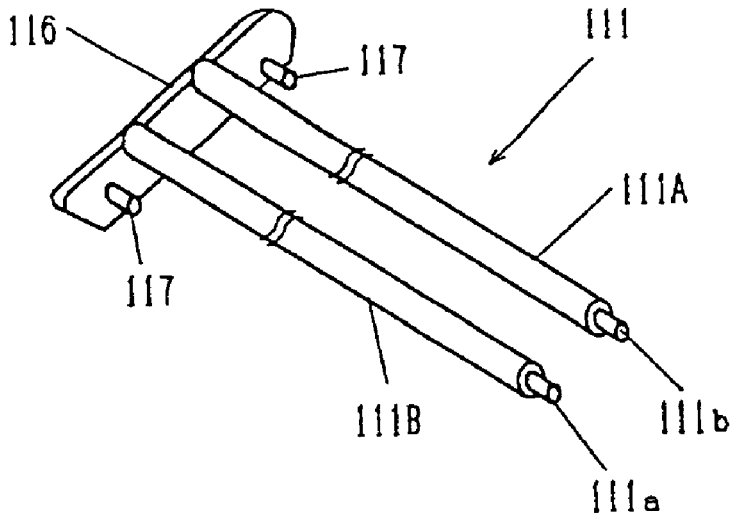
FIG. 32 is a perspective view of a bar member unit.
Figure 33:
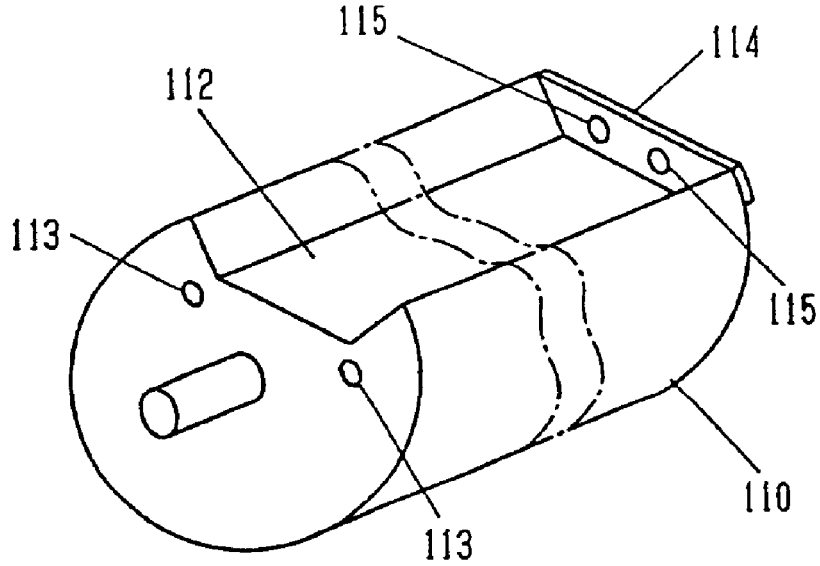
FIG. 33 is a perspective view of a shaft member.
Figure 34:
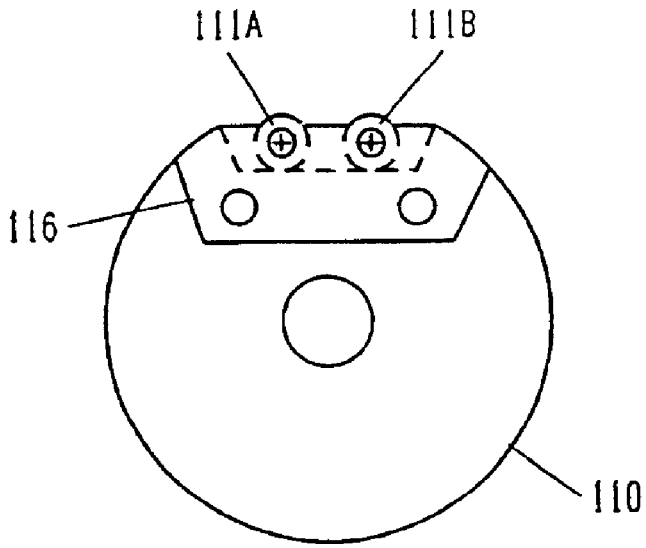
FIG. 34 is a diagram viewed along line J—J in FIG. 31.
Figure 35:
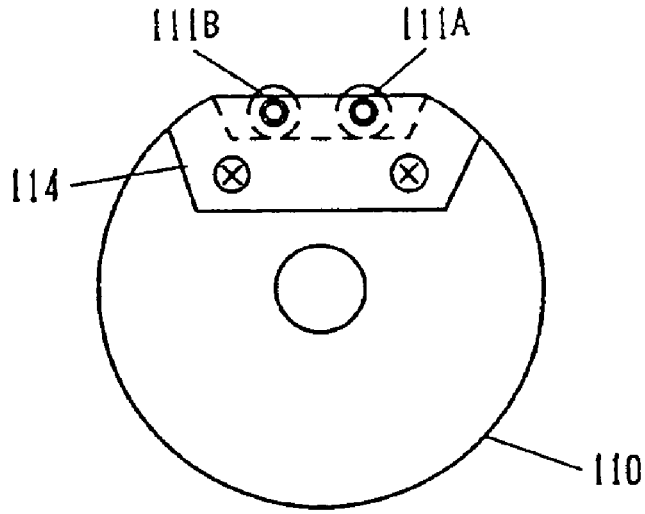
FIG. 35 is a diagram viewed along line K—K in FIG. 31.

A cleaning fabric take-up shaft according to still another embodiment is shown in FIG. 31. FIG. 32 is a perspective view of a bar member unit, and FIG. 33 is a perspective view of a shaft member. FIG. 34 is a diagram viewed from line J—J in FIG. 31, and FIG. 35 is a diagram viewed from line K—K in FIG. 31. In this embodiment, as a mechanism for mechanically changing the condition where the cleaning fabric take-up shaft is in contact with the cleaning fabric that is wound around it, ends of both bar members are fitted into the end of a shaft member. A groove having a predetermined width is formed in the outer periphery of the shaft member in the axial direction. The bar members are fitted into the groove in the shaft member. To wind the cleaning fabric, a condition where the cleaning fabric contacts part of the outer periphery of the bar member is produced.

In FIG. 31, a cleaning fabric take-up shaft 6 comprises a shaft member 110 and bar members 111A and 111B that extend along the entire length, or almost the entire length, of the shaft member 110. A groove 112 is formed in the outer periphery of the shaft member 110 in the axial direction. The bar members 111A and 111B are located in the groove 112. Engagement holes 113 are formed in one end of the shaft member 110, and an end plate 114 is fixed to the, other end at the position of the groove 112. Engagement holes 115 are formed in the end plate 114 at the position corresponding to the end of the groove 112, and ends 111*a* and 111*b* of the bar members 111A and 111B are inserted into the engagement holes 115. Therefore, the end plate 114 serves as a hook member for holding the ends 111*a* and 111*b* of the bar members 111A and 111B, while the engagement holes 115 serve as bar member engagement portions.

The bar members 111A and 111B are fixed by screws to a support plate 116. A bar member unit 111 is provided by integrally forming the bar members 111A and 111B and the support plate 116. When the support plate is fitted onto the shaft member 110, the bar members 111A and 111B are positioned with a predetermined interval between them and parallel to the bottom face of the shaft member 110. Engagement projections 111*a* and 111*b* are formed at the ends of the bar members 111A and 111B on one side, so that they can be fitted into the engagement holes 115 in the end plate 114. Engagement protrusions 117 are formed on a support plate 116 and are inserted into the engagement holes 113, which are formed in the end of the shaft member 100. The bar member unit 111 is attached to the shaft member 110 by inserting the engagement projections 11*a* and 111*b* of the bar members 111A and 111B into the engagement holes 115 in the end plate 114, and by inserting the engagement projections 117 on the support plate 116 into the engagement holes 113 on the end of the shaft member 110.

Figure 36:
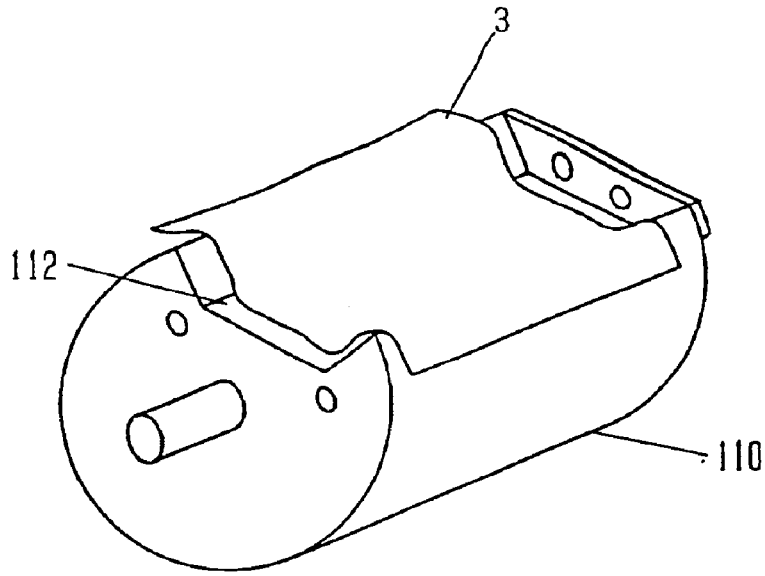
FIG. 36 is an explanatory diagram for the positioning of cleaning fabric.
Figure 37:
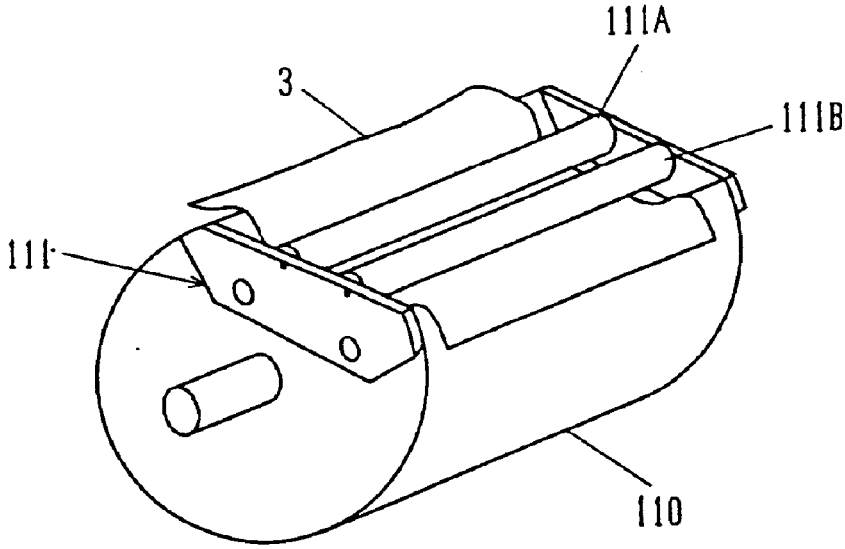
FIG. 37 is an explanatory diagram for the positioning of the cleaning fabric after it has been completed.
Figure 38:
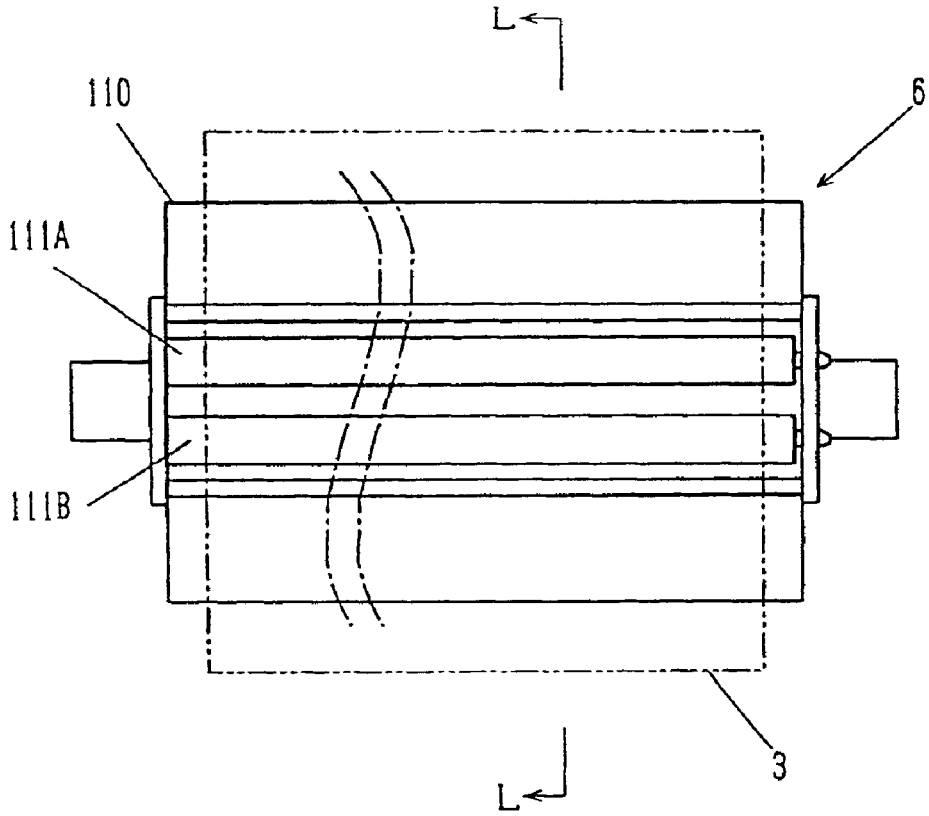
FIG. 38 is a diagram for explaining the use of the cleaning fabric take-up shaft in the embodiment shown in FIG. 31.
Figure 39:
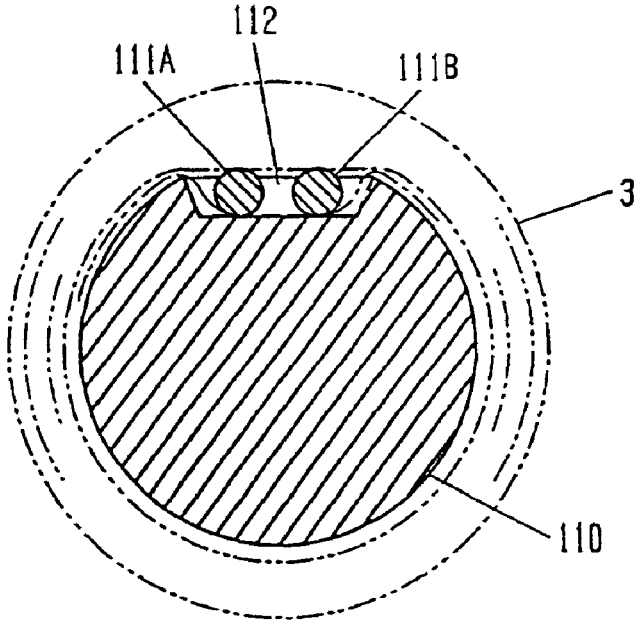
FIG. 39 is a cross-sectional view taken along line L—L in FIG. 38.

The use for the cleaning fabric take-up shaft 6 will now be explained. First, the bar member unit 111 is removed from the shaft member 110, and then, the leading edge (the leading portion of the fabric that is first wound around the cleaning fabric take-up shaft) of the cleaning fabric 3 is placed over the groove 112, as is shown in FIG. 36. Following this, as is shown in FIG. 37, the bar member unit 111 is attached to the shaft member 110, so that the cleaning fabric 3 is held between the bottom of the groove 112 and the bar members 111A and 111B. When the cleaning fabric take-up shaft 6 is rotated, the cleaning fabric 3 is taken up around the cleaning fabric take-up shaft 6, as is shown in FIG. 38. When the cleaning fabric 3 is taken up, the cleaning fabric 3 is in contact with parts of the bar members 111A and 111B, i.e., the parts opposite the bottom of the groove 112, as is shown in FIG. 39.

Figure 40:
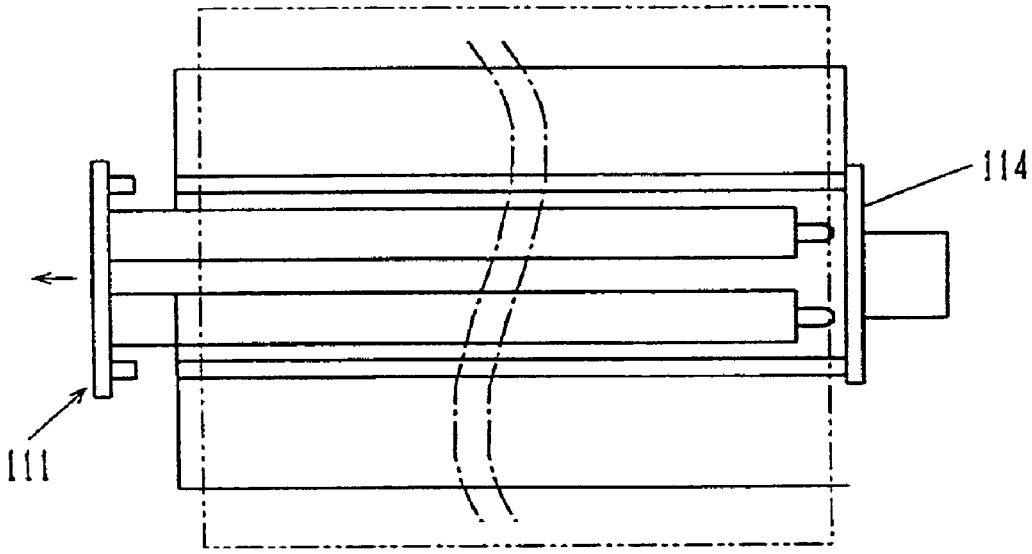
FIG. 40 is an explanatory diagram for the process for extracting a bar member unit.
Figure 41:
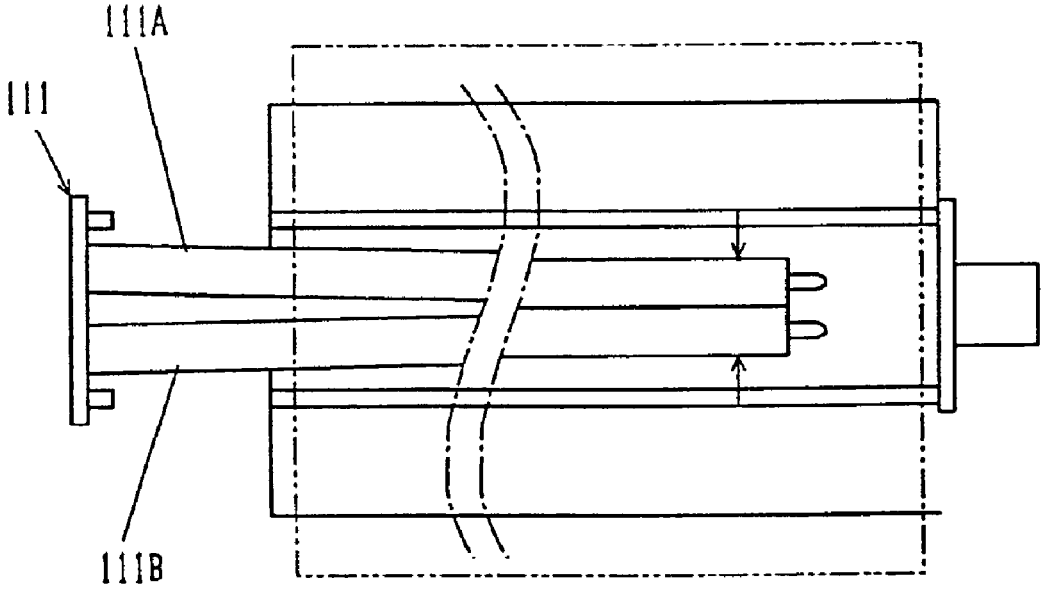
FIG. 41 is an explanatory diagram for the movement of the bar member by the winding force exerted by a cleaning fabric roll.

To remove the cleaning fabric take-up shaft 6 from the wound cleaning fabric 3, the bar member unit 111 is pulled in the axial direction, as is shown in FIG. 40, and the ends of the bar members 111A and 111B are disengaged from the end plate 114. Then, a force indicated by arrows in FIG. 41 is applied by the cleaning fabric 3 to the bar members 111A and 111B. Since the bar members 111A and 111B are attached to the support plate 116 with an open sided structure, they are deflected at their free ends and approach each other, so that the distance between them is reduced. As the bar members are moved in this manner, the contact between the cleaning fabric 3 and the bar members 111A and 111B is relaxed, so that the bar members 111A and 111B can be easily pulled out. When the bar members 111A and 111B have been removed, the force of the contact between the shaft member 110 and the cleaning fabric 3 is reduced, and the shaft member 110 can be easily removed.

Figure 42:
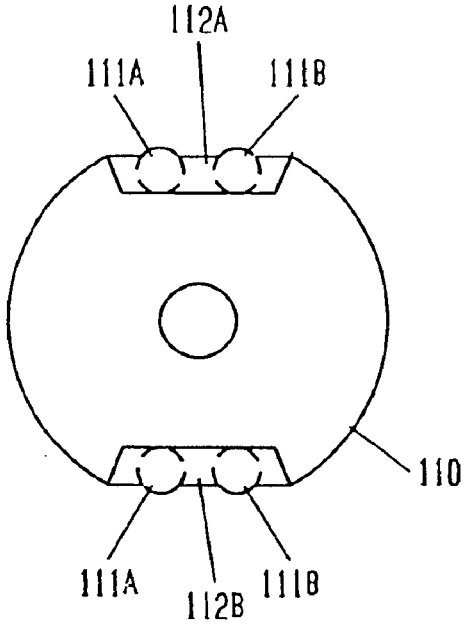
FIG. 42 is a diagram for explaining a modification of the embodiment shown in FIG. 31.

Modifications of the above embodiment will now be described. In a first modification, a plurality of grooves are formed in the outer periphery of a shaft member, and a bar member unit is provided for each groove. In the modification in FIG. 42, two grooves 112A and 112B are formed in a shaft member 110. As is shown in FIG. 42, since a mechanism, for mechanically changing the contact condition of a cleaning fabric take-up shaft and cleaning fabric that is taken up around the take-up shaft, is provided at a plurality of locations, the shaft member can more easily be removed from the cleaning fabric, and work efficiency can be improved.

Figure 43A:
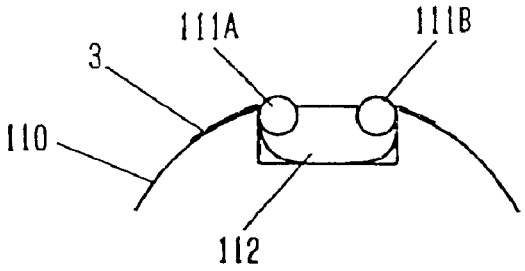
FIGS. 43A and 43B are explanatory diagrams for another modification.

In a second modification, in order to easily remove a shaft member from cleaning fabric, bar members are moved toward the bottom of a groove to reduce the force of contact with cleaning fabric, or to provide a no contact condition. A groove 112 is so deep that, as is shown in FIG. 43A, a gap can be formed between its bottom and bar members 111A and 111B while a bar member unit is attached to a shaft member.

Figure 43B:
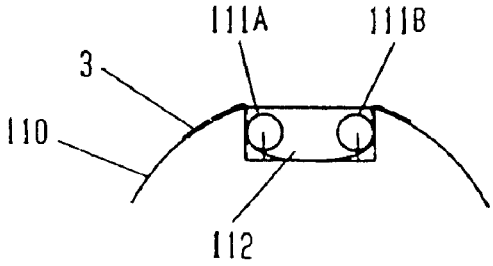

Cleaning fabric 3 is sandwiched and held between the bar members 111A and 111B and the side walls of the groove 112. When the bar member unit is pulled out in the axial direction, the bar member is disengaged from the shaft member, and as is shown in FIG. 43B, the bar members 111A and 111B are moved to the bottom of the groove 112 and are separated from the cleaning fabric 3. Thus, the bar members 111A and 111B can be easily extracted from the shaft member, and the shaft member can be removed from the cleaning fabric. The grooves 112A and 112B in the first modification can be formed as deep as in the second modification.

Figure 44A:
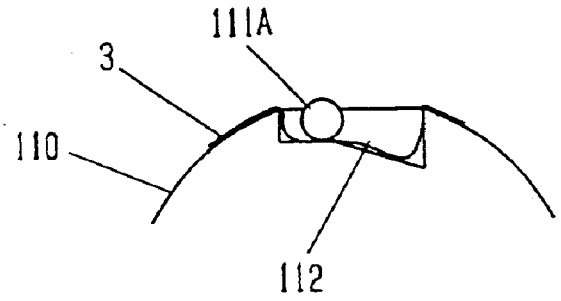
FIGS. 44A and 44B are explanatory diagrams for another modification.
Figure 44B:
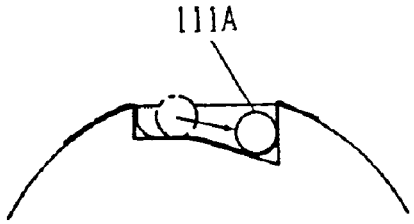

In a third modification, a groove has a shallow bottom portion and a deep bottom portion, and when bar members are disengaged from a shaft member, the bar members are moved from the shallow bottom portion to the deep bottom portion so they can be easily removed. In FIG. 44, a groove 112 in a shaft member has a shallow bottom portion 112*a*, in which a bar member 111A is fixed while cleaning fabric is taken up, and a deep bottom portion, which is adjacent to the shallow bottom portion 112*a* and which is used when the bar member 111A is to be pulled out. To pull out the bar members 111A, they are disengaged from the shaft member, and as is shown in FIG. 44B, they are moved to the deep bottom portion 112*b*. Since the bar members 111A are separated from the cleaning fabric, they can be easily removed.

Figure 45A:
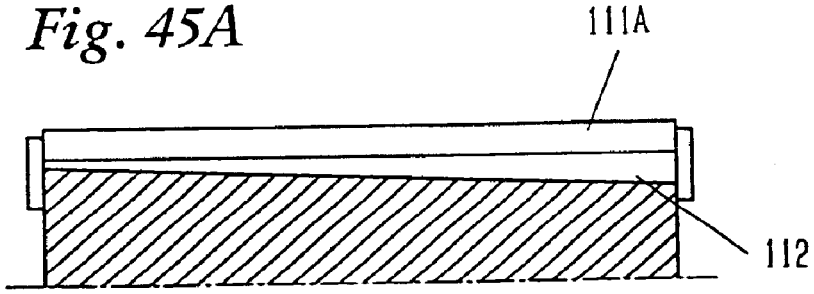
FIGS. 45A and 45B are explanatory diagrams for an additional modification.
Figure 45B:
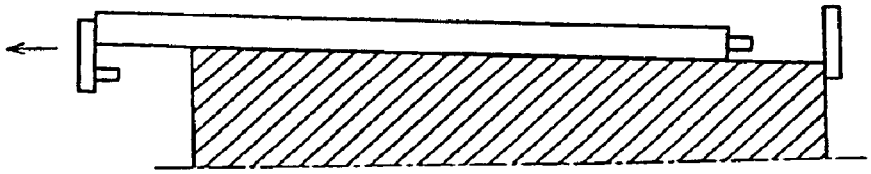

A fourth modification has a structure wherein a groove from which a bar member is to be extracted is shallow at one end and the depth of the groove increases toward the other end. When one end of the bar member is disengaged from the end of the shaft member, the bar member is moved toward the bottom of the groove and enters a no contact state relative to the cleaning fabric. When the cleaning fabric has been taken up with bar member engaging the shaft member, after the bar member is disengaged from the shaft member, the bar member is moved toward the bottom of the groove, as is shown in FIG. 45B. Therefore, the bar member is separated from the cleaning fabric and easily be removed.

Figure 46A:
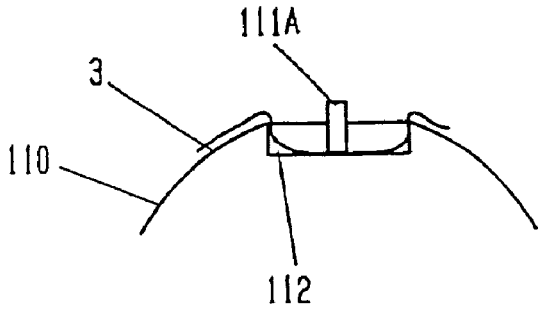
FIGS. 46A and 46B are side views of one part of a cleaning fabric take-up shaft according to another additional embodiment of the present invention, viewed from one end of the shaft.
Figure 46B:
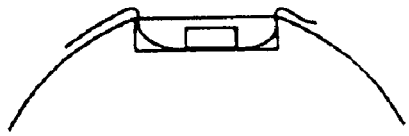

An explanation will now be given for a structure where a bar member having a polygonal shape or an oblong shape in cross section is disengaged from a shaft member and falls into a groove to enter a no contact condition with cleaning fabric. In the modification in FIGS. 46A and 46B, a bar member having a rectangular shape in cross section is used. As is shown in FIG. 46A, while the faces of the bar member that correspond to the short sides of the rectangle are parallel with the bottom of a groove, the bar member is fitted in a shaft member to wind cleaning fabric. To remove the bar member, the bar member is disengaged from the shaft member. Then, as is shown in FIG. 46B, the bar member is rotated, and a face of the bar member that corresponds to a long side of the rectangle contacts the bottom of the groove to separate the bar member from the cleaning fabric, so that the bar member is easily removed.

Figure 47A:
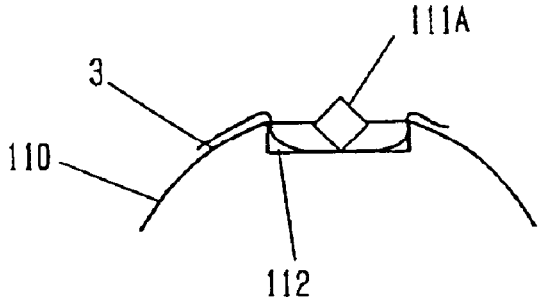
FIGS. 47A and 47B are side views of one part of a cleaning fabric take-up shaft having a bar member with a square cross section.
Figure 47B:
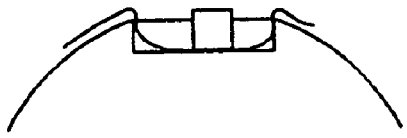
Figure 48A:
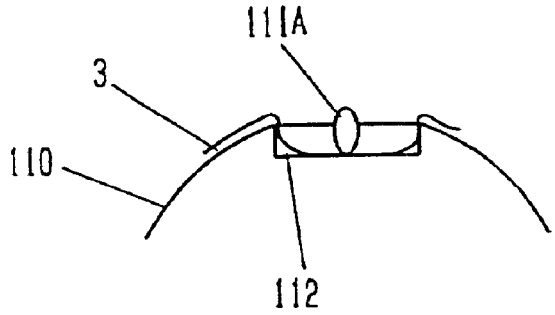
FIGS. 48A and 48B are side views of one part of a cleaning fabric take-up shaft having a bar member with an oblong cross section.
Figure 48B:
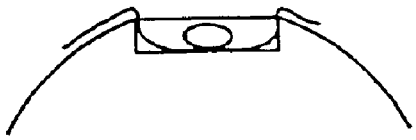

Similarly, FIG. 47 is a diagram showing an example bar member having a square shape in cross section, and FIG. 48 is a diagram of an additional example bar member having an oblong in cross section. When either of these bar members is used, the same effect as in FIG. 46 can be obtained. Although, in these embodiments, only one bar member has been used, a plurality of bar members may be employed.

When the width of a cylinder to be cleaned is large, the length of the cleaning fabric take-up shaft is increased accordingly. For a structure where a long bar member is provided over the entire axial length, or almost the entire axial length, at a cylinder, a bar member unit having a bar member attached to a support plate is difficult to handle, and the bar member tends to be bent and causes a reduction in the work efficiency. This is an especially important problem as a bar member that is bent may catch the cleaning fabric or a shaft member and be difficult to remove.

Figure 49:
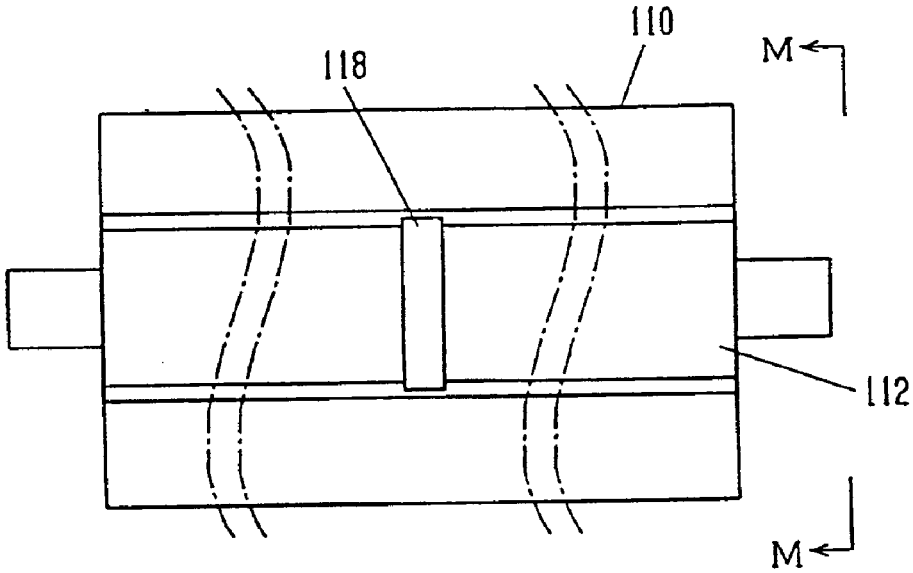
FIG. 49 is a plan view of a cleaning fabric take-up shaft according to a still another embodiment of the present invention.
Figure 50:
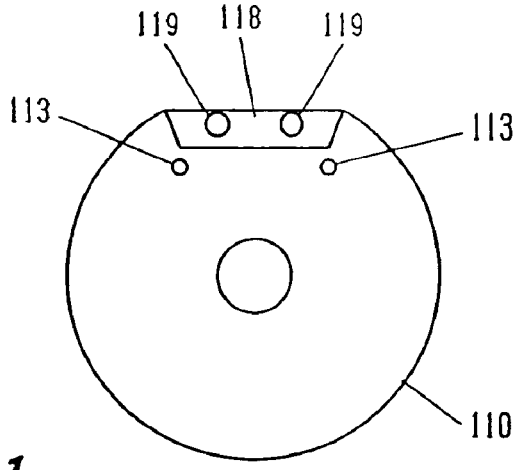
FIG. 50 is a diagram viewed along line M—M in FIG. 49.

As a countermeasure for the above problem, a still further embodiment is provided where one or more hook members are available for hooking the ends of bar members at a middle portion of a groove in a shaft member, so that the bar members can be removed from both sides of the shaft member. In FIG. 49, a shaft member 110 has an hook member 118 that is fixed to the middle portion of a groove 112. As is shown in FIG. 50, holes 119 are formed in the hook member 118 so that the bar members can be hooked at both sides.

Figure 51:
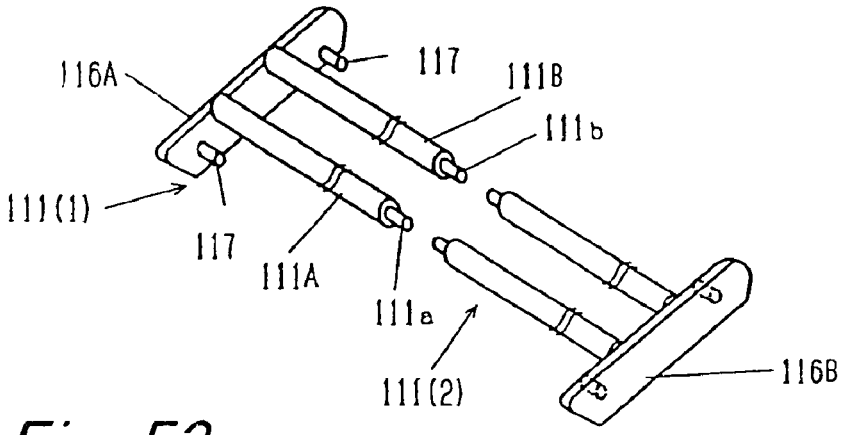
FIG. 51 is a perspective view of a bar member unit that is to be attached to the cleaning fabric take-up shaft shown in FIG. 49.

Bar members 111A and 111B have protrusions 111*a* and 111*b* at their distal ends, as is shown in FIG. 51. The protrusions 111*a* and 111*b* are inserted into the holes 119 of the hook member 118. The holes 119 serve as a bar member hooking portion for hooking one end of each bar member.

Figure 52:
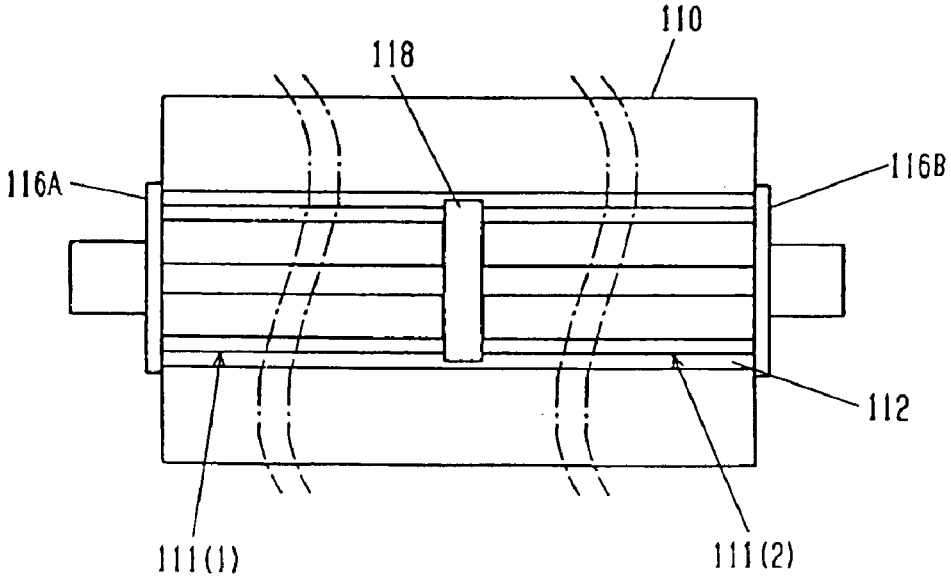
FIG. 52 is a plan view of the cleaning fabric take-up shaft assembly to which the bar member unit is attached.

In this embodiment, in consonance with the axial length of a cleaning fabric take-up shaft, a shaft member is constituted by a plurality of bar member segments that are provided along the axial direction and toward the middle portion of the axis. Two bar members form one pair of bar member units. In FIG. 52, a bar member unit 111(1) is detachably attached to the left side of the shaft member by using a support plate 116A. Another bar member unit 111(2) is attached to the right of the shaft member by using a support plate 116B. The bar member units 111(1) and 111(2) are to be pulled out at the ends from which the units are attached. In this embodiment, the protrusions 111*a* and 111*b* have been formed on the bar members, and the holes 119 into which the protrusions are inserted have been formed in the hook member 118. However, an opposite arrangement may be employed. In other words, holes may be formed in the distal ends of the bar members, and protrusions may be formed on the hook members.

Figure 53:
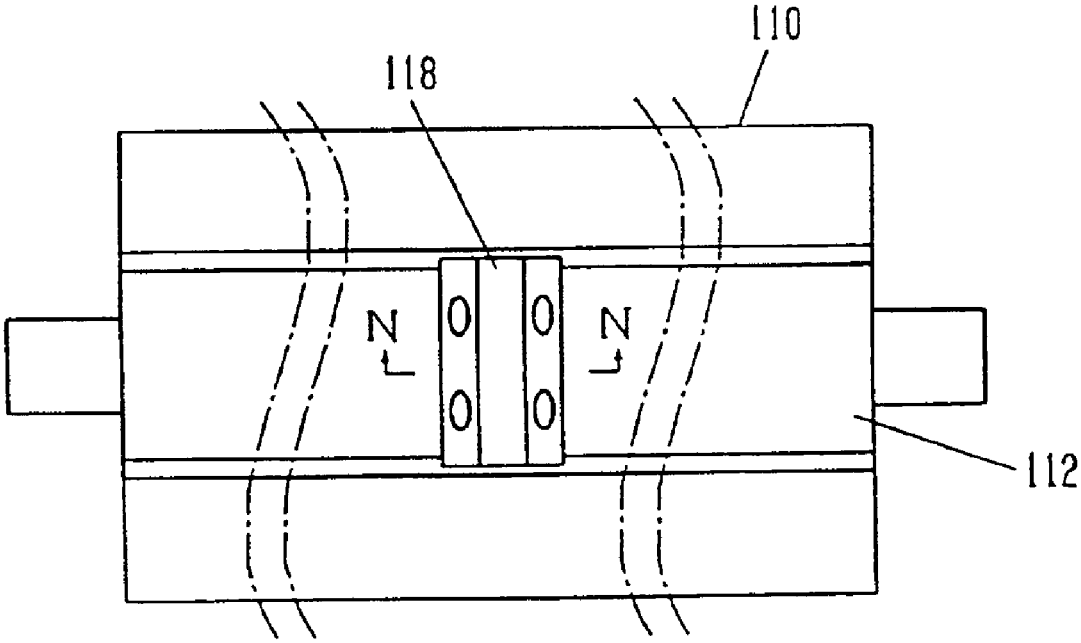
FIG. 53 is a plan view of a modification of the embodiment in FIG. 49.
Figure 54:
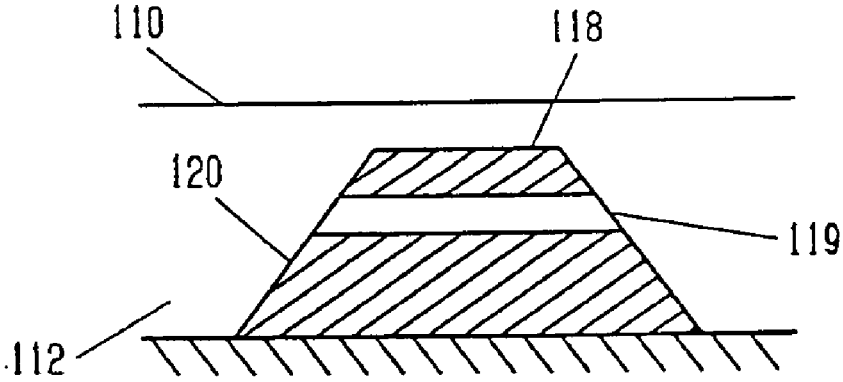
FIG. 54 is a cross-sectional view taken along line N—N in FIG. 53.

In FIG. 53 is shown a modification for a hook member, which has inclined faces 120 on both sides in the direction in which a groove 112 is formed. A hook member 118 is a trapezoid in cross section, as is shown in FIG. 54. Since the inclined faces are formed on both sides of the hook member 118, a defect can be removed where cleaning fabric catches at the hook member and can not be loosened, or is difficult to loosen, when the shaft member 110 is to be removed from the cleaning fabric. It should be noted that an adequate number of hook members can be selected in consonance with the structure of a bar member unit. As for the number and the shape of bar members, those specified in the previously described embodiments can be employed, and can be combined as needed.

Figure 55:
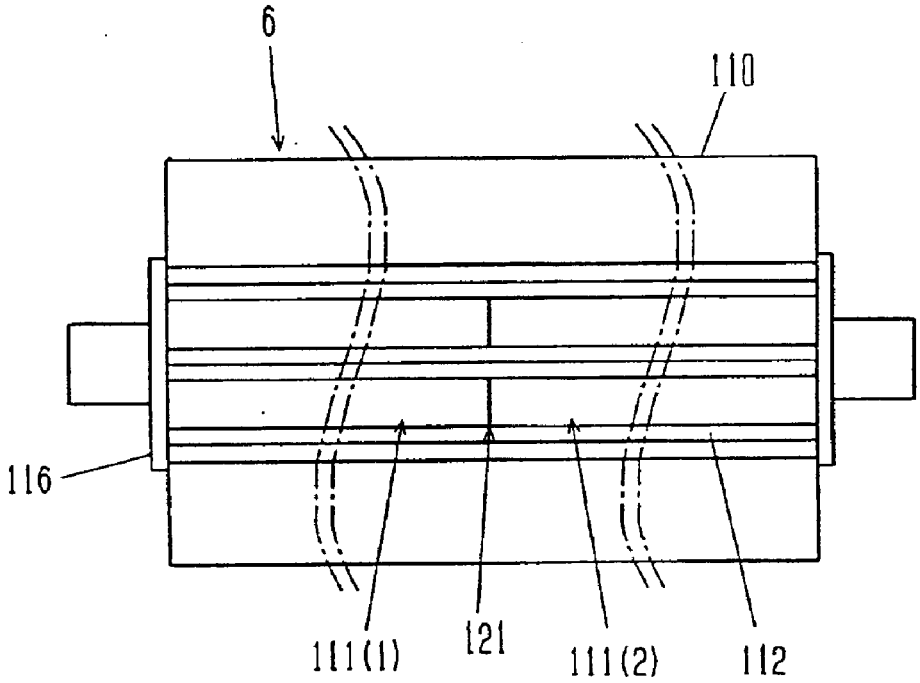
FIG. 55 is a plan view of another modification of the embodiment in FIG. 49.
Figure 56:
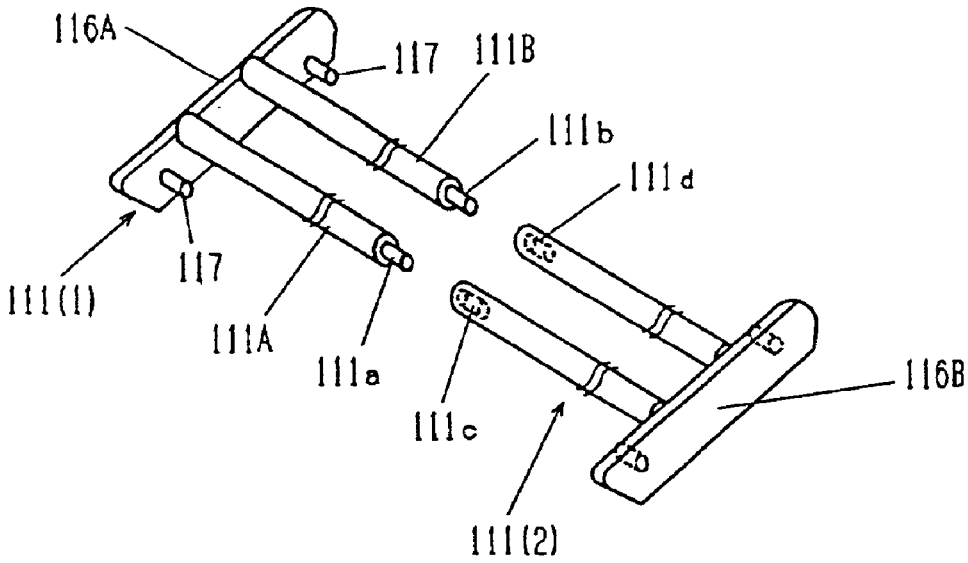
FIG. 56 is a perspective view of a bar member unit to be attached to the cleaning fabric take-up shaft in FIG. 55.

In FIG. 55 is shown another modification of the structure where bar members are coupled at the middle portion of a groove in a shaft member. Bar member units 111(1) and 111(2) are coupled at a coupling portion 121 at the distal ends of the bar members before being attached to a shaft member 110. In FIG. 56, protrusions 111*a* and 111*b* are formed on the ends of the bar members on one side, while holes 111*c* and 111*d* are formed in the ends of the other bar members. To attach the individual units to the shaft member 110, the bar members are moved in the longitudinal direction at the coupling portion 121, and protrusions are inserted into holes and secured.

Figure 57:
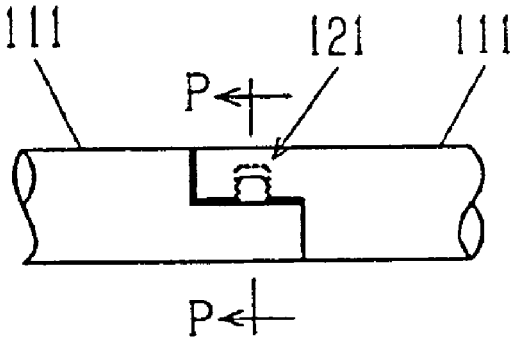
FIG. 57 is a side view of another example of the coupling structure of the bar member.

In a structure for coupling bar members in FIG. 57, bar members 111 are coupled together in the direction perpendicular to the longitudinal direction of the bar members 111. The distal ends of the bar members to be coupled have faces that are parallel to each other in the longitudinal direction. Portions to be engaged are formed on the faces of bar members on one side, and engagement portions are formed on the faces of the other bar members opposite them. To attach the individual units to a shaft member, the engagement portions are employed to engage the portions to be engaged to couple bar member pair.

Figure 58:
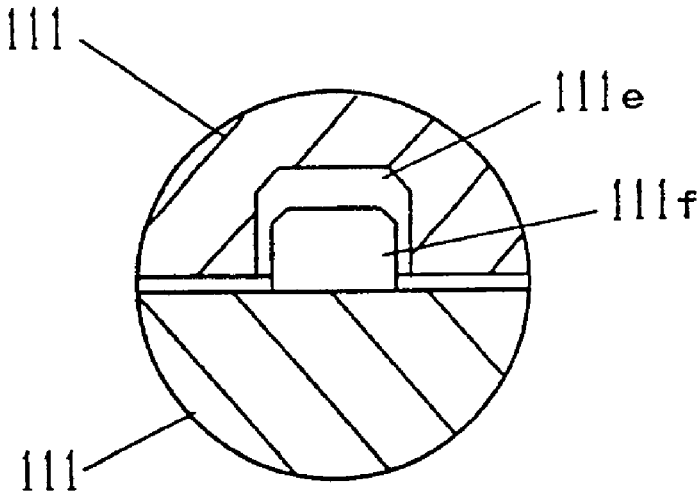
FIG. 58 is a cross-sectional view taken along line P—P in FIG. 57.

In FIG. 58, at the distal end of a bar member 111 by a cut portion is formed that is almost equivalent in size to half of the diameter. The internal face of the cut portion serves as a recessed portion 111*e*, which is a portion to be engaged, and a convex portion 111*f* is formed as an engagement portion on another bar member 111. The recessed portion 111*e* and the convex portion 111*f* engage to couple the bar members together. This coupled structure is not limited to that shown in the diagrams; but various other coupling techniques can be applied.

Figure 59A:
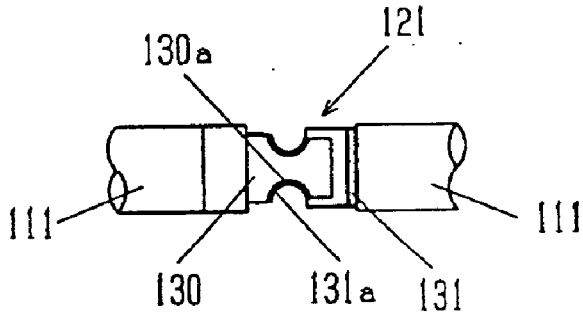
FIGS. 59A and 59B are a top view and a side view of an additional example of the coupling structure of the bar member.
Figure 59B:
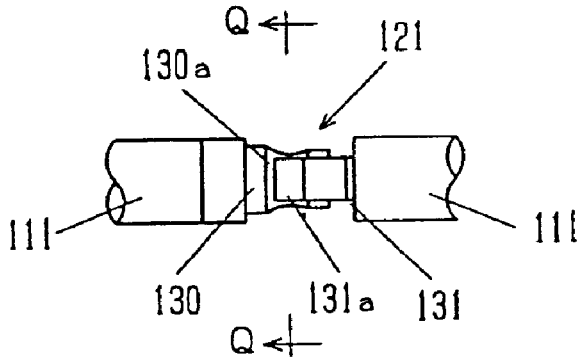
Figure 60:
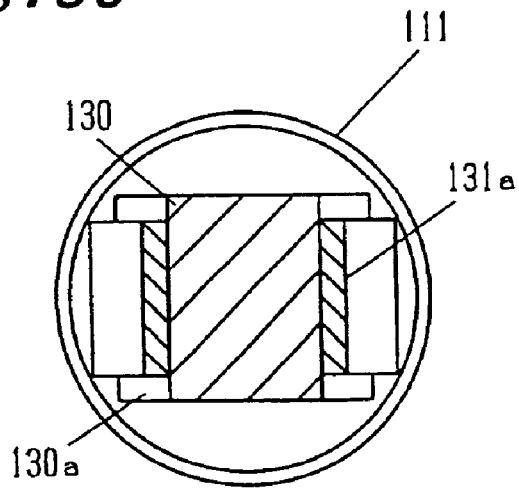
FIG. 60 is a cross-sectional view taken along line Q—Q in FIG. 59B.

In a coupled structure for bar members in FIGS. 59A and 59B, a coupling portion 121 is separately formed at the distal end of bar member for coupling them. A coupling member 130 having a portion to be engaged 130*a* is attached to the distal end of a bar member 111, as is shown in FIG. 60. A coupling member 131 having an engagement portion, for which hooks 131*a* are provided, is formed at the distal end of the other bar member 111. The hook portions 131*a* engage the portion to be engaged 130*a* to couple the bar members.

When one, or both, of the coupling member having the portion to be engaged and the coupling member having the engagement portion are formed of an elastic material, or when a click motion mechanism is adopted for the portion to be engaged or for the engagement portion, the engagement of the portions 131*a* and 130*a* is secured when the bar members are coupled together. Although in this modification, the portion to be engaged 130*a* is provided as a groove, it can be provided as a recessed portion or as a convex portion. In such a case, the hook of the engagement portion 131*a* should have a shape corresponding to either the recessed or the convex portion.

Figure 61:
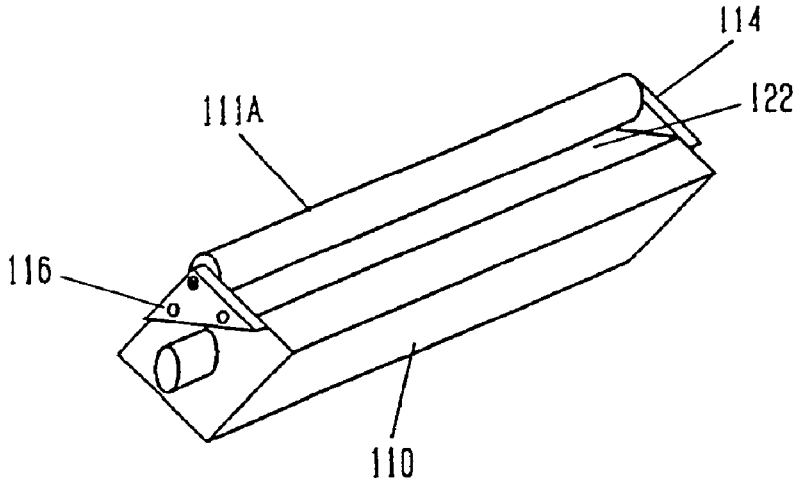
FIG. 61 is a perspective view of a cleaning fabric take-up shaft according to yet another embodiment of the present invention.

An explanation will now be given for a structure where a shaft member having a polygonal shape in cross section is employed, and a bar member is located at one corner at least. In FIG. 61 is shown a structure where a bar member is located at one corner of a shaft member that is a square in cross section. A portion 122 is formed by cutting off one corner portion of a shaft member along the entire length. In the cut portion 122, an end plate 114 and a support plate 116 are located opposite each other. The end plate 114 is secured to one axle end to hold one side of a bar member 111A in the longitudinal direction of the axle. A support plate 116 to which the bar member 111A is attached is detachably provided at the other end of the axle. While the bar member 111A is attached to the shaft member 110, a gap is formed between the cut face 122 of the shaft member and the bar member 111A.

To remove the bar member from cleaning fabric, when the support plate 116 is pulled to disengage one end of the bar member 111A from the end plate 114, the bar member 111A is moved toward the cut portion 122. Since the bar member 111A is thus separated from the cleaning fabric, the bar member 111A can be easily removed.

Although a solid-core shaft member has been employed for the cleaning fabric receiving shaft assemblies in the above embodiments, a hollow shaft member may also be employed. When a hollow shaft member, such as a pipe shaft, is employed for the assembly, the assembly is light and easy to handle. Specifically, in the cleaning fabric take-up shaft assembly in the embodiment shown in FIG. 31, when a shaft member having a groove in its outer periphery is employed, means can be provided for using a plate that covers the openings of the hollow shaft member to engage one end of a bar, member. As a result, the number of required components can be reduced.

Figure 62:
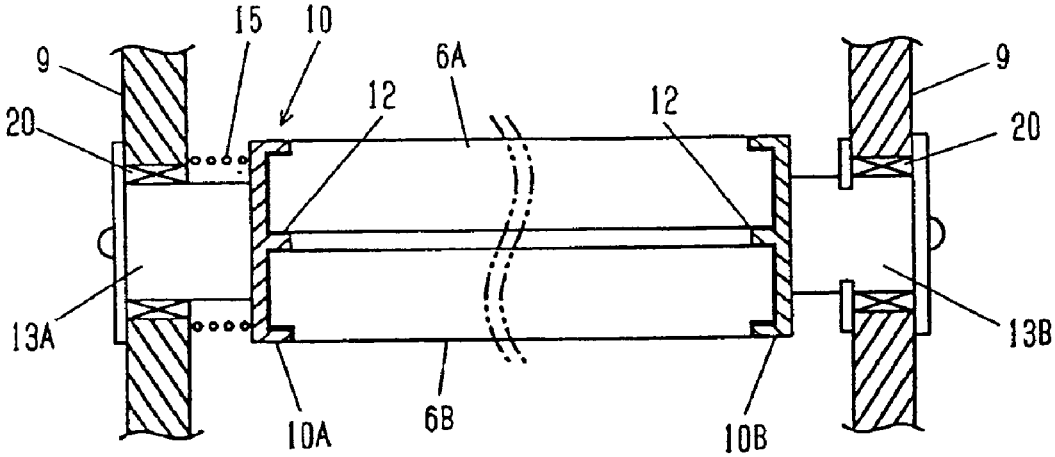
FIG. 62 is a front view of a shaft receiving section including the cleaning fabric take-up shaft.

An explanation will now be given for a cylinder cleaning device that has an assembly wherein a cleaning fabric take-up shaft is constituted by divided shaft members, which are supported at shaft receiving sections. In FIG. 62 is shown the structure of a cleaning fabric take-up shaft in a cylinder cleaning device. In this embodiment, shaft base portions 13*a* and 13*b* are formed for the first and the second shaft member fixing portions 10*a* and 10B, which constitute the shaft member fixing section 10 in the embodiment shown in FIG. 1. The shaft bases 13A and 13B are supported at shaft receiving sections 20 in the side plates 9. The shaft base portion 13A is rotatably supported and can be moved in the axial direction. The shaft base portion 13B is rotatably supported. The first shaft member fixing portion 10A is urged toward the second shaft member fixing portion 10B by a spring 15.

The shaft member fixing portion 10A is moved toward the side plates 9 to increase the interval between the shaft member fixing portions 10A and 10B. Shaft members 6A and 6B are positioned between the shaft member fixing portions 10A and 10B, and sandwiched between them by moving the shaft member fixing portion 10A. In this condition, since the spring 15 drives the shaft member fixing portion 10A, the shaft members 6A and 6B are stably secured between the shaft member fixing portions 10A and 10B. To dispose of the cleaning fabric, which has been hooked to the shaft members and wound around them, the first shaft member fixing portion 10A is moved toward the side plate 9, while holding a cleaning fabric roll. The shaft members 6A and 6B are first released from the side of the second shaft member fixing portion 10B, and then from the first shaft member fixing portion 10A. During this procedure, since a wedge 12 that is inserted between the shaft members 6A and 6*b* in the cleaning fabric roll is removed, the shaft members 6A and 6B approach each other and the diameter of the take-up shaft 6 is reduced. Therefore, the cleaning fabric is separated from the shaft members and the cleaning fabric take-up shaft 6 can be removed from the cleaning fabric roll.

The cylinder cleaning fabric is used for a cylinder cleaning device having an assembly where a cleaning fabric mounting element is fitted into the outer peripheries of shaft members, a shell member, or a member including an axle portion, all of which constitute a cleaning fabric take-up shaft.

Figure 63:
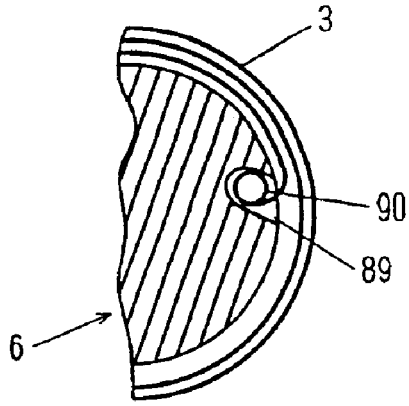
FIG. 63 is a diagram for explaining cylinder cleaning fabric.
Figure 64:
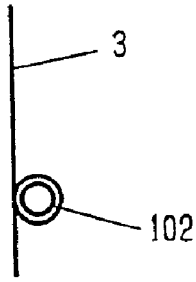
FIG. 64 is a diagram for explaining an example of a cleaning fabric mounting element.
Figure 65:
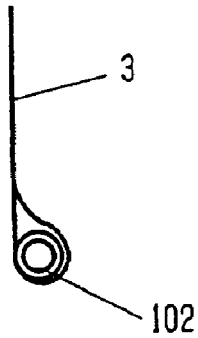
FIG. 65 is a diagram for explaining another example of the cleaning fabric mounting element.

In FIG. 63, a cleaning fabric mounting element 90 is fitted into an engagement groove 89 formed in the outer periphery of a cleaning fabric take-up shaft 6, and is rotated in the direction indicated by an arrow, so that cleaning fabric 3 is wound to form a roll. The cleaning fabric mounting element 90 forms a curled portion 102 in the vicinity of the tail end (FIG. 64) or at the tail end (FIG. 65) of the cleaning fabric 3. This curled portion 102 is formed by rolling up fabric only or by rolling the fabric around a core.

Figure 66:
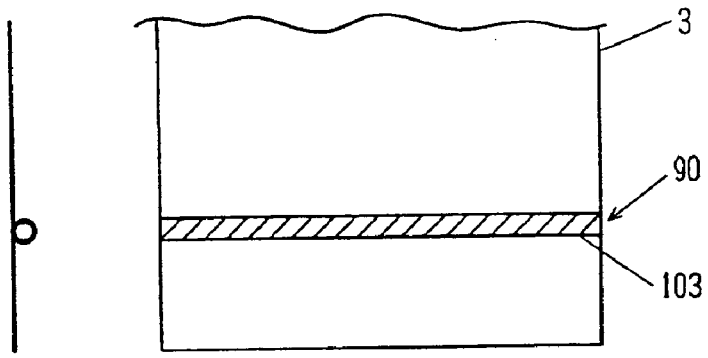
FIG. 66 is a diagram for explaining an additional example of the cleaning fabric mounting element.
Figure 67:
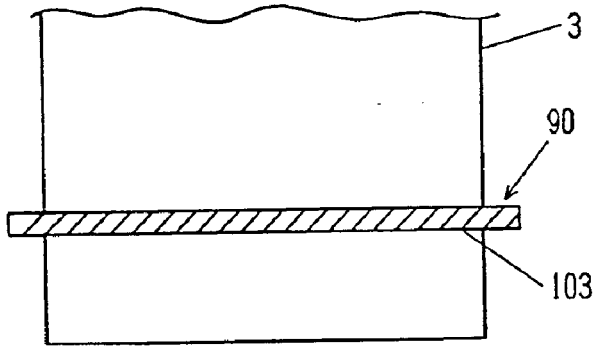
FIG. 67 is a diagram for explaining a further example of the cleaning fabric mounting element.
Figure 68:
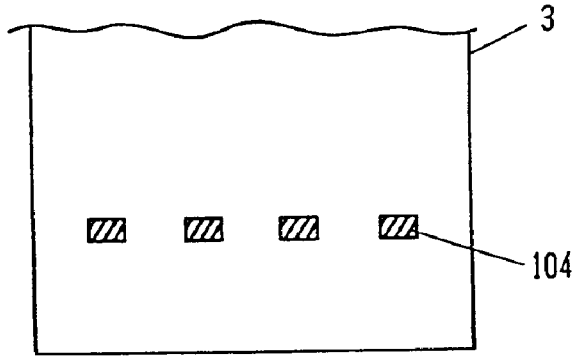
FIG. 68 is a diagram for explaining still another example of the cleaning fabric mounting element.

In FIGS. 66 and 67, the cleaning fabric mounting element 90 is formed as a bar or as a string member 103, which is provided at a location near the tail end (or at the tail end) of the cleaning fabric 3, and is located perpendicular to the direction in which the cleaning fabric 3 is fed. It is preferable that the bar or string member 103 be made of comparatively soft material, such as paper or cloth. A bar or string member 103 as long as the width of the cloth, or longer, is employed, or block members 104 shown in FIG. 68 are used as the member 103. Although in this example, one bar or string member, or one row of block members, is provided, a plurality of bar or string members, or a plurality of rows of block members, may be employed. Although the bar or string member 103, or the block members 104, are directly formed on the cleaning fabric 3, an additional member may be attached to the cleaning fabric to provide the member 103 or the members 104.

Figure 69A:
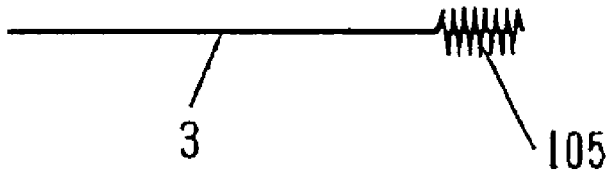
FIGS. 69A, 69B and 69C are diagrams for explaining a yet another example of the cleaning fabric mounting element.
Figure 69B:
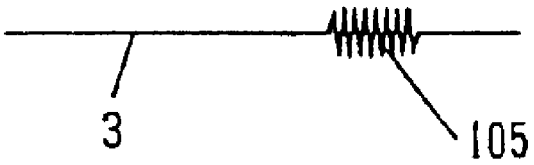
Figure 69C:
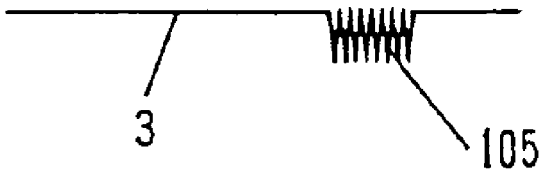

For another structure, as is shown in FIG. 69, a cleaning fabric mounting element 105 is formed where a cleaning fabric 3 is partially folded in a bellow's shape at the tail end of the fabric (FIG. 69A), or near the tail end (FIG. 69B). A cleaning fabric mounting element 105 in FIG. 69C has a fan-folded portion projecting out from one surface of cleaning fabric 3.

Figure 70A:
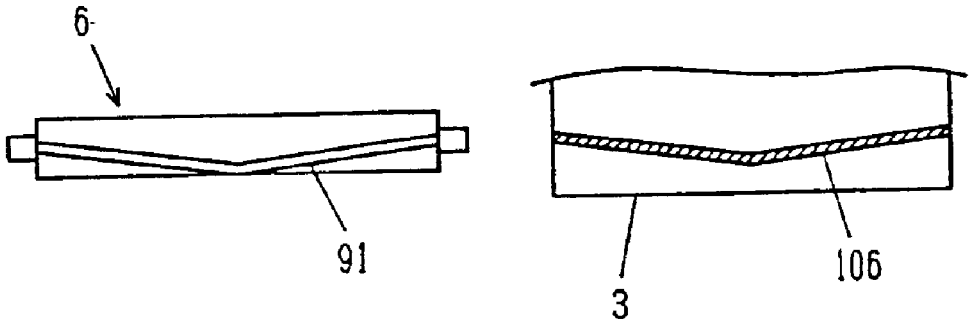
FIGS. 70A, 70B and 70C are diagrams for explaining an assembly of the cleaning fabric take-up shaft and the cleaning fabric mounting element.
Figure 70B:
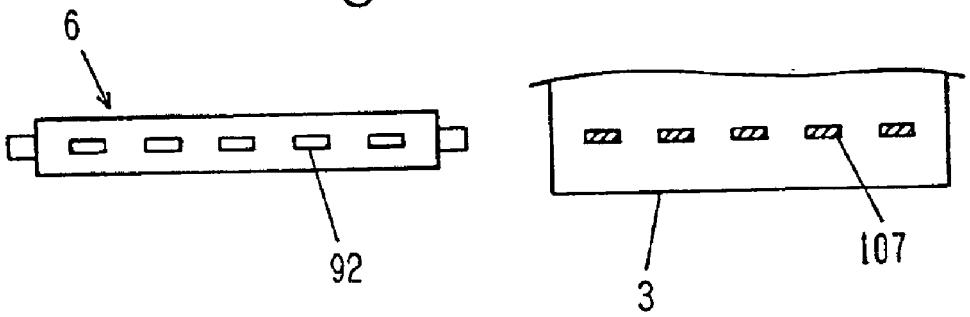
Figure 70C:
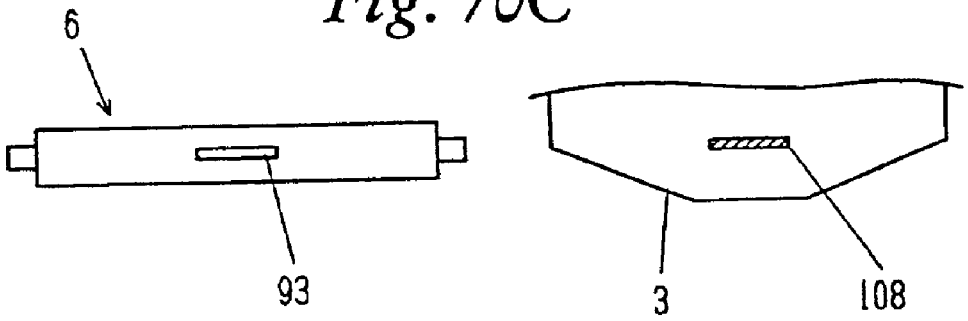

In FIGS. 70A, 70B and 70C are shown example combinations of an assembly for hooking cleaning fabric to a cleaning fabric take-up shaft and a cleaning fabric mounting element. A cleaning fabric take-up shaft 6 in FIG. 70A has an engagement groove 91 that runs obliquely towards either end from the center in the longitudinal direction of the shaft 6. A raised, cleaning fabric mounting element 106 to be fitted in the engagement groove 91 is formed on cleaning fabric 3. A cleaning fabric take-up shaft 6 in FIG. 70B has a plurality of recessed engagement portions 92 formed in along the longitudinal direction of the shaft 6. Block shaped leaning fabric mounting elements 107 to be fitted in the engagement recessed portions 92 are provided on cleaning fabric 3. A cleaning fabric take-up shaft 6 in FIG. 70C has an elongated engagement recessed portion 93 formed in the center in the longitudinal direction of the shaft 6. A long block shaped cleaning fabric mounting element 108 to be fitted in the engagement recessed portion 93 is formed on cleaning fabric 3.

Figure 71A:
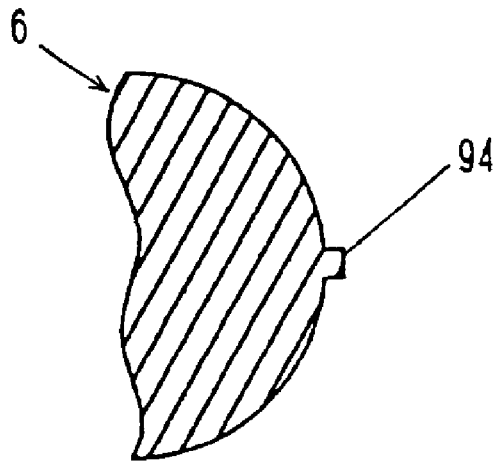
FIGS. 71A, 71B, and 71C are diagrams for explaining example structures of the outer periphery of the cleaning fabric take-up shaft.
Figure 71B:
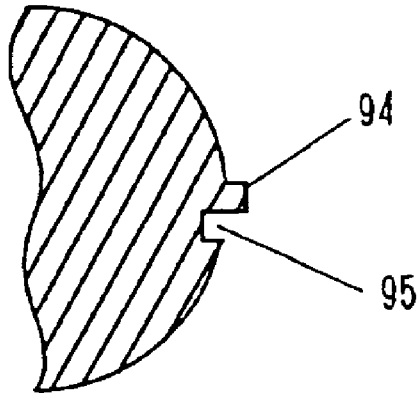
Figure 71C:
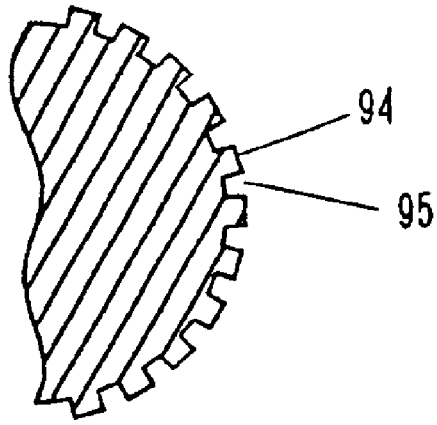

A modification of the structure for hooking the cleaning fabric to the cleaning fabric take-up shaft is shown in FIGS. 71A, 71B and 71C. In this modification, convex and/or recessed grooves, extending in the longitudinal direction of the shaft 6, are formed in the outer periphery of a cleaning fabric take-up shaft 6. A hooking mechanism shown in FIG. 71A has one convex line 94. A hooking mechanism in FIG. 71B has a paired convex line 94 and recessed line 95, which are adjacent to each other. A hooking mechanism in FIG. 71C has multiple convex lines 94 and recessed lines 95 that are continuously and alternately formed over the entire periphery.

When an assembly for changing the periphery of a cleaning fabric take-up shaft is used as a mechanism for mechanically changing the condition at the point where the cleaning fabric take-up shaft is in contact with cleaning fabric wound around the shaft, if a hook member is provided in the middle portion of the groove of the shaft member as is shown in FIG. 49 or FIG. 53, and the cleaning fabric is held and hooked between the bar member and the bottom of the groove of the shaft member, the hook member will obstruct the hooking of the bar member and the hooking of the cleaning fabric will not be ensured. In this example, an opening, a slit, etc., is formed at the position of the hooking member at the leading edge of the cleaning fabric or in its vicinity.

Various processes for hooking the cleaning fabric are shown in FIGS. 72A through 72D: a hole 3*a* through which a hook member is passed is formed near the leading edge of cleaning fabric 3 (FIG. 72A); a notch slit 3*b* through which a hook member is passed is formed at the leading edge of cleaning fabric (FIG. 72B), a notch 3*c* is formed at the leading ledge of cleaning fabric (FIG. 72C); and a portion, near the leading edge of cleaning fabric, where a hook member is located is formed as strips (FIG. 72D).

In this example, when a shaft member is to be removed from wound cleaning fabric, is probable that a cleaning fabric processed portion, such as a hole or a slit, may interfere with and be caught by a hook member, or that resistance by a hook member may prevent the shaft member from being smoothly pulled out. Thus, it is preferable that a hooking member have inclined faces on both sides, as is shown in FIG. 53.

Figure 73:
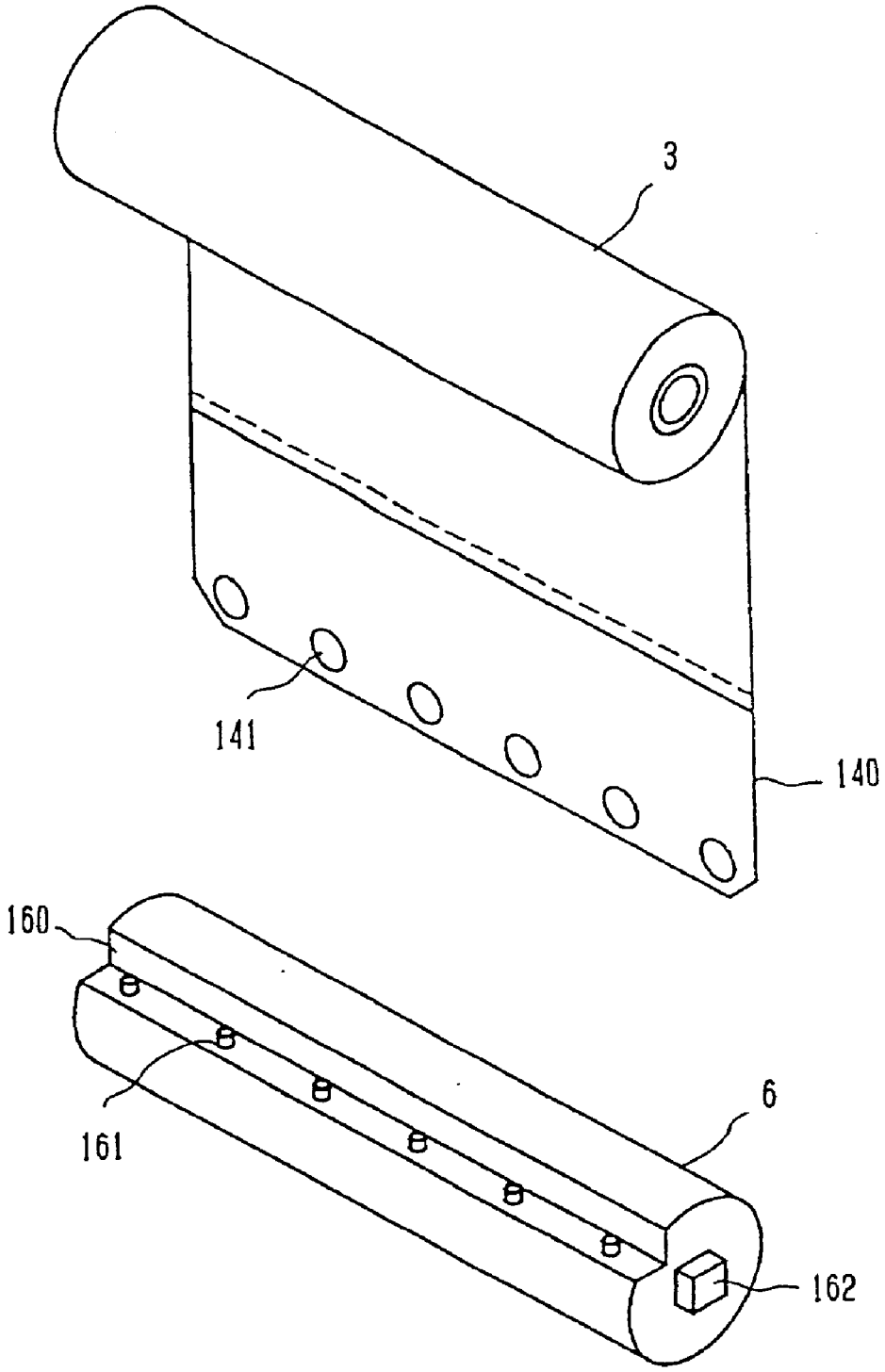
FIG. 73 is a perspective view of an engagement mechanism between the cleaning fabric and the take-up shaft.

An engagement structure for cleaning fabric and a take-up shaft is shown in FIG. 73. Taking into consideration various physical conditions, such as the tensile strength of cleaning fabric and the function relative to the outer periphery of a cleaning fabric take-up shaft, an end side portion 140 of cleaning fabric 3 is formed of a thick paper sheet or a synthetic resin sheet, for example, and is added to the cleaning fabric 3. A surface process may be performed for the end side portion 140 of the cleaning fabric 3. Unlike the above described process where a member (coupling member) that differs from the cleaning fabric 3 is used to form the fabric end side portion 140, which is then added to the fabric end side, a special process, such as reinforcing or coating, or impregnation with a low friction material or a curing agent, is performed directly on the end side portion 140 to satisfy the above described conditions.

A portion to be engaged is provided at the thus fabricated front edge, at or near the end side portion of the cleaning fabric.

The means to be engaged includes the end side portion 140 in which a plurality of engagement holes 141 are formed. Means for hooking the engagement holes 141 is provided on the side of a take-up shaft 6. A notched portion 160 is formed in the axial direction of the take-up shaft 6. Protrusions 161 are arranged on the face of the notched portion 160 in the direction in which the cleaning fabric 3 is wound and correspond to the engagement holes 141 of the cleaning fabric 3.

The take-up shaft 6 has a shaft attachment portion 162 that is rotatably supported by the side plate 9 of the cleaning unit 2. The projected shaft attachment portion 162 has a polygonal shape, as is shown in FIG. 73.

Although in this example six engagement holes are formed for the cleaning fabric and six protrusions are formed on the take-up shaft, an arbitrary number can be selected. When a plurality of protrusions and holes are formed, at the initiation of the winding, the right angle for the cleaning fabric relative to the take-up shaft is easily obtained.

Figure 74A:
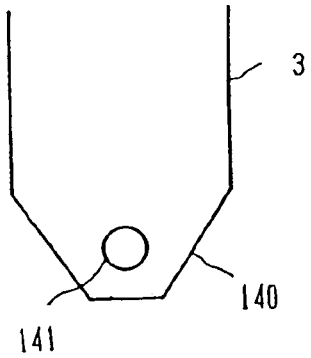
FIGS. 74A through 74F are diagrams of modifications of a portion of the cleaning fabric to be engaged.
Figure 74B:
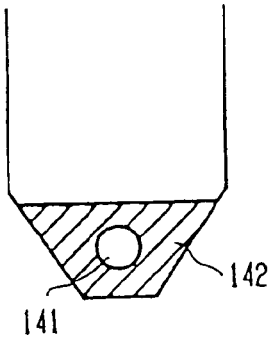
Figure 74C:
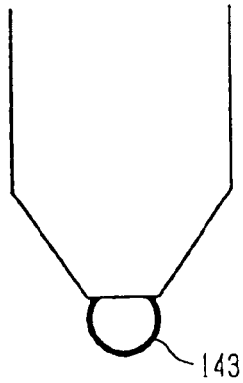
Figure 74D:
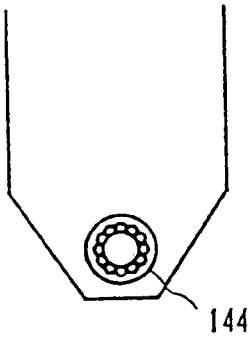
Figure 74E:
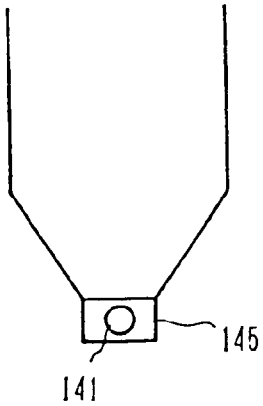
Figure 74F:
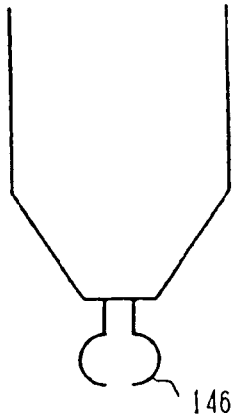

Modifications of the portion of the cleaning fabric to be engaged are shown in FIGS. 74A through 74F: a single engagement hole 141 is formed in an end side portion 140 of cleaning fabric (FIG. 74A); a reinforced portion (shaded portion) 142 is provided on an end side portion 140 of cleaning fabric 3, and an engagement hole 141 is formed in the reinforced portion 142 (FIG. 74B); a ring 143 is formed (FIG. 74C); and a hook A 144 is formed (FIG. 74D); a member 145 having an engagement hole 141 is independently formed (FIG. 74E); and a hook B 146 is formed (FIG. 74F).

Figure 75:
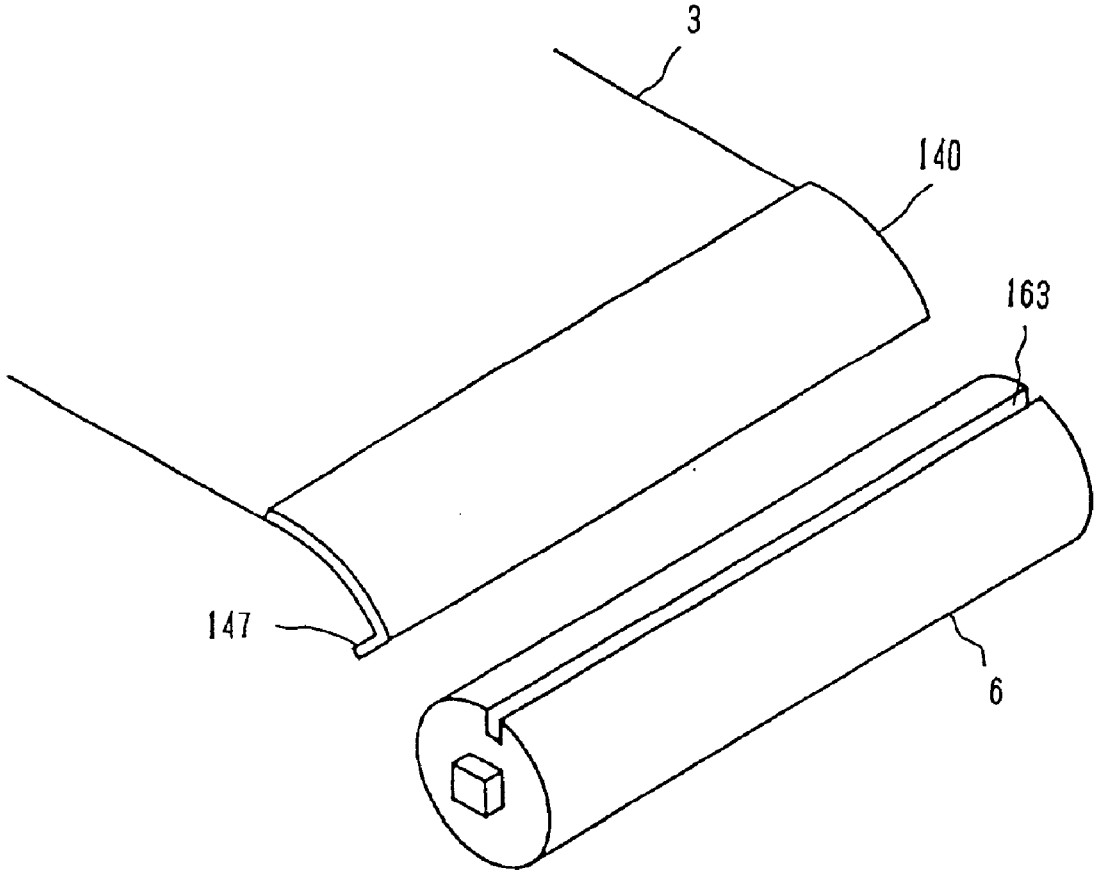
FIG. 75 is a perspective view of a modification of the engagement mechanism.

Another example of the engagement structure for cleaning fabric relative to the take-up shaft is shown in FIG. 75. As means of cleaning fabric to be engaged, provided is a portion to be engaged that has a bent portion at an end side of the cleaning fabric. The portion to be engaged is hooked into a recessed portion that is provided in the longitudinal direction in the outer periphery of the take-up shaft.

In FIG. 75, an end side portion 140 of cleaning fabric 3 is made of a hard material, such as thick paper. A portion to be engaged 147 is provided by bending the tip of the end side portion 140. A recessed portion 163 having a grooved shape is formed in the outer periphery of the take-up shaft 6 in the longitudinal direction. When the cleaning fabric 3 is to be wound around the take-up shaft 6, the portion to be engaged 147 of the end side portion 140 of the cleaning fabric 3 is fitted into the recessed portion 163 of the take-up shaft 6.

Figure 76:
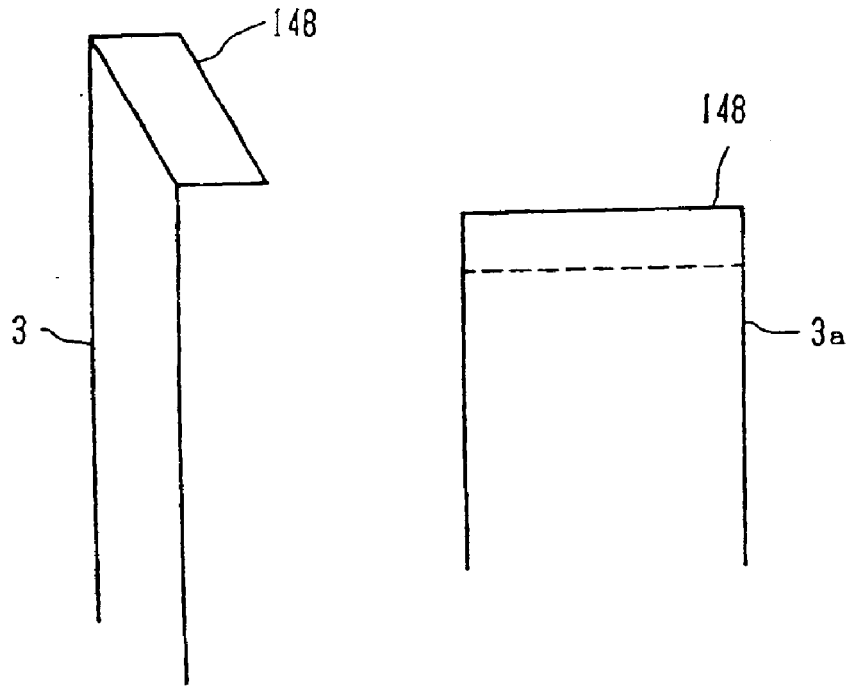
FIG. 76 is an explanatory diagram for another modification of the engagement mechanism.
Figure 77:
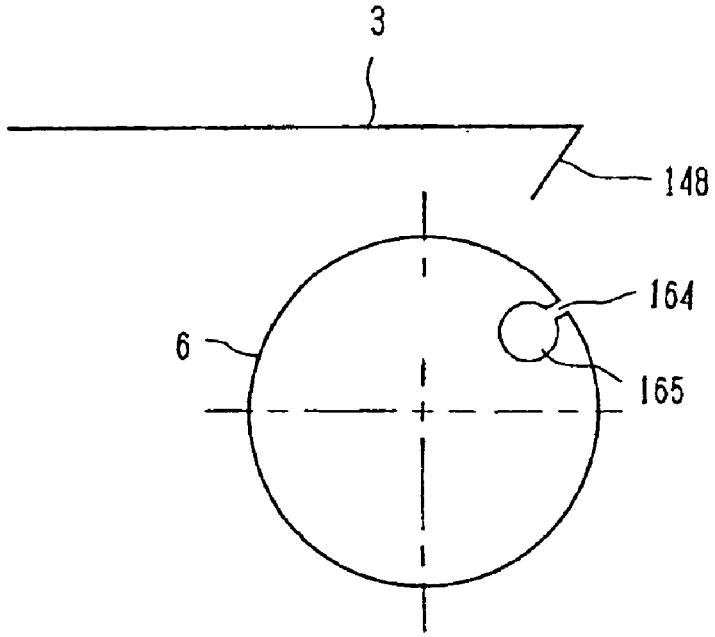
FIG. 77 is an explanatory diagram for an additional modification of the engagement mechanism.

A modification of the above described structure will now be explained. In FIG. 76, at the end side portion of the cleaning fabric 3, a portion to be engaged 148 is formed by folding the cleaning fabric 3. The portion to be engaged 148 is fitted into a recessed portion 164 have a slit shape, which is formed in the longitudinal direction in the outer periphery of the take-up shaft 6 in FIG. 6.

Preferably, perforations 3*a* are formed in advance at a folded portion of the portion to be engaged 148. In the take-up shaft 6, a hole 65 is formed with which the recessed portion 164 communicates and which passes through in the longitudinal direction of the shaft 6. The portion to be engaged 148 is folded at the perforations 3*a* and is fitted into the recessed portion 164. In this condition, the distal end of the portion to be engaged 148 projects inward into the hole 165, ensuring the winding of cleaning fabric. When the wound cleaning fabric is to be removed from the take-up shaft 6, a tool (not shown) having a blade at the distal end is inserted into the hole 165, and cuts the portion to be engaged 148 at the perforations 3*a*.

Figure 78:
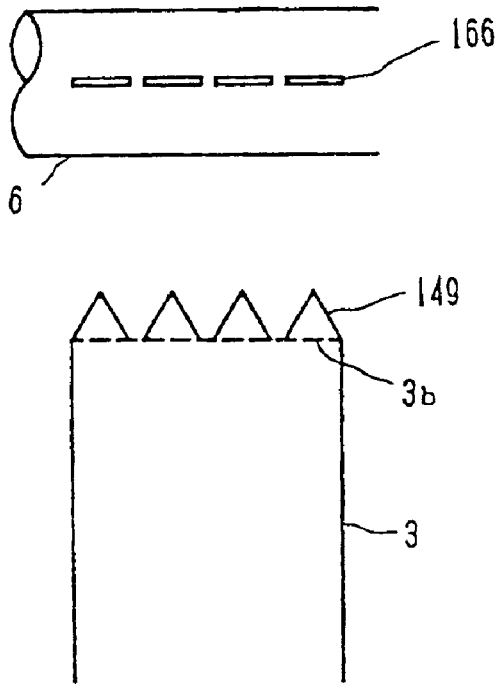
FIG. 78 is an explanatory diagram for a further modification of the engagement mechanism.

In a structure in FIG. 78, a portion to be engaged 149 having a corrugated shape is formed on the end side of cleaning fabric 3. Slits 166 are formed in a take-up shaft 6 and correspond to the corrugated shape of the portion to be engaged 149 of the cleaning fabric 3. Perforations 3*b* are formed in advance at the root of the corrugate portion to be engaged 149. When the cleaning fabric 3 is to be engaged with the take-up shaft 6, the portion to be engaged 149 is folded at the perforations 3*b* and is securely fitted into the slits 166. By the fitting the corrugated portion to be engaged 149 into the slits 166, the right angle and the widthwise positioning of the cleaning fabric relative to the take-up shaft can be performed at the same time.

Figure 79:
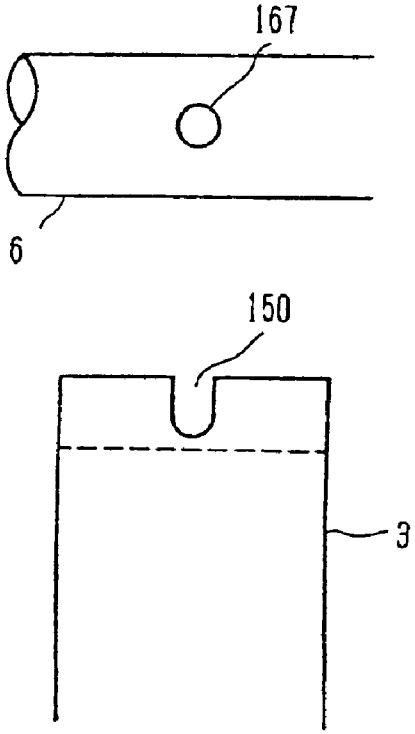
FIG. 79 is an explanatory diagram for still another modification of the engagement mechanism.

In an engagement structure in FIG. 79, for aligning a portion to be engaged, a position at the end side portion of cleaning fabric 3 is provided as means to be engaged for the cleaning fabric 3. The portion to be engaged is fitted over a boss.

A U-shaped portion to be engaged 150, which is open at its front edge, is formed at the end side portion of cleaning fabric. A boss 167 projects from the outer periphery of the take-up shaft 6.

To wind the cleaning fabric around the take-up shaft, the boss 167 is fitted into the portion to be engaged 150 of the cleaning fabric 3. When the right angle of the cleaning fabric 3 is confirmed, the cleaning fabric 3 is wound around the take-up shaft 6 as it is rotated.

Figure 80:
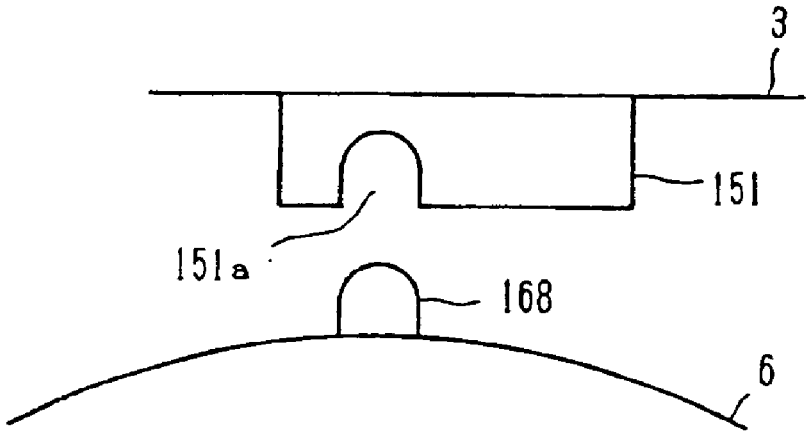
FIG. 80 is an explanatory diagram for yet another modification of the engagement mechanism.

In an engagement structure shown in FIG. 80, a portion to be engaged, which is an independent member, is attached as means to be engaged of cleaning fabric to the end side of cleaning fabric. The portion to be engaged is fitted over a boss that is formed on the take-up shaft. A portion to be engaged 151 is formed at the end side portion of cleaning fabric 3, and a hole 151*a* is formed therein that opens in the direction perpendicular to the face of the cleaning fabric 3. A boss 168 is formed on the outer periphery of a take-up shaft 6 and is to be fitted into the hole 151*a* of the portion to be engaged 151.

Figure 81:
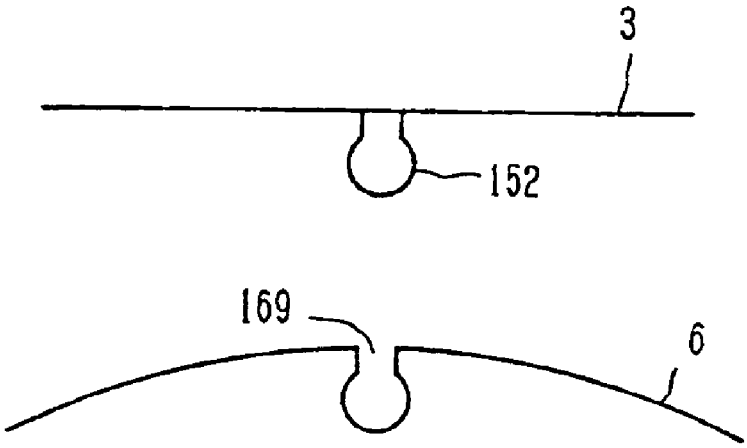
FIG. 81 is an explanatory diagram for a still further modification of the engagement mechanism.

In a structure shown in FIG. 81, a portion to be engaged 152 having a spherical convex portion is formed on the end side portion of cleaning fabric 3. A spherical recessed portion 169 is formed in the outer periphery of a take-up shaft 6.

With the structures in FIGS. 80 and 81, the right angle and the widthwise positioning of the cleaning fabric relative to the take-up shaft can be easily performed by engaging the portion to be engaged with the engagement portion.

Figure 82:
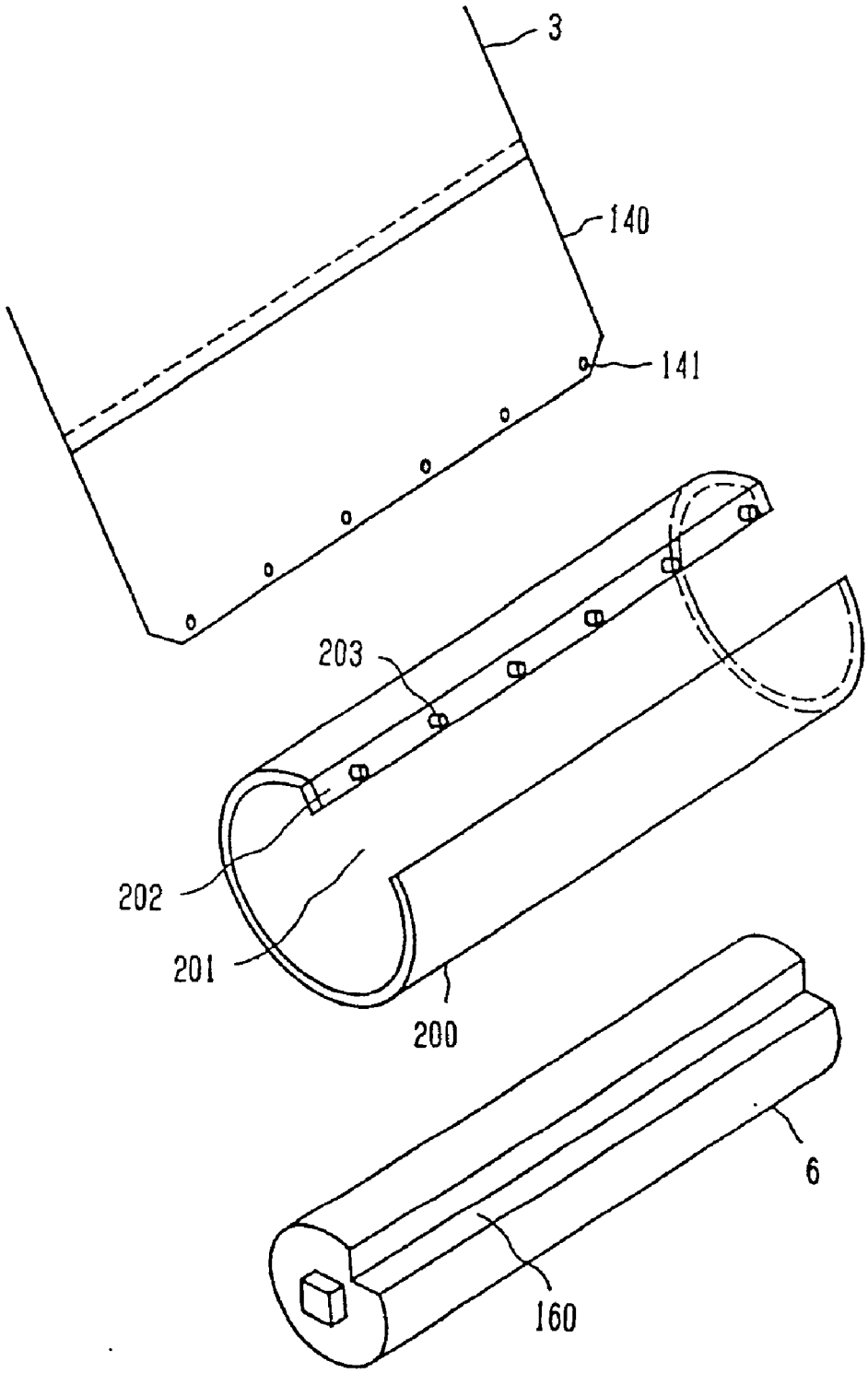
FIG. 82 is a perspective view of another example of the engagement mechanism.

In an engagement structure in FIG. 82, a portion to be engaged is attached as means to be engaged for cleaning fabric 3 to the end side portion of the cleaning fabric 3. A take-up shaft has a shell member on which projections are formed. The projections on the shell member are fitted into the portion to be engaged of the cleaning fabric 3. The portion to be engaged of the cleaning fabric will be explained by employing the structure shown in FIG. 73.

A sleeve member 200 in FIG. 82, a shell member, has an open portion 201 that is not contiguous with the outer circumference. An attachment portion 202 is formed entirely at one open edge in the longitudinal direction, extending inward. An engagement portion 203 on which are projections is formed on the attachment portion 202. A notched of portion 160 is formed in the portion of a take-up shaft 6 where the attachment portion 202 of the sleeve member 200 is positioned. The inner diameter of the sleeve member 200, which is larger than the diameter of the take-up shaft 6, is reduced by winding the cleaning fabric 3 around it, and the sleeve 200 is closely attached to the take-up shaft 6.

The sleeve member 200 is fitted over the take-up shaft 6, the attachment portion 202 is positioned at the notched portion 160, and the portion to be engaged 141 of the cleaning fabric engages the engagement portion 203. Then, when the cleaning fabric is wound around the take-up shaft via the sleeve member 200, the diameter of the sleeve member 200 is reduced by the winding force, and the sleeve member 200 is thus closely attached to the take-up shaft 6. While the take-up shaft 6 is rotated to wind the cleaning fabric, the attachment portion of the sleeve member 200 is held by the notched portion 160, so that the sleeve member 200 will not slip across the take-up shaft 6.

Figure 83:
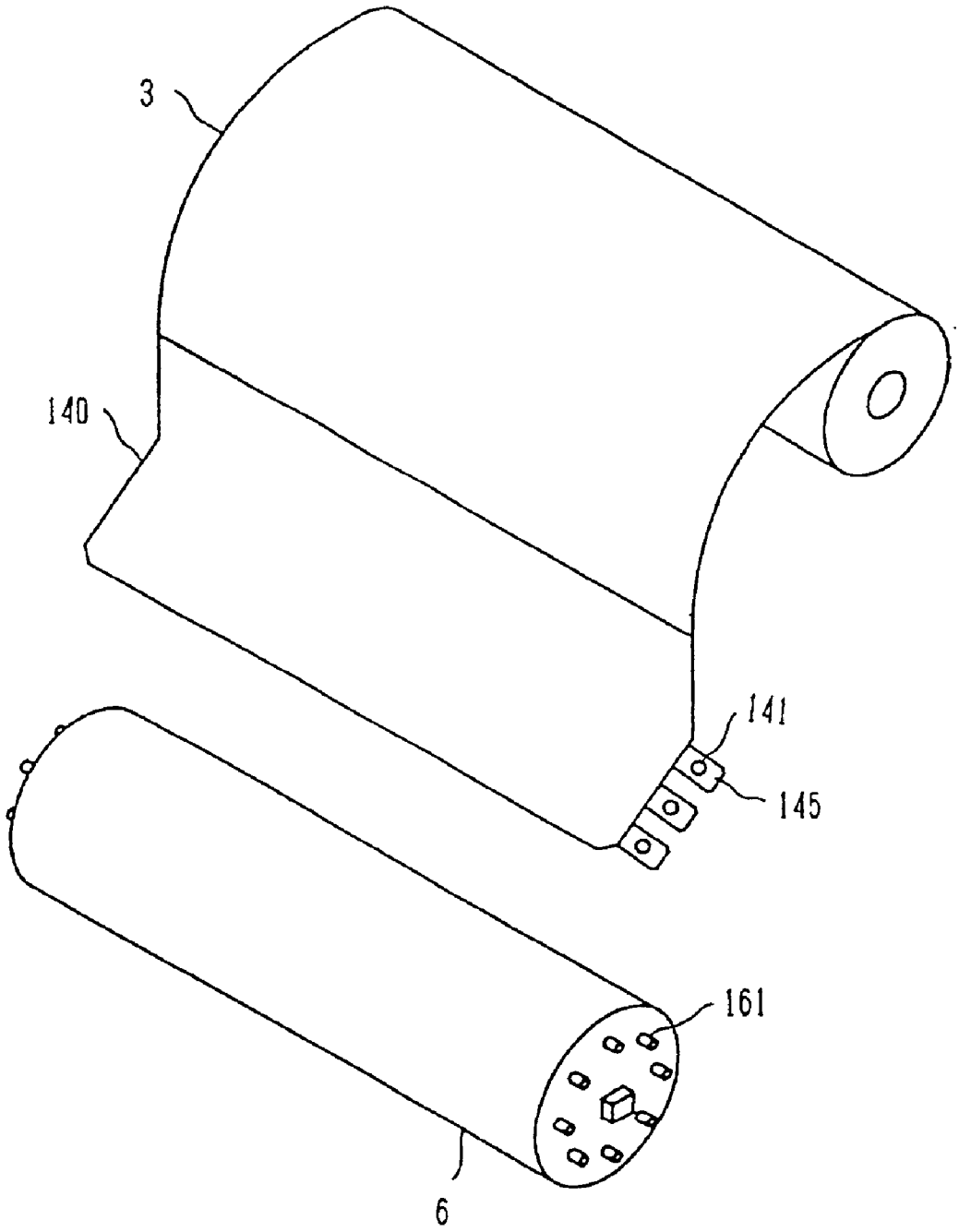
FIG. 83 is a perspective view of an additional example of the engagement mechanism.

In an engagement structure in FIG. 83, a portion to be engaged is formed as means to be engaged for cleaning fabric 3 on the side edge of the end side portion of the cleaning fabric 3. This portion to be engaged is fitted over an engagement portion, which is formed at the ends of a take-up shaft. The portion to be engaged of the cleaning fabric 3 will be explained by employing the structure in FIG. 74E. It should be noted that a plurality of independent members 145 having engagement holes 141 are formed at predetermined intervals.

Engagement holes 141 are formed, as portions to be engaged 145, at an end side portion 140 of the cleaning fabric 3. An engagement portion 161 having projections is formed on both ends of a take-up shaft 6, so that the projections are to be fitted in the engagement holes 141.

The portions to be engaged 145 that project out to the side of the cleaning fabric are bent toward the shaft end, so that the projections can be passed through them.

Figure 84:
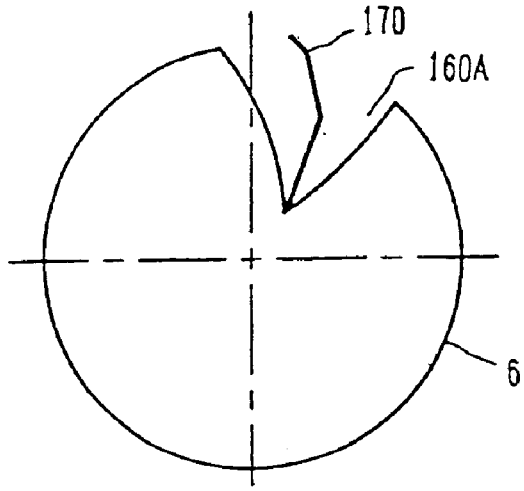
FIG. 84 is a perspective view of a further example of the engagement mechanism.

In an engagement structure in FIG. 84, the end side portion of cleaning fabric is held against a take-up shaft and secured.

A wide notched portion 160A is formed in a take-up shaft 6 in the longitudinal direction. A holding member 170 is rotatably provided at the notched portion 160A. The holding member 170 is supported at one end by a rotary shaft, and is urged in the direction indicated by an arrow by a spring, etc. With this arrangement, the holding member is moved against the force exerted by the spring, etc., in the direction opposite the direction indicated by the arrow, and a gap is formed between one face of the notched portion 160A and the holding member 170. When the end side portion of the cleaning fabric has been inserted, the holding member 170 is moved in the direction indicated by the arrow to hold the cleaning fabric.

Figure 85:
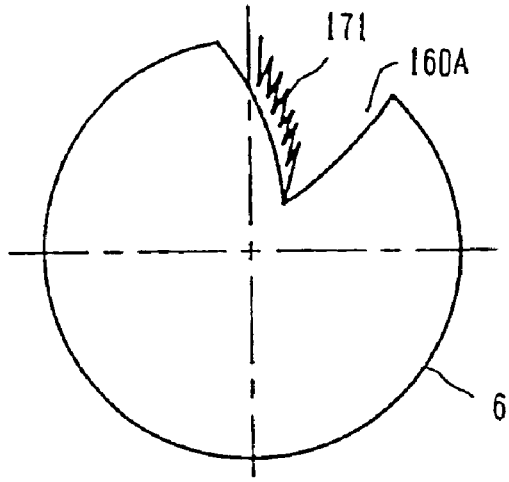
FIG. 85 is an explanatory diagram showing a modification of the example engagement mechanism in FIG. 84.
Figure 86:
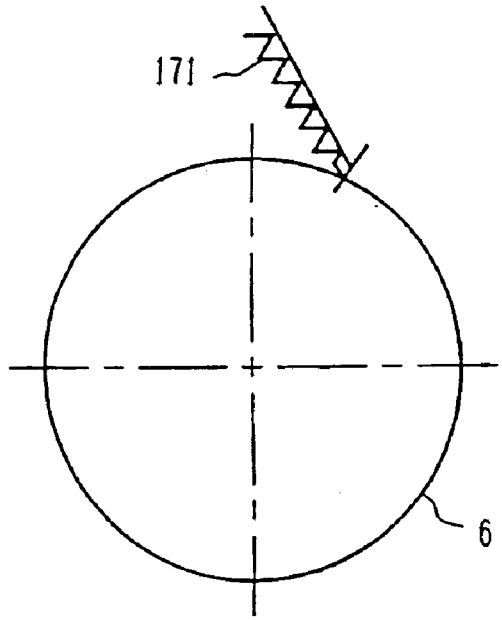
FIG. 86 is an explanatory diagram showing another modification of the example engagement mechanism in FIG. 84.

In an engagement structure in FIG. 85, the end side portion of cleaning fabric is held by joining the faces of the end side portion and the take-up shaft. A planar fastener or an adhesive sheet, for example, is bonded, as joining means 171, on one face of the notched portion 160A of a take-up shaft 6. A planar faster is provided as means to be joined at the end side portion of the cleaning fabric 3 so as to easily stick to the adhesive sheet. A structure shown in FIG. 86 employs the surface of a take-up shaft 6 to constitute the joining means 171.

An explanation will be given for an embodiment of a disengagement mechanism for removing used cleaning fabric that is wound around a take-up shaft 6.

Figure 87:
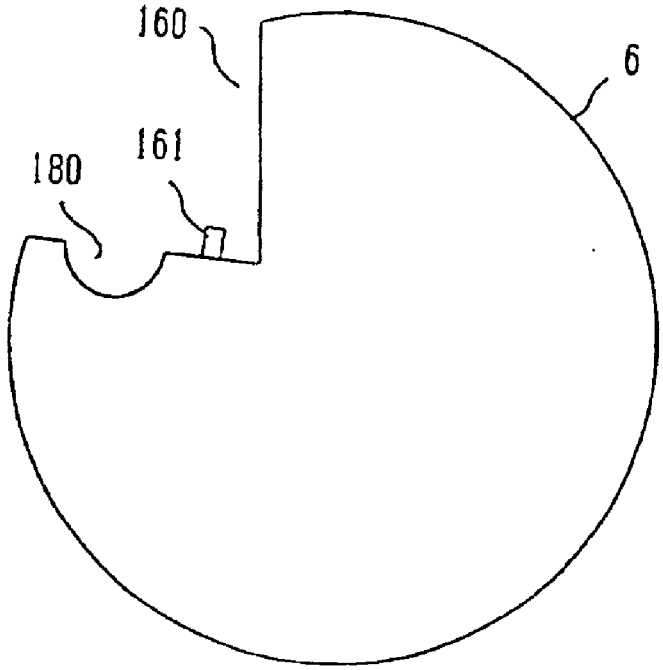
FIG. 87 is a side view of a disengagement mechanism between the cleaning fabric and the take-up shaft.

A structure for the disengagement of the cleaning fabric from a take-up shaft is shown in FIG. 87. In this embodiment, a mechanism is provided in a take-up shaft for disengaging the portion to be engaged of the cleaning fabric from the engagement portion.

Figure 88:
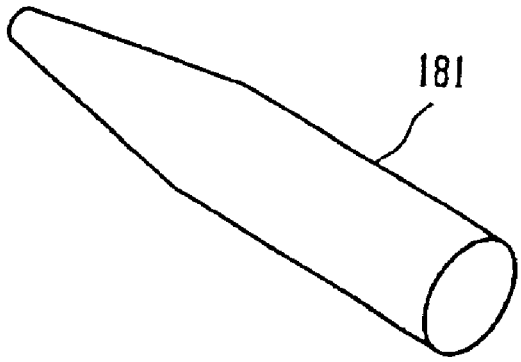
FIG. 88 is a perspective view of a disengagement tool.

A recessed portion 180 having a semicircular shape in cross section is formed in a notched portion 160 where an engagement portion 161 is formed. A disengagement tool 181 having a bar shape in FIG. 88 is inserted into the recessed portion 180.

Figure 89A:
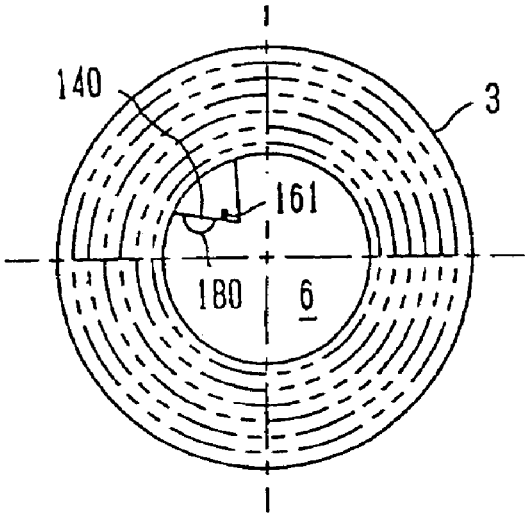
FIGS. 89A, 89B and 89C are diagrams for explaining a disengagement process.
Figure 89B:
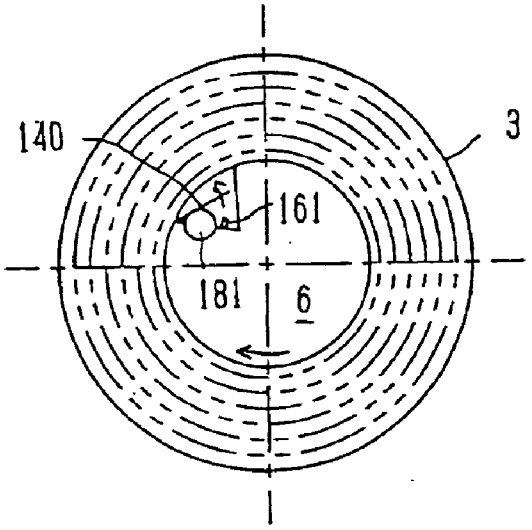
Figure 89C:
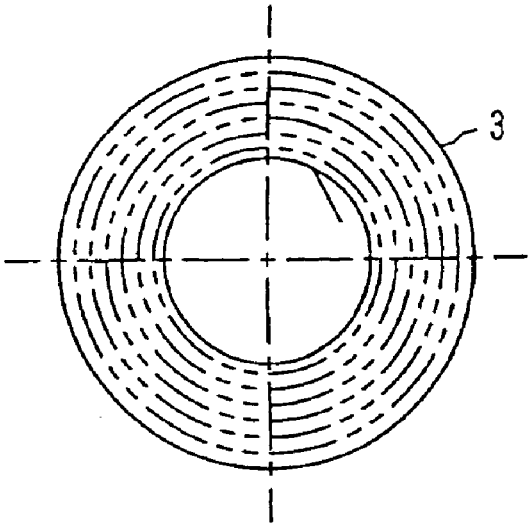
Figure 90:
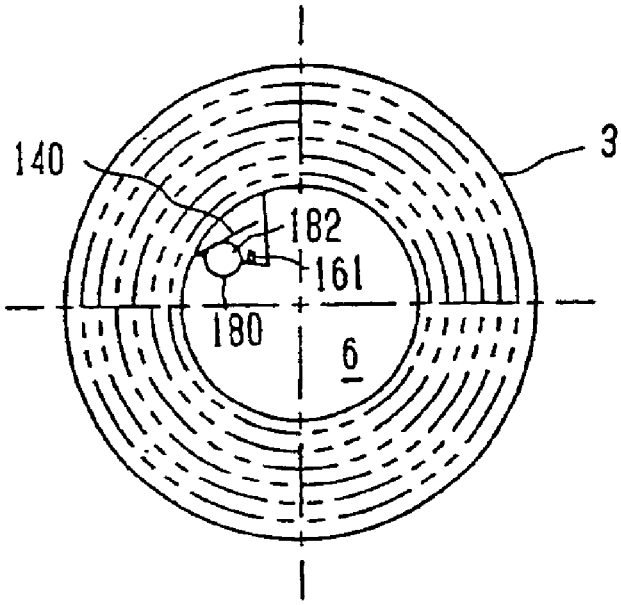
FIG. 90 is an explanatory diagram for an example engagement/disengagement mechanism.
Figure 91:
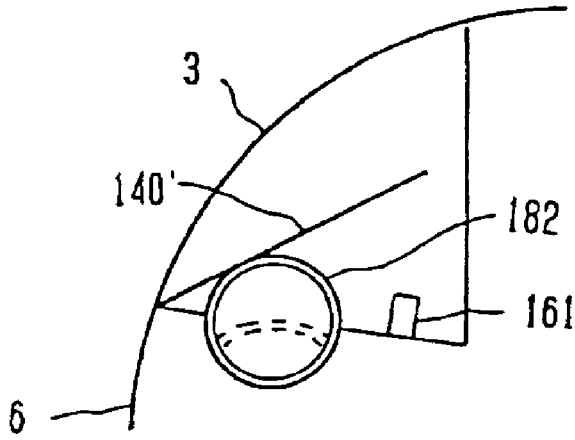
FIG. 91 is a partial enlargement diagram of FIG. 90.

In FIG. 89A is shown a condition where cleaning fabric 3 has been wound around a take-up shaft 6. To remove the used cleaning fabric 3 from the take-up shaft 6, the disengagement tool 181 is inserted into the recessed portion 180 from the shaft end. The end side portion 140 of the cleaning fabric 3 is raised by the disengagement tool 180 in the direction indicated by an arrow in FIG. 89B, and is disengaged from the engagement portion 161. While pressing down the cleaning fabric 3, the take-up shaft 6 is rotated in the direction indicated by the arrow and is pulled out. The cleaning fabric 3 can be separated from the take-up shaft 6, while retaining the shape it acquired when wound around the take-up shaft 6 (FIG. 89C). Thereafter, the cleaning fabric 3 is disposed of A modification of the disengagement mechanism is shown in FIG. 90. An inflation member 182 is provided in a recessed portion. To remove used cleaning fabric 3 from a take-up shaft 6, compressed air is supplied to expand the inflation member 182 from the shrunken state which is indicated by the broken lines in FIG. 91. Accordingly, an end side portion 140 of the cleaning fabric 3 is raised, disengaging an engagement portion 161.

An explanation will be given for a structure where only one mechanism is employed to engage cleaning fabric with a take-up shaft, and to disengage and remove the used cleaning fabric that is wound around the take-up shaft.

Figure 92:
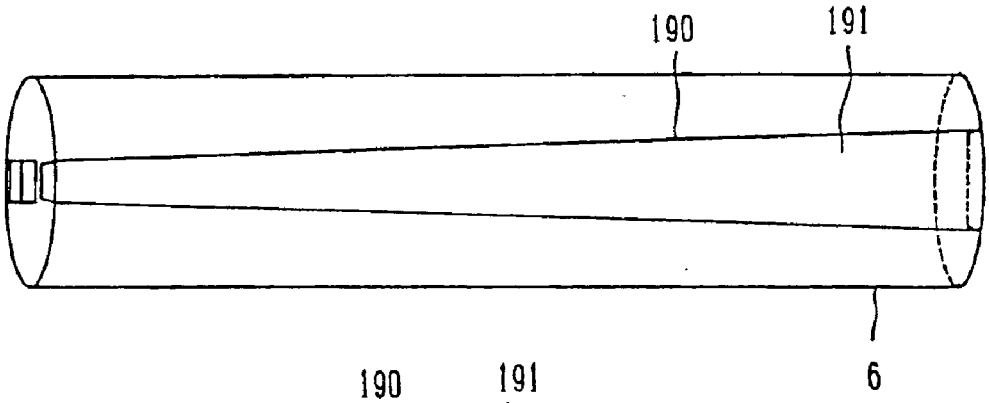
FIG. 92 is a perspective view of another example of the engagement/disengagement mechanism.
Figure 93:
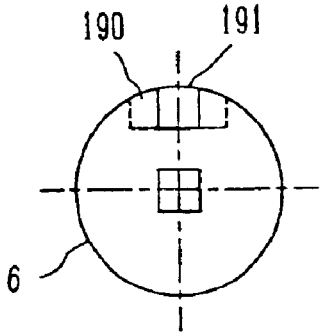
FIG. 93 is a left side view of the mechanism in FIG. 92.

A structure for engagement/disengagement of cleaning fabric relative to a take-up shaft is shown in FIG. 92. In this embodiment, provided is a structure wherein the cleaning fabric is engaged by its end side portion being held against the take-up shaft side. Further, by detaching a holding member from the shaft, the shape of the take-up shaft is changed to perform disengagement.

A groove (taper groove) 190, for which the width is changed while traveling from one end to the other end, is formed in a take-up shaft 6 in the longitudinal direction. A holding member is provided, which includes a key member 191 having the same shape as the groove 190 that is to be inserted into the groove 190. The key member 191 is removed from the groove 190, and the end side portion of the cleaning fabric is inserted into the groove 190. Then, the key member 191 is inserted into the groove 190, and the cleaning fabric is securely held by the outer side of the key member 191 and the internal face of the groove 190. At this time, the surface of the key member 191 is at the same level as the surface of the take-up shaft 6, integrally forming a part of the surface of the take-up shaft 6. To remove the used cleaning fabric from the take-up shaft, the key member 191 is detached to disengage the cleaning fabric from the take-up shaft. Since the shape of the take-up shaft is changed by the detachment of the key member 191, the take-up shaft 6 can be easily removed from the used cleaning fabric 3.

In this embodiment, the end side portion of the cleaning fabric 3 is held between the key member and the take-up shaft. However, the cleaning fabric engagement portion may be provided at another location, and the key member may be used only for a disengagement function for loosening the cleaning fabric 3.

Figure 94:
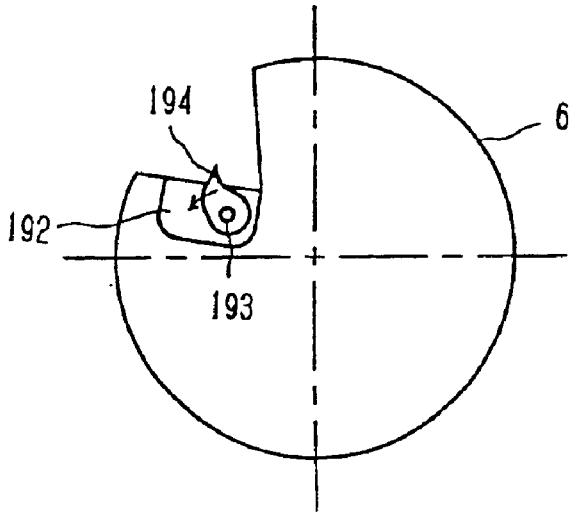
FIG. 94 is an explanatory diagram for a modification of the engagement/disengagement: mechanism.
Figure 95:
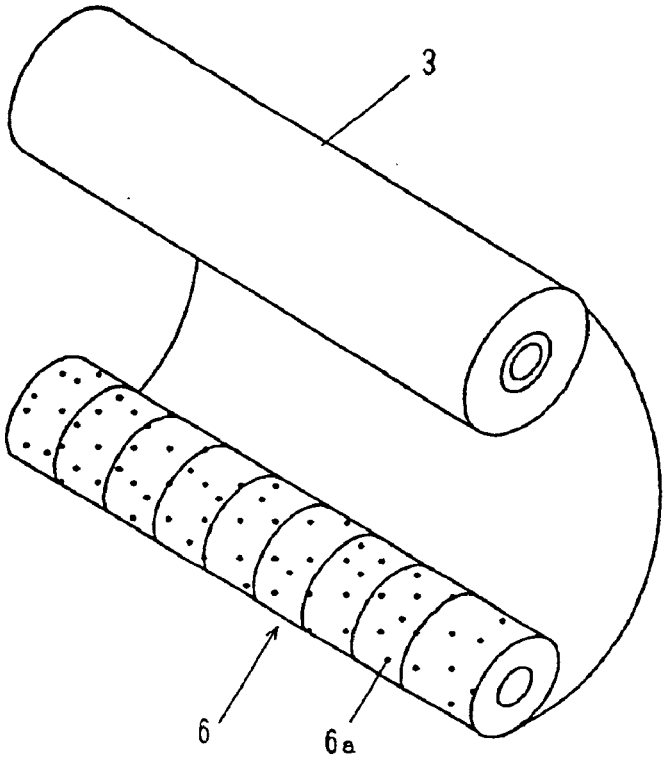
FIG. 95 is an explanatory drawing showing a conventional cleaning fabric take-up shaft.

A modification is shown in FIG. 94. A recessed portion 192 is formed in a notched portion of a shaft 6. In the recessed portion 192, a pawl 194 is mounted on a rotary shaft 193, which is provided in the axial direction. The pawl 194 is exposed and retracted by an on from the shaft end. The pawl 194 projects from the recessed portion 192 in FIG. 94 to engage the portion to be engaged, which is formed at the end side portion of the cleaning fabric. To release the engagement, the pawl 194 is rotated in the direction indicated by an arrow, and the engagement of the cleaning fabric with the end side portion is released.

In the above described embodiments, in order to facilitate the removal of the used cleaning fabric while it is retained in the shape that it acquired by being wound around the take-up shaft, the surface of the outer periphery of the take-up shaft is smoothed, or a teflon resin is coated on the surface of a take-up shaft, so that friction between the take-up shaft and the cleaning fabric is reduced. Further, smoothing the face f the end side portion of the cleaning fabric that contacts the take-up shaft is also effective. For example, the cleaning fabric 3 is coated with a teflon resin or wax, a low friction sheet such as a teflon resin sheet is used as a coupling member, or a film of low friction material is laminated with cleaning fabric during the manufacturing process.

Figure 97A:
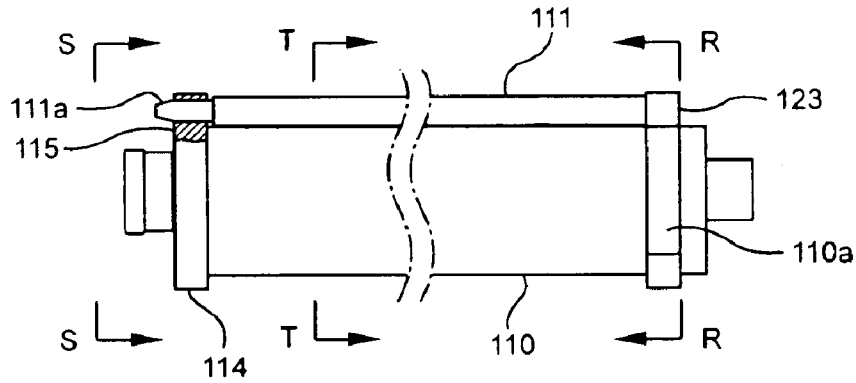
FIG. 97A is a front view of a cleaning fabric take-up shaft according to another embodiment of the present invention.
Figure 97B:
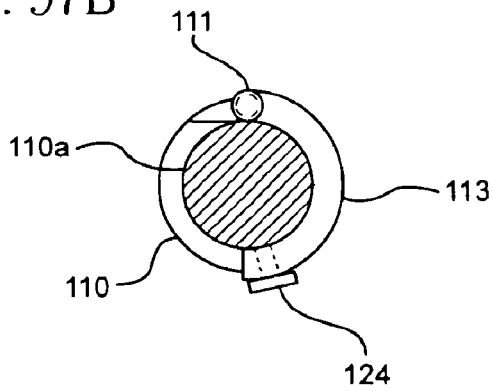
FIG. 97B is a diagram viewed along line R—R in FIG. 97A.
Figure 97C:
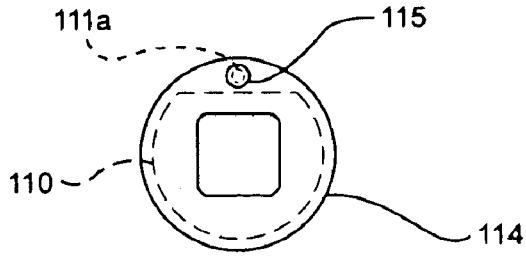
FIG. 97C is a diagram viewed along line S—S in FIG. 97A.

In the procedure for removing the cleaning fabric, the cleaning fabric is separated from the take-up shaft by rotating only the take-up shaft in the direction opposite the direction for winding. Then, the take-up shaft is extracted, and the used cleaning fabric roll is disposed of. Especially with an assembly that has means for disengaging the cleaning fabric from the take-up shaft, the work will be safe, and it will be easy to disengage the cleansing fabric from the shaft and to extract the take-up shaft., FIG. 97A is a front view of a cleaning fabric take-up shaft according to another embodiment of the present invention. FIG. 97B is a diagram viewed along line R—R in FIG. 97A, FIG. 97C is a diagram viewed along line S—S in FIG. 97A, FIG. 97D is a side view of a bar member and FIG. 97E is a cross-sectional view taken along line T—T in FIG. 97A.

In this embodiment, the assembly for mechanically changing the condition at the location where the take-up shaft contacts the cleaning fabric which has been taken up is so arranged that the end of a bar member 111 detachably fitted into the end of a shaft member 110.

The cleaning fabric take-up shaft comprises a shaft member 110 and a bar member 11 which extends along the entire length of the shaft member. The shaft member 110 has a circular shape in cross section and is provided with a portion 210 which is formed by partially cutting out the outer periphery of the shaft member 110 and extends in the axial direction of the shaft member 110. An end plate 114 is fixed to the one of the shaft member 110. An engagement hole 115 is formed in the end plate 114 at the position corresponding to the portion 210 for inserting the end 111*a* of the bar member 111. A circular groove 110*a* is formed in the vicinity of the other end of the shaft member 110.

Figure 97D:
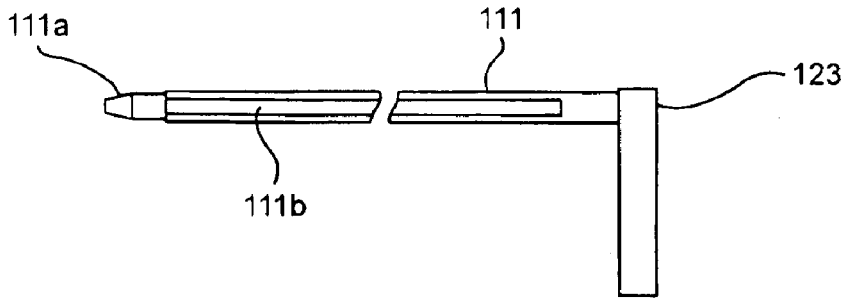
FIG. 97D is a side view of a bar member.
Figure 97E:
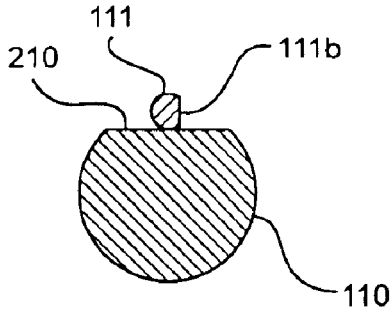
FIG. 97E is a cross-sectional view taken along line T—T in FIG. 97A.

The bar member 111 has such a shape in cross section that a circular is partially cut in a straight line as shown in FIGS. 97D and 97E, and is disposed in the vicinity of the cut out portion 210 of the shaft member 110. When the bar member 111 is set to the shaft member 110 as shown in FIG. 97A, a flat portion 111*b* of the bar member 111 is positioned at the inner side of circular contour of the shaft member 110 in a dislocation from the cut out portion 210. FIG. 97E shows a condition in which the bar member 111 is set to the shaft member 110.

Figure 98:
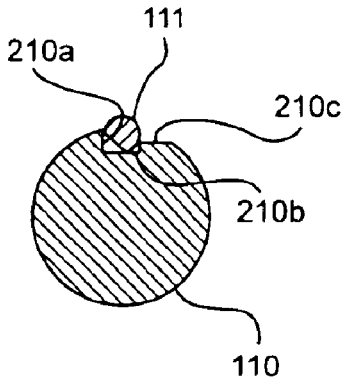
FIG. 98 is a cross-sectional view showing a modification of a shaft member.

FIG. 98 is a cross-sectional view showing a modification of the shaft member. The partially cut out face 210 of the shaft member 110 has wall surfaces 210*a* and 210*b* of a L-shape in cross section and the wall surface 210*b* is provided with a convex rising. 210*c* reaching to the circumferential surface of the shaft member 110. The bar member 111 is disposed in contact with the wall surfaces 210*a* and 210*b*.

The engagement for the cleaning fabric with the cleaning fabric take-up shaft will now be explained. Prior to setting the bar member 111 to the shaft member, the cleaning fabric is wound over the cut out portion 210 of the shaft member 110, and thereafter the end 111*a* of the bar member 111 is inserted into the engagement hole 115 of the end plate 114 to engage the end 111*a* with the end plate. A lever 123 is fitted into the circular groove 110*a* of the shaft member 110 by turning the lever 123 to press down it from above, and is fixed to the circular groove 110*a* by means of a cramp screw 124. As a result of this handling, the cleaning fabric is engaged between the cut out portion 210 of the shaft member 110 and the circumferential surface of the bar member 111 (the outer surface of the bar member except for the flat portion 111*b*).

In the modification shown in FIG. 97E, the cleaning fabric is engaged with the cleaning fabric take-up shaft at one place. In the modification shown in FIG. 98, the cleaning fabric is engaged with the wall surfaces 210*a* and 210*b* of the shaft member at two places.

Figure 99:
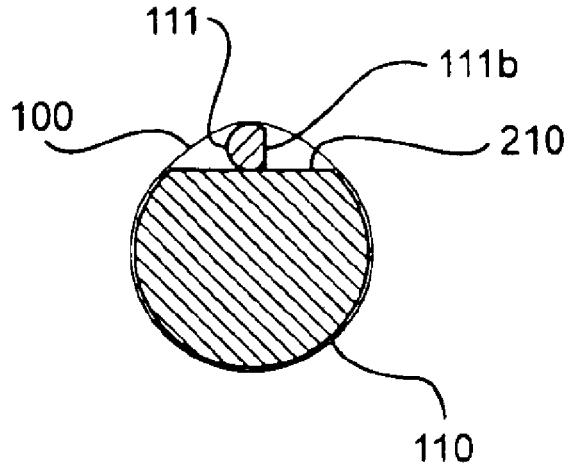
FIG. 99 is a cross-sectional view showing a modification of a shaft member in a first position.
Figure 100:
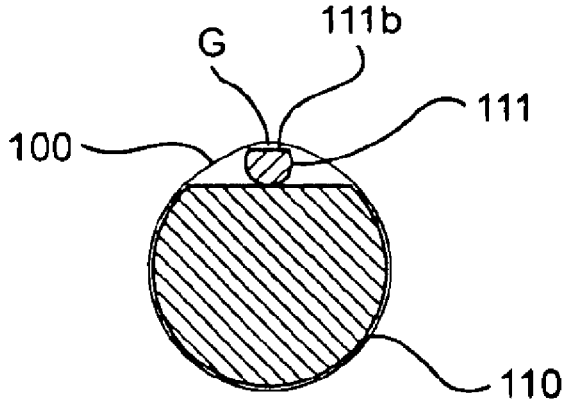
FIG. 100 is a cross-sectional view showing a modification of a shaft member in a second position.

When the cleaning fabric 3 is set to be wound around the cleaning fabric take-up shaft, a condition of the bar member 111 shown in FIG. 99 is regarded as a first position. When the cleaning fabric take-up shaft is pulled out from a cleaning fabric roll 100, a condition of the bar member 111 shown in FIG. 100 is regarded as a second position. In the second position of the bar member 111, the flat portion 111*b* of the bar member faces upward by loosening the clamp screw 124 of the lever 128 to turn the lever 123 in a counter-clockwise direction from the condition shown in FIG. 97B. By this handling, a gap, G is formed between the cleaning fabric roll 100 and the flat portion 111*b* of the bar member. Accordingly, when the bar member 111 is turned from the first position to the second position, the bar member 111 is loosed from the inner surface of the cleaning fabric taken up to the shaft member 110 so that the bar member is disengaged from the cleaning fabric. In this condition, first the bar member 11 can be pulled out from the shaft member 110, and then the shaft member 110 can be pulled out from the cleaning fabric roll 100.

What is claimed is:

1. A cylinder cleaning device for cleaning a circumferential surface of a cylinder by pressing a cleaning fabric passed between cleaning fabric supplying element for said cleaning fabric and cleaning fabric take-up shaft assembly for taking up said cleaning fabric against said circumferential surface of said cylinder, comprising:

a frame;

said cleaning fabric take-up shaft assembly, supported to said frame, that includes a shaft member which has a circular shape in cross section and which has a portion of the outer periphery thereof partially cut out extending in an axial direction;

a bar member which is disposed in said cut out portion of said shaft member and is supported to the end of said shaft member at one end thereof as well as being rotatable between a first position when the cleaning fabric is taken up and a second position when the cleaning fabric which has been taken-up is pulled out from said shaft member, said bar member having such a shape in cross section that when said bar member is rotated from the first position to the second position, said bar member is released from the inner surface of the cleaning fabric in a condition where said bar member is in contact with the cleaning fabric which has been taken up to said shaft member.

2. A cylinder cleaning device according to claim 1, wherein said bar member is removable from the end of said shaft member at one end thereof.

3. A cylinder cleaning device according to claim 1, wherein the partially cut out portion of said shaft member is formed by a groove.

4. A cylinder cleaning device according to claim 1, wherein the partially cut out portion of said shaft member has at least one wall surface which extends to a circumferential surface of said shaft member.

5. A cylinder cleaning device according to claim 1, wherein said bar member has an elliptic shape in cross section.

6. A cylinder cleaning device according to claim 1, wherein said bar member has a polygonal shape in cross section.

7. A cylinder cleaning device according to claim 1, wherein said bar member has a circular shape in cross section.

8. A cylinder cleaning device according to claim 1, wherein the cleaning fabric is passed between said bar member and said shaft member to rotate the bar member and the cleaning fabric is engaged between said bar member and said shaft member.

9. A cylinder cleaning device according to claim 3, wherein the cleaning fabric is passed between said bar member and said groove of said shaft member to rotate the bar member and the cleaning fabric is engaged between said bar member and the groove of said shaft member.

10. A cylinder cleaning device for cleaning a circumferential surface of a cylinder by pressing a cleaning fabric passed between cleaning fabric supplying element for said cleaning fabric and a cleaning fabric take-up shaft assembly for taking up said cleaning fabric against said circumferential surface of said cylinder, comprising:

a frame, said cleaning fabric take-up shaft assembly, supported to said frame, that includes a shaft member which has a circular shape in cross section and which has a portion of the outer periphery thereof partially cut out extending in an axial direction;

a bar member which is disposed in said partially cut out portion of said shaft member and is supported to the end of said shaft member at one end thereof as well as being rotatable between a first position when the cleaning fabric is taken up and a second position when the cleaning fabric which has been taken up is pulled out from said shaft member;

said bar member having such a shape in cross section that when said bar member is rotated from the first position to the second position, said bar member is released from the inner surface of the cleaning fabric in a condition where said bar member is in contact with the cleaning fabric which has been taken up to said shaft member; and a gap formed between a part or the whole of said bar member which is attached to said shaft member and a bottom of groove in said shaft member, and when said bar member is detached from the end of said shaft member, said shaft member is moved toward said gap and pulled out from said cleaning fabric.

11. A cylinder cleaning device according to claim 10, wherein the depth of said gap is greater from at, or in the vicinity of, the end of said shaft where said bar member is to be extracted from said shaft member, to the opposite end of said shaft.

12. A cylinder cleaning device according to claim 10, further comprising: a hook member having a bar member hook portion in the middle of said groove in said shaft member, wherein an end of said bar member detachably engages said bar member hook portion to thereby attach said bar member to said shaft member.

13. A cylinder cleaning device according to claim 12, wherein each of said bar members includes a plurality of bar member segments, in the axial direction of said shaft member and toward the center of said shaft, and wherein ends of said bar members on one side are detachably engaged with said bar member hook portion of said hook member, so that said bar member is pulled out from both ends of said shaft member.

14. A cylinder cleaning device according to claim 12, wherein a plurality of said hook members are formed.

15. A cylinder cleaning device for cleaning a circumferential surface of a cylinder by pressing a cleaning fabric passed between a cleaning fabric supplying element for said cleaning fabric and cleaning fabric take-up shaft assembly for taking up said cleaning fabric against said circumferential surface of said cylinder, comprising:

a frame;

said cleaning fabric take-up shaft assembly, supported to said frame, that includes a shaft member which has a circular shape in cross section and which has a groove formed in part of the outer surface thereof and extending in an axial direction; two bar members which are disposed in the groove of said shaft member in parallel arrangement and are detachably supported to the end of said member at each one end thereof as well as being movable between a first position when the cleaning fabric is taken up and a second position in which said shaft member is detached from the end thereof and when the cleaning fabric which has been taken up is pulled out from said shaft member;

wherein when said bar members move from the first position to the second position, said bar members are released from the inner surface of the cleaning fabric in a condition where said bar members are in contact with the cleaning fabric which has been taken up by said take-up shaft member.

16. A cylinder cleaning device according to claim 15, wherein a plurality of said grooves are formed in said outer surface of said shaft and wherein said bar members are detachably fitted in said grooves, respectively.

17. A cylinder cleaning device according to claim 15, wherein when the cleaning fabric is passed between said bar members and a groove of said shaft member to move the bar members to the first position, the cleaning fabric is engaged between said bar members and a groove of said shaft member.

18. A cylinder cleaning device for cleaning a circumferential surface of a cylinder by pressing a cleaning fabric passed between cleaning fabric supplying element for said cleaning fabric and cleaning fabric take-up shaft assembly for taking up said cleaning fabric against said circumferential surface of said cylinder, comprising:

a frame;

said cleaning fabric take-up shaft assembly, supported by said frame, that includes a mechanical structure for changing a circumference of said cleaning fabric take-up shaft assembly thereof to mechanically change a condition in contact with said cleaning fabric, which is wound up around said cleaning fabric take-up shaft assembly, with said mechanical structure consisting of a shaft member, for which a groove of a predetermined width is formed in an outer surface of said shaft in the axial direction thereof, and a bar member, which is inserted into said groove of said shaft member so that said cleaning fabric contacts one part of the outer surface during the winding of said cleaning fabric, and where said bar member has at least one end detachably attached to an end of said shaft member, and with said bar member consisting of a plurality of bar member segments, one end of said shaft member and the other end of said bar member segments being detachably attached to the other end of said shaft member, so that when said bar member segments are attached to said shaft member, said bar member segments are connected to each other.

19. A cylinder cleaning device according to claim 18, wherein, in said connection structure for said bar member segments, a connection member is attached to an end of said bar member segments, or ends of both of said bar member segments, to be coupled with other bar member segments via said connection member.

20. A cylinder cleaning device according to claim 18, wherein, in said connection structure for said bar member segments, a portion to be engaged is formed to one bar member se rent and an engagement portion is provided to the other bar member segment, so that said engagement portion is connected to said portion to be engaged.

21. A cylinder cleaning device according to claim 20, wherein said portion to be engaged is a hole formed in a distal end of said bar member segment, and said engagement portion is a projection, and wherein said projection is fitted into, and coupled with, said hole by moving said bar member in a longitudinal direction.

* * * * *